US011946245B2

(12) United States Patent
Bowron

(10) Patent No.: US 11,946,245 B2
(45) Date of Patent: Apr. 2, 2024

(54) CONNECTOR FOR A MODULAR BUILDING

(71) Applicant: Z-MODULAR HOLDING, INC., Chicago, IL (US)

(72) Inventor: Julian Bowron, Toronto (CA)

(73) Assignee: Z-MODULAR HOLDING, INC., Chicago, IL (US)

( * ) Notice: Subject to any disclaimer, the term of this patent is extended or adjusted under 35 U.S.C. 154(b) by 0 days.

(21) Appl. No.: 18/087,486

(22) Filed: Dec. 22, 2022

(65) Prior Publication Data

US 2023/0175250 A1 Jun. 8, 2023

Related U.S. Application Data

(63) Continuation of application No. 15/752,510, filed as application No. PCT/CA2016/050954 on Aug. 12, 2016, now Pat. No. 11,536,020.

(Continued)

(51) Int. Cl.
*E04B 1/41* (2006.01)
*E04B 1/19* (2006.01)

(Continued)

(52) U.S. Cl.
CPC ..... *E04B 1/41* (2013.01); *E04B 1/1903* (2013.01); *E04B 1/24* (2013.01); *E04B 1/343* (2013.01);

(Continued)

(58) Field of Classification Search
CPC .. E04B 1/1903; E04B 1/40; E04B 2001/1978; E04B 2001/2451; E04B 2001/2403; E04B 2001/2406; E04B 2001/2472; E04B 2001/2418; F16B 7/0486; F16B 7/185; B66C 1/66; Y10T 403/4602;

(Continued)

(56) References Cited

U.S. PATENT DOCUMENTS 946,423 A * 1/1910 Connaty ..... E04B 1/2403 403/217
2,037,736 A 4/1936 Payne (Continued)

FOREIGN PATENT DOCUMENTS

AU 2014221181 B2 3/2018
AU 2018204197 A1 7/2018

(Continued)

OTHER PUBLICATIONS

Extended European Search Report for corresponding application No. PCT/CA2014050110 dated Jan. 20, 2017.

(Continued)

*Primary Examiner* — Brian E Glessner
*Assistant Examiner* — Adam G Barlow
(74) *Attorney, Agent, or Firm* — Fitch, Even, Tabin & Flannery, LLP

(57) ABSTRACT

A connector assembly, having an upper connector, a pin coupling the upper connector to a lower connector and a gusset plate sandwiched between the upper and lower connectors. Also, disclosed is a hoistable connector assembly, a lifting frame assembly, a coupling system for modular frame units, a method for assembling a module unit using the connector assembly, and a modular frame unit and building having the connector assembly.

9 Claims, 42 Drawing Sheets

Related U.S. Application Data

(60) Provisional application No. 62/205,366, filed on Aug. 14, 2015.

(51) Int. Cl.

| | |
|---|---|
| ***E04B 1/24*** | (2006.01) |
| ***E04B 1/343*** | (2006.01) |
| ***E04B 1/348*** | (2006.01) |
| ***E04G 21/14*** | (2006.01) |
| ***E04H 1/00*** | (2006.01) |
| *E04B 1/38* | (2006.01) |
| *E04H 1/12* | (2006.01) |

(52) U.S. Cl.
CPC ..... *E04B 1/3483* (2013.01); *E04G 21/142* (2013.01); *E04H 1/005* (2013.01); *E04B 2001/389* (2023.08); *E04H 2001/1283* (2013.01)

(58) Field of Classification Search
CPC .. Y10T 403/73; Y10T 403/555; Y10T 403/42
See application file for complete search history.

(56) References Cited

U.S. PATENT DOCUMENTS 3,205,611 A 9/1965 Onanian
3,357,727 A * 12/1967 Finkenstein ..... F16B 17/004 403/176
3,416,270 A 12/1968 McHugh
3,752,511 A * 8/1973 Racy ..... B65D 90/0013 410/82
3,824,750 A 7/1974 Antoniou
3,858,989 A 1/1975 Field
3,973,855 A * 8/1976 Florence ..... F16B 12/44 52/645
4,003,144 A 1/1977 Maddestra
4,021,127 A * 5/1977 Gasparro ..... A47B 47/005 403/171
D248,447 S 7/1978 Hornung
D258,194 S 2/1981 Stanley
4,620,404 A 11/1986 Rizk
4,726,701 A 2/1988 Thomas
4,758,111 A 7/1988 Vitta
4,844,648 A * 7/1989 Fentiman ..... E04B 1/2403 403/171
4,925,330 A 5/1990 Cornish
5,066,161 A 11/1991 Pinney
5,127,759 A 7/1992 Orbom
5,259,685 A 11/1993 Gilb
D357,544 S 4/1995 Spransy
5,414,918 A 5/1995 Pearson
5,440,544 A 8/1995 Zinser, Jr.
5,451,115 A 9/1995 Sayres
5,516,225 A * 5/1996 Kvols ..... A47B 47/0008 403/231
5,556,218 A 9/1996 Homer
5,590,974 A * 1/1997 Yang ..... A47B 47/005 403/171
5,605,410 A * 2/1997 Pantev ..... F16B 7/0486 403/174
5,727,358 A 3/1998 Hayashi
5,816,011 A 10/1998 Kuramoto
5,820,289 A * 10/1998 Kern ..... H05K 7/183 403/231
5,904,437 A * 5/1999 Allen ..... F16B 7/0446 403/171
5,921,049 A 7/1999 Sugiyama
6,062,761 A * 5/2000 Allen ..... F16B 7/0446 403/409.1
6,092,849 A 7/2000 Zambelli
6,247,869 B1 * 6/2001 Lichvar ..... F16L 47/00 403/403
6,332,657 B1 * 12/2001 Fischer ..... A47B 47/005 403/217
6,334,286 B1 1/2002 Zambelli
6,390,719 B1 * 5/2002 Chan ..... E04B 1/5806 52/646
6,974,276 B2 * 12/2005 Kirchner ..... F16B 7/0486 248/62
7,334,377 B2 2/2008 Dubensky
7,503,623 B2 * 3/2009 Favaretto ..... B62D 23/005 280/798
D622,865 S 8/2010 Bajrami
7,882,388 B2 2/2011 Bramante
7,883,288 B2 * 2/2011 Jorna ..... F16B 7/0453 403/171
7,941,985 B2 5/2011 Simmons
8,176,703 B2 5/2012 Tremacchi
8,671,644 B2 * 3/2014 Huang ..... A47B 13/06 403/172
9,121,433 B1 * 9/2015 Bacon ..... F16B 7/0446
D756,202 S 5/2016 Leduc
9,334,642 B1 5/2016 Tanaka
9,458,619 B2 10/2016 Bowron
9,579,589 B1 * 2/2017 Lee ..... A63H 33/105
9,845,595 B2 12/2017 Bowron
9,932,734 B1 4/2018 Winter
10,036,156 B1 7/2018 Macdonald
10,450,737 B2 10/2019 Bowron
D867,108 S 11/2019 Bowron
10,907,342 B1 * 2/2021 Parkhouse ..... E04B 1/388
11,644,056 B2 * 5/2023 Sikeler ..... F16B 12/52 403/170
2002/0007614 A1 1/2002 Katayama
2005/0034390 A1 * 2/2005 Dubensky ..... E04B 1/3483 52/302.1
2006/0112657 A1 * 6/2006 Abbot-Wilcox ..... E04B 1/2604 52/633
2009/0087255 A1 4/2009 Jorna
2009/0205276 A1 8/2009 Tremacchi
2009/0307994 A1 12/2009 Cathcart
2011/0219708 A1 9/2011 Ohnishi
2011/0286121 A1 * 11/2011 Werner ..... F24S 23/74 359/872
2011/0308063 A1 12/2011 Feeleus
2013/0045042 A1 * 2/2013 Ohlson ..... E04B 1/585 403/171
2013/0306808 A1 * 11/2013 Huang ..... A47B 13/06 248/163.1
2014/0102993 A1 * 4/2014 Werner ..... F24S 23/74 211/1.51
2014/0286695 A1 * 9/2014 Jocham ..... H02B 1/30 403/205
2014/0294500 A1 * 10/2014 Schaaf ..... H02B 1/301 403/403
2015/0184369 A1 * 7/2015 Carless ..... E04B 1/19 52/762
2016/0002909 A1 1/2016 Bowron
2017/0002559 A1 1/2017 Bowron
2017/0044753 A1 2/2017 Bowron
2017/0089059 A1 3/2017 Farre Berga
2018/0127967 A1 5/2018 Bowron
2018/0135295 A1 5/2018 Bowron
2018/0216336 A1 8/2018 Macdonald
2019/0044753 A1 2/2019 Neeld
2019/0078321 A1 3/2019 Bowron
2019/0136504 A1 5/2019 Burgess
2019/0330838 A1 10/2019 Bowron
2020/0035495 A1 11/2020 Bowron

FOREIGN PATENT DOCUMENTS

CA 2744074 A1 12/2011
CN 1149651 A 5/1997
CN 2381869 Y 6/2000
CN 101575876 A 11/2009
CN 101680227 A 3/2010
CN 101769008 A 7/2010
CN 202559534 U 11/2012

(56) References Cited

FOREIGN PATENT DOCUMENTS

| | | | |
|---|---|---|---|
| CN | 202672346 | U | 1/2013 |
| CN | 203834666 | U | 9/2014 |
| CN | 104612250 | A | 5/2015 |
| DE | 249688 | A1 | 9/1987 |
| DE | 19517785 | | 11/1996 |
| DE | 69704916 | T2 | 11/2001 |
| EP | 0761895 | A1 | 3/1997 |
| EP | 1683923 | A2 | 7/2006 |
| EP | 2759648 | A1 | 7/2014 |
| EP | 2818429 | A1 | 12/2014 |
| EP | 2959067 | A4 | 2/2017 |
| GB | 2300432 | A | 11/1996 |
| GB | 2554967 | A | 4/2018 |
| JP | S52-094009 | U | 7/1977 |
| JP | S62-031604 | U | 2/1987 |
| JP | S63-179306 | U | 11/1988 |
| JP | H03-066303 | U | 6/1991 |
| JP | H03-224926 | A | 10/1991 |
| JP | H03233042 | A | 10/1991 |
| JP | H03267431 | A | 11/1991 |
| JP | H03267431 | B1 | 11/1991 |
| JP | H04-098904 | U | 8/1992 |
| JP | H04261733 | A | 9/1992 |
| JP | H05195584 | A | 8/1993 |
| JP | H0642060 | A | 2/1994 |
| JP | H07180221 | A | 7/1995 |
| JP | H07180228 | A | 7/1995 |
| JP | 3014203 | U | 8/1995 |
| JP | H07243239 | A | 9/1995 |
| JP | H07300901 | A | 11/1995 |
| JP | H0967869 | A | 3/1997 |
| JP | H09194179 | A | 7/1997 |
| JP | H09-278352 | A | 10/1997 |
| JP | H09278352 | A | 10/1997 |
| JP | H10245929 | A | 9/1998 |
| JP | H10331267 | A | 12/1998 |
| JP | 2001214530 | A | 8/2001 |
| JP | 2002081140 | A | 3/2002 |
| JP | 2003293458 | A | 10/2003 |
| JP | 2004270438 | A | 9/2004 |
| JP | 2005139623 | A | 6/2005 |
| JP | 2006063787 | A | 3/2006 |
| JP | 2009024419 | A | 2/2009 |
| JP | 2010112008 | A | 5/2010 |
| JP | 2010168889 | A | 8/2010 |
| JP | 2013167131 | A | 8/2013 |
| JP | 2013245501 | A | 12/2013 |
| JP | 2016513192 | A | 5/2016 |
| JP | 2017515027 | A | 6/2017 |
| JP | 2018529913 | A | 10/2018 |
| KR | 100923637 | B1 | 10/2009 |
| KR | 20110053101 | A | 5/2011 |
| KR | 10-1233559 | B1 | 2/2013 |
| KR | 101676411 | B1 | 11/2016 |
| KR | 20160148659 | A | 12/2016 |
| TW | 294752 | B | 1/1997 |
| WO | 9836134 | A1 | 8/1998 |
| WO | 03069083 | A1 | 8/2003 |
| WO | 2004035952 | A1 | 4/2004 |
| WO | 2006096997 | A1 | 9/2006 |
| WO | 2006122372 | A1 | 11/2006 |
| WO | 2007144913 | A1 | 12/2007 |
| WO | 2010035816 | A1 | 4/2010 |
| WO | 2012083391 | A1 | 6/2012 |
| WO | 2012129601 | A1 | 10/2012 |
| WO | 2012129701 | A1 | 10/2012 |
| WO | 2014127472 | A1 | 8/2014 |
| WO | 2015164975 | A1 | 11/2015 |
| WO | 2016165022 | A1 | 10/2016 |
| WO | 2017027965 | A1 | 2/2017 |
| WO | 2018132921 | A1 | 7/2018 |
| WO | 2019016617 | A1 | 1/2019 |
| WO | 2019162712 | A1 | 8/2019 |

OTHER PUBLICATIONS

Written Opinion issued by the Canadian Intellectual Property Office for International Application No. PCT/2016/050954 dated Oct. 14, 2016, 8 pages.

Extended European Search Report issued against corresponding International Application PCT/CA2015050369 dated Nov. 20, 2017. Information on Search Strategy.

Office Action issued against corresponding Japanese Patent Application No. JP2015-558313 dated Mar. 6, 2018.

Chinese Office Action dated Jun. 19, 2018.

Extended European Search Report issued against International Application No. PCT/CA2016050954 dated Feb. 14, 2019.

Extended European Search Report issued against International Application No. PCT/CA2014050110 dated Jan. 20, 2017.

Office Action issued against corresponding Japanese Application 2017-508717 dated Feb. 26, 2019.

First Office Action and Search Report for corresponding Chinese Patent Application No. 201680027827 .9 dated Apr. 15, 2019.

Written Opinion of the International Searching Authority for PCT/CA2015050369 dated Jul. 14, 2015.

Office Action issued against corresponding Chinese Application No. 201480022662.7 dated Jul. 18, 2017.

International Search Report for International Application No. PCT/CA2016/050954 dated Oct. 14, 2016, 5 pages.

International Search Report for International Application No. PCT/CA2018/050065 dated Apr. 16, 2018, 4 pages.

Written Opinion of the International Searching Authority for PCT/CA2018/050065 dated Apr. 16, 2018, 5 pages.

International Search Report for International Application No. PCT/CA2016/050434 dated Jun. 23, 2016.

Written Opinion of the International Searching Authority for International Application No. PCT/CA2014/050110 dated May 5, 2014.

Written Opinion of the International Searching Authority for PCT/CA2016050434 dated Jun. 23, 2016.

IPOS Written Opinion issued against corresponding Singaporean Patent Application No. 11201906602S dated Sep. 4, 2020 in English (7 pages) .

Office Action issued against corresponding Chinese Patent Application No. 201880013 277.4 dated Oct. 27, 2020 in Chinese (13 pages).

Office Action issued against corresponding Indonesian Patent Application No. P00201904813 dated Sep. 14, 2020; English translation submitted herewith (4 pages).

First Examination Report issued against corresponding Australian Patent Application No. 2016247454 dated May 20, 2020 in English (8 pages) .

Second Examination Report issued against corresponding Australian Patent Application No. 2016247454 dated Jun. 23, 2020 in English (9 pages).

Office Action issued against corresponding Brazilian Patent Application No. BR112018002870-3 dated Aug. 5, 2020 in Portuguese (4 pages).

Office Action issued against corresponding Chinese Patent Application No. 2016800526457 dated Jun. 9, 2020 in Chinese and English (8 pages).

Office Action issued against corresponding Japanese Patent Application No. 2018-526978 dated Aug. 21, 2020 in Japanese and English (14 pages).

Office Action issued against corresponding Brazilian Patent Application No. BR112015020099 dated Jun. 2, 2020 in Portuguese (4 pages).

Written Opinion issued by the Intellectual Property Office of Singapore for International Application No. PCT/CA2014/050110 dated May 2, 2016, 5 pages.

PCT International Search Report for International Application No. PCT/CA2014/050110 dated May 5, 2014, 4 pages.

English translation of Office Action issued against corresponding Japanese patent application 2018-218118, dated Dec. 17, 2019.

Substantive Examination Report issued by the Intellectual PropertyCorporation of Malaysia against corresponding Malaysian patent application PI 2016001907, dated Jan. 16, 2020.

(56) References Cited

OTHER PUBLICATIONS

Examination Report issued by Intellectual Property India against corresponding Indian patent application 201617036767, dated Feb. 21, 2020.
English translation of First Office Action issued against corresponding Japanese patent application 20 17-50871 7, dated Dec. 24, 2019.
Form 2906 issued by EPO against corresponding EPO patent application 14 754 894 .5, dated Nov. 25, 2019 (in English).
Notice of Grant of Patent issued for corresponding Chinese Patent Application No. 201810153991.5 dated Mar. 30, 2021 with English translation ( 4 pages).
Office Action issued against corresponding South Korean Patent Application No. 10-2021-7005101 dated Apr. 28, 2021 with English translation (7 pages).
Office Action issued against corresponding Chinese Patent Application No. 201880013277.4 dated Oct. 27, 2020 with English translation ( 42 pages).
Office Action issued against corresponding Indian Patent Application No. 201817005845 dated Sep. 14, 2020 with English translation (6 pages).
Certificate of Grant issued by IPOS for Singaporean Patent Application No. 11201801190R dated Oct. 14, 2020, in English (3 pages).
Office Action issued against corresponding Chinese Patent Application No. 201680052645.7 dated Feb. 2, 2021 with English translation (5 pages).
Office Action issued against corresponding Australian Patent Application No. 2016308775 dated Feb. 25, 2021 in English (2 pages).
Office Action issued against corresponding JP Patent Application No. 2018-526978 dated Apr. 22, 2021 with English translation (6 pages).
Certificate of Grant issued for corresponding Australian Patent Application No. 2018204197 dated Nov. 12, 2020 in English (1 page).
Office Action issued against corresponding Indian Patent Application No. 8541/DELNP/2015 dated Nov. 18, 2020 with English translation (6 pages).
Certificate of Patent issued for corresponding Japanese Patent Application No. 2018-218118 with English translation (10 pages).
Notice of Allowance issued for corresponding Mexican Patent Application No. MX/a/2015/010800 dated Jul. 27, 2020 with English translation (2 pages).
Notice of Allowance issued for corresponding South Korean Patent Application No. 10-2015-7026049 dated Nov. 20, 2020 with English translation (7 pages).
Office Action issued against corresponding Chinese Patent Application No. 201810153991.5 dated Aug. 31, 2020 with English translation (6 pages).
Office Action issued against corresponding Canadian Patent Application No. 2,901,755 dated Oct. 30, 2020 in English (4 pages).
Substantive Examination Clear Report issued against corresponding Malaysian Patent Application No. PI 2015002061 dated Nov. 12, 2020 in English ( 1 page).
Written Opinion and Search Report issued against corresponding Singaporean Patent Application No. 10201610543Q dated Sep. 8, 2020 in English (10 pages).
Office Action issued against corresponding Japanese Patent Application No. 2022-016873 dated Sep. 28, 2023 English Translation (4 pages).
Search Report issued against corresponding European Patent Application No. 23 179 873.7 dated Oct. 20, 2023 in English (5 pages).
Office Action issued against corresponding United Arab Emirates Patent Application No. P6000248/2018 dated Sep. 19, 2023 English Translation (5 pages).
Extended European Search Report issued against corresponding EP Patent Application No. 21152108.3 dated May 4, 2021 in English (7 pages).
Office Action issued against corresponding South Korean Patent Application No. 10-2016-7033280 dated Apr. 26, 2021 in English and Korean (23 pages).
Certificate of Grant issued for corresponding Malaysian Patent Application No. 2016001907 dated Oct. 27, 2020 in English (5 pages).
Search Report issued against corresponding Brazilian Patent Application No. BR112016025375-2 dated Jul. 12, 2020 with English machine translation ( 11 pages).
Search Report issued against corresponding Chinese Patent Application No. 2019104842745 dated Oct. 27, 2020 with English translation ( 11 pages).
Communication under Rule 71(3) EPC issued for corresponding European Patent Application No. 15 785 510.7 dated Aug. 3, 2020 in English (6 pages).
Office Action issued against corresponding Indonesian Patent Application No. P00201607453 dated Apr. 30, 2020 with English machine translation (4 pages).
Office Action issued against corresponding Indonesian Patent Application No. P00201607453 dated Aug. 24, 2020 with English machine translation (4 pages).
Office Action issued against corresponding Japanese Patent Application No. 2017-508717 dated Nov. 24, 2020 with English machine translation (9 pages).
Office Action issued against corresponding Mexican Patent Application No. MX/a/2016/014274 dated Aug. 26, 2020 with English machine translation (6 pages).
Office Action issued against corresponding Japanese Patent Application No. 2018-505507 dated Nov. 17, 2020 with English translation (6 pages).
International Preliminary Report on Patentability issued for corresponding International Application No. PCT/CA2019/050960 dated Jan. 12, 2021 (4 pages).
Office Action issued against corresponding EP Patent Application No. 14 754 894.5 dated Apr. 16, 2021 in English (5 pages).
Office Action issued against corresponding CN Patent Application No. 201880013277.4 dated May 27, 2021 with English translation (26 pages).
Office Action issued against corresponding IN Patent Application No. 201917030094 dated May 19, 2021 with English translation (7 pages).
Office Action issued against corresponding MX Patent Application No. MX/a/2017/013296 dated May 17, 2021 with English translation (10 pages).
Office Action issued against corresponding JP Patent Application 2018-505507 dated Jun. 14, 2021 with English translation (6 pages).
Brazilian Patent Office, Application No. BR112015020099-0; Office Action dated Oct. 6, 2021. (in Portuguese with English translation).
Office Action issued against corresponding CA Patent Application No. 2,901,755; dated Sep. 7, 2021 (3 pages).
Office Action issued against corresponding EP Patent Application No. 16836312.5 dated Aug. 27, 2021 (5 pages).
Office Action issued against AU Patent Application No. 2020260531; dated Aug. 19, 2021 (4 pages).
Office Action issued against AU Patent Application No. 2019283912; dated Sep. 27, 2021 (4 pages).
CNIPA, Application No. 201880013277.4; Office Action dated Jan. 21, 2022. (in Chinese with English translation).
EPO; Application No. 18741568.2; Intention to Grant dated Oct. 18, 2021.
JPO; Application No. 2019-540006; Office Action dated Oct. 5, 2021.
IMPI; Application No. MX/a/2018/001821 ; Office Action dated Mar. 11, 2022. (Related case; Machine translation).
KIPO; Application No. 10-2019-7024117; Office Action dated Feb. 24, 2022. (Related case; Machine translation).
Examination Report dated May 17, 2022, in Brazilian Application No. BR112018002870-3, 9 pages.
Written Opinion dated May 2, 2022, in Singaporean Application No. 11202100236X, 6 pages.
Search and Examination Reports dated Apr. 28, 2022, in United Arab Emirates Application No. P6000248/2018, 12 pages.
Communication dated Mar. 25, 2022, in European Application No. 16836312.5, 4 pages.

(56) References Cited

OTHER PUBLICATIONS

Communication dated Feb. 25, 2022, in European Application No. 19833475.7, 6 pages.
Examination Report dated Mar. 16, 2022, in Brazilian Application No. BR112015020099-0, 6 pages.
European Search Report dated Jul. 8, 2022, for European Application No. 22165259.7 (12 pages).
Examination Report dated Jul. 28, 2022, for Indian App. No. 202147003273 (6 pages).
Office Action dated Jun. 20, 2022, in Korean Application No. 10-2022-7011193 , with English language machine translation (7 pages).
Office Action dated Jun. 21, 2022, in Japanese Patent Application No. JP 2021-108974, with English language machine translation (7 pages).
Office Action dated Aug. 1, 2022, in Chinese Application No. 201980054125.3, together with English language translation thereof (36 pages).
Supplementary European Search Report for corresponding application No. PCT/CA2014050110 dated Feb. 17, 2017.
Office Action Issued on basis of Art 35 in corresponding Brazilian Patent Application BR112019014771-3 (Portuguese with English translation) dated Nov. 1, 2022.
Office Action Issued against corresponding Mexican Patent Application No. MX/a/2019/008532 (Spanish with English Translation) dated Oct. 19, 2022.
Office Action issued against corresponding Korean Patent Application No. 10-2018-7006810 dated Aug. 30, 2023 English Translation (16 pages).
Office Action issued against corresponding Japanese Patent Application No. 2021-500562 dated Aug. 2, 2023 English Translation (6 pages).
Office Action issued against corresponding EP Patent Application No. 21152108.3 dated Sep. 12, 2023 (5 pages).
Office Action issued against corresponding BR Patent Application No. BR112021000532-3 dated Jun. 28, 2023 (8 pages).
Office Action dated Feb. 2, 2023, in U.S. Appl. No. 17/680,954 (15 pages).
Search Report dated Nov. 30, 2022, in Singapore Application No. 10201900884S (2 pages).
Written Opinion dated Dec. 1, 2022, in Singapore Application No. 10201900884S (6 pages).

* cited by examiner

FIG. 1.1
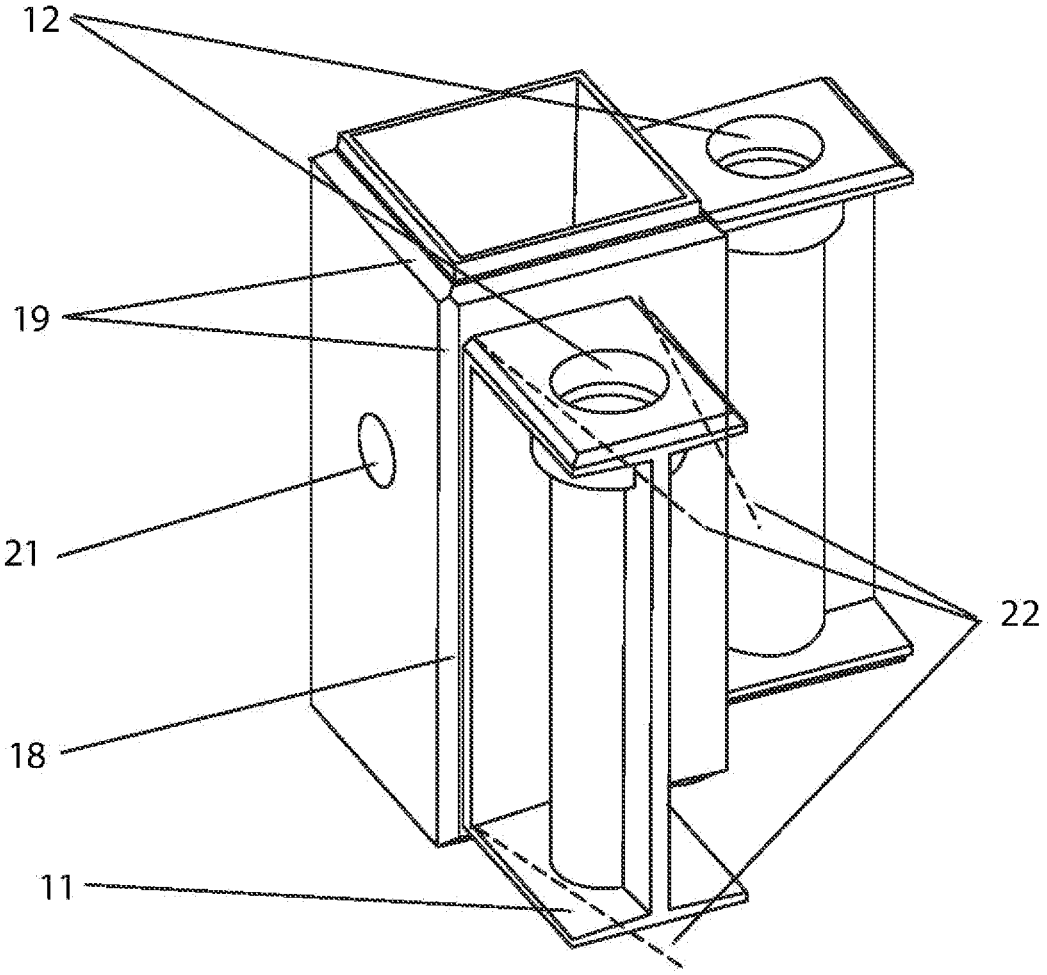

FIG. 1.2
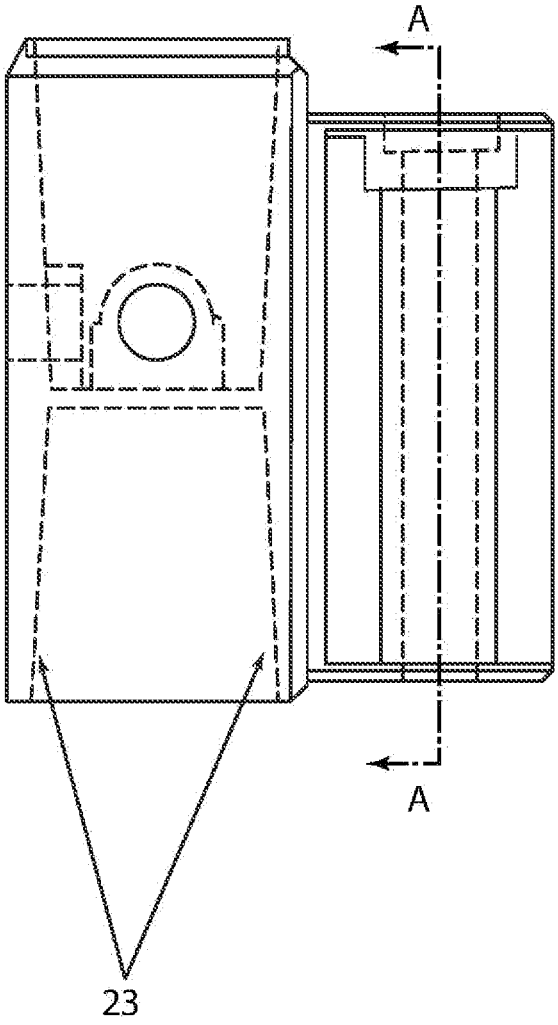

FIG. 1.3
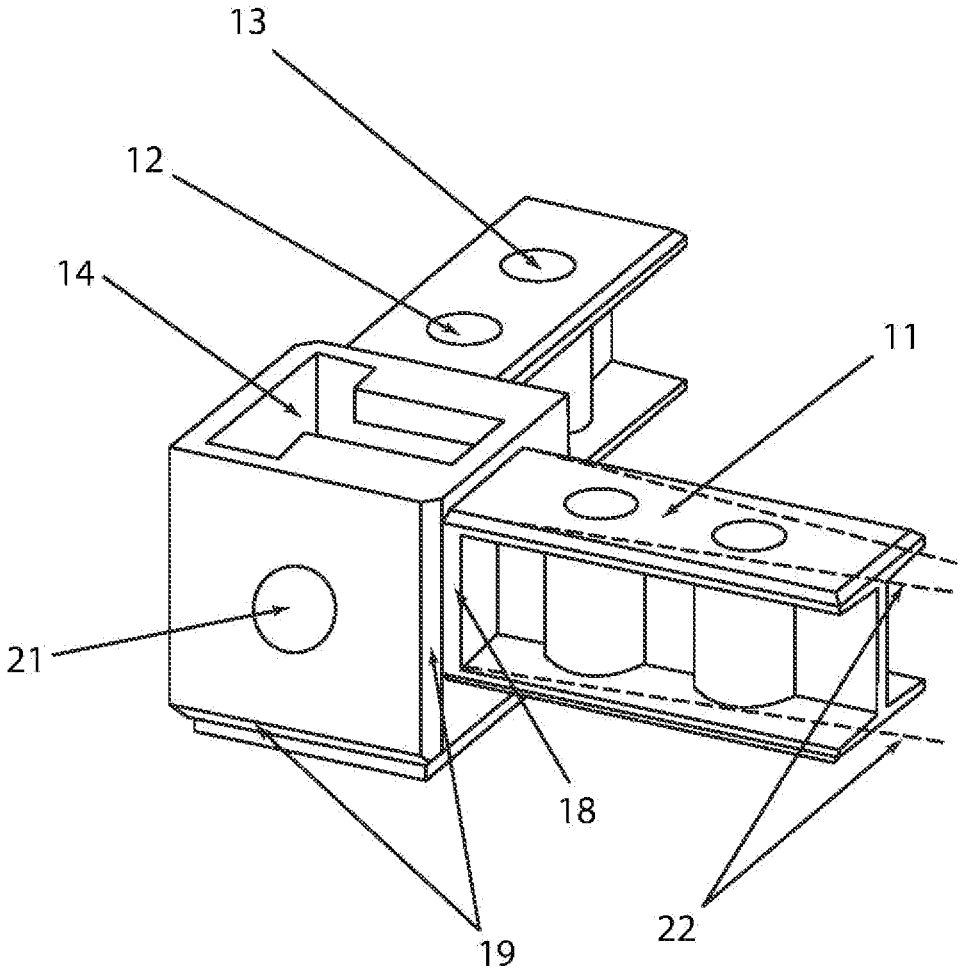

FIG. 2.1
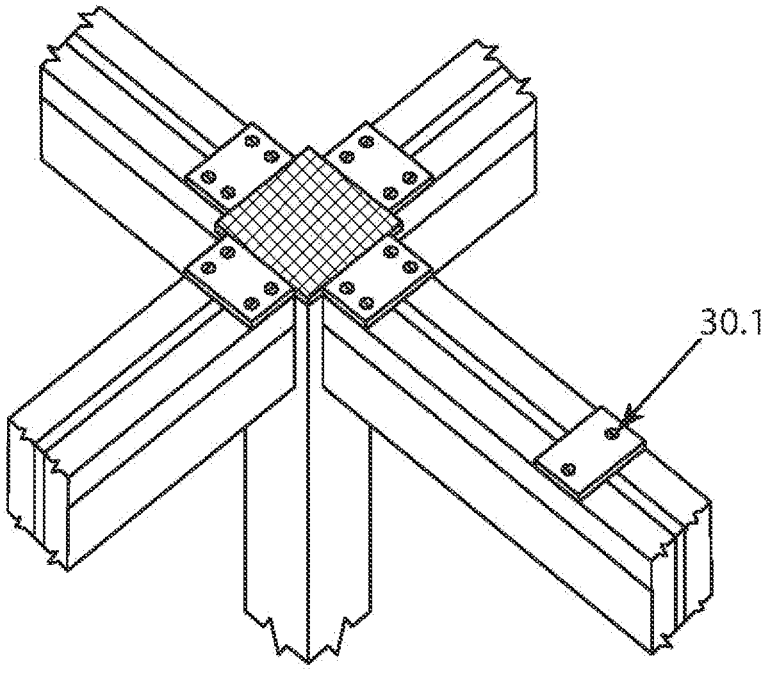
FIG. 2.2
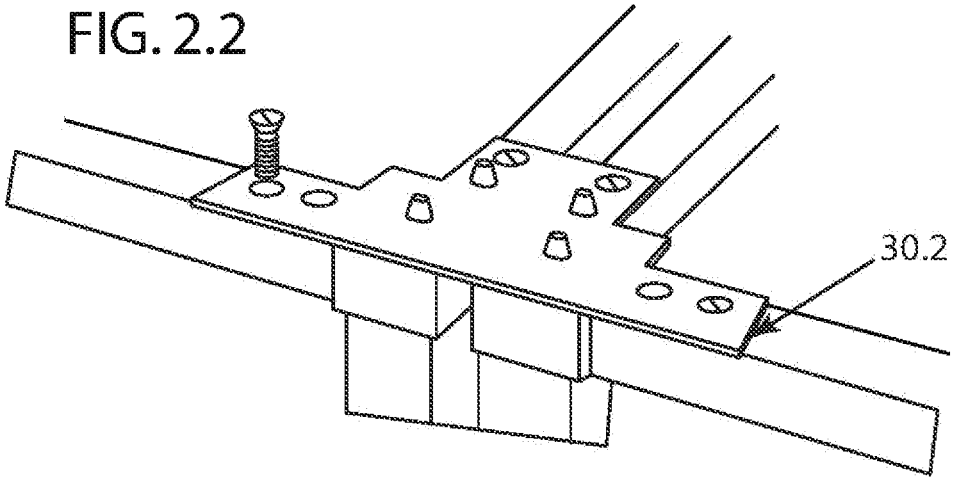

FIG. 3.1
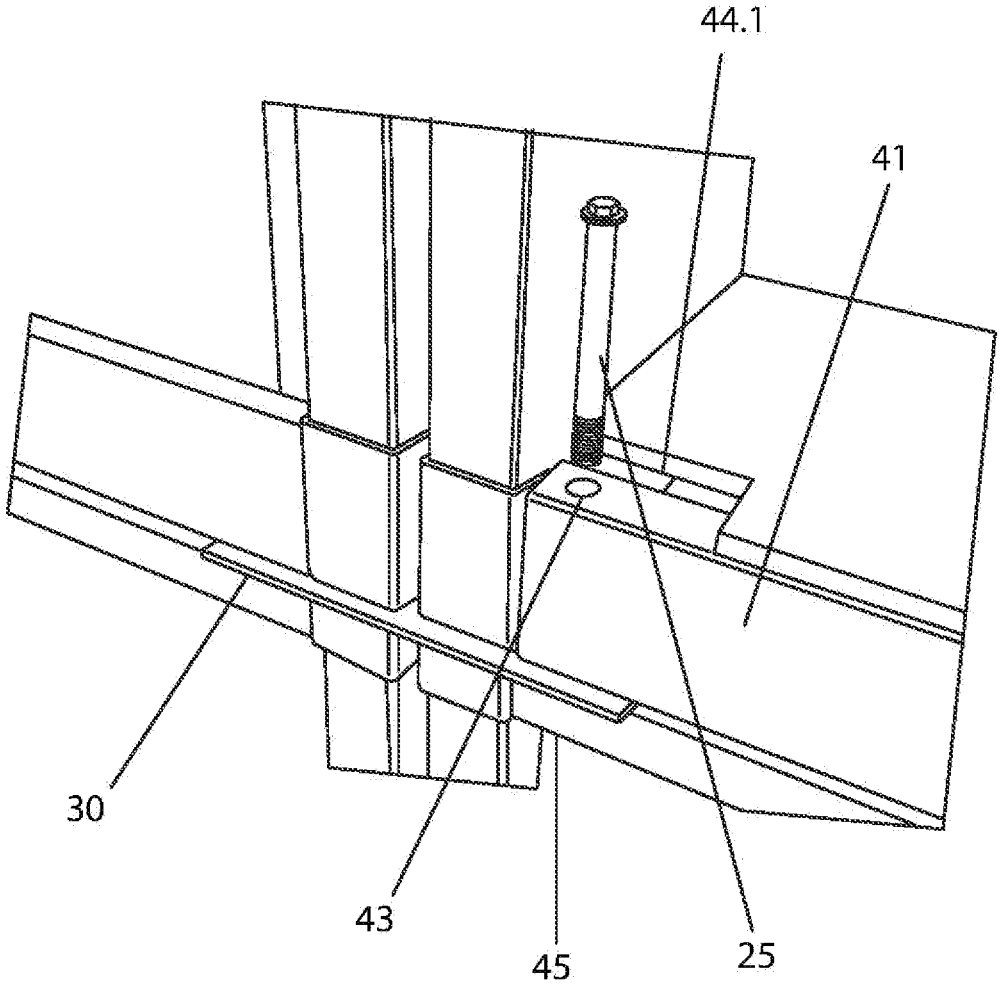

FIG. 3.2
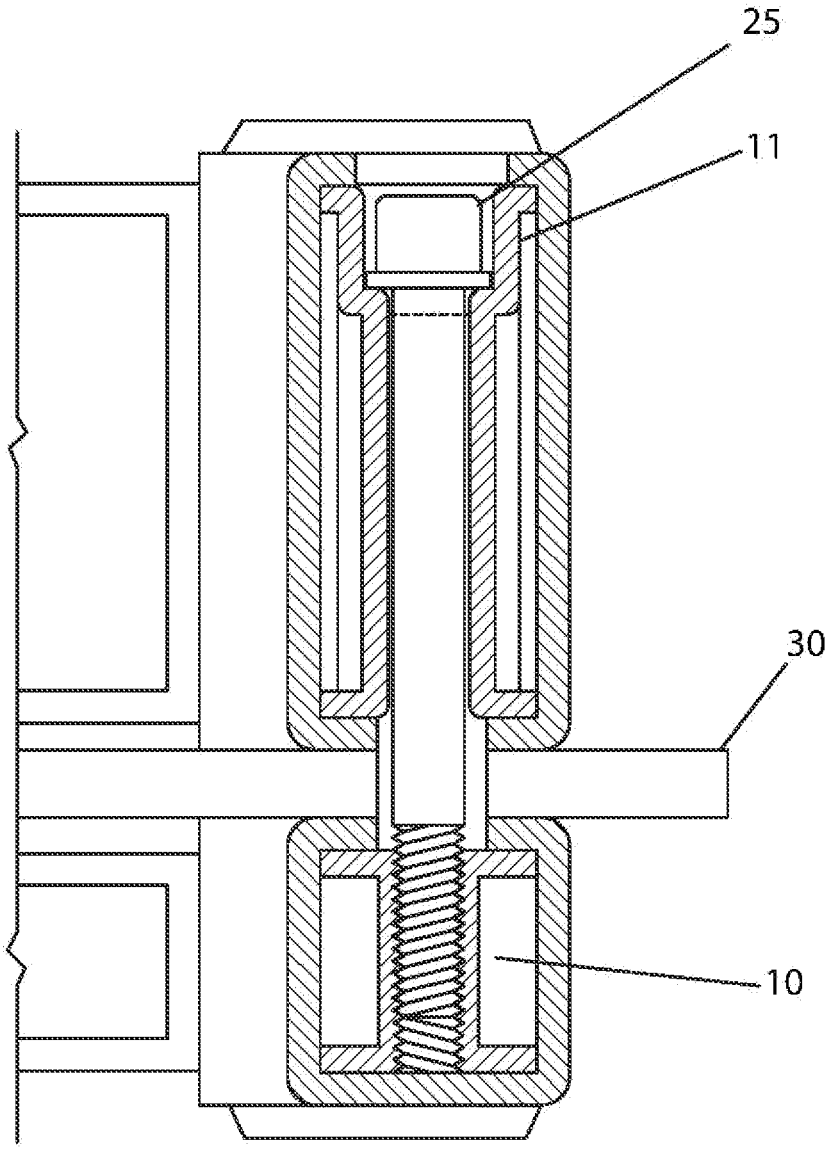

FIG. 3.3
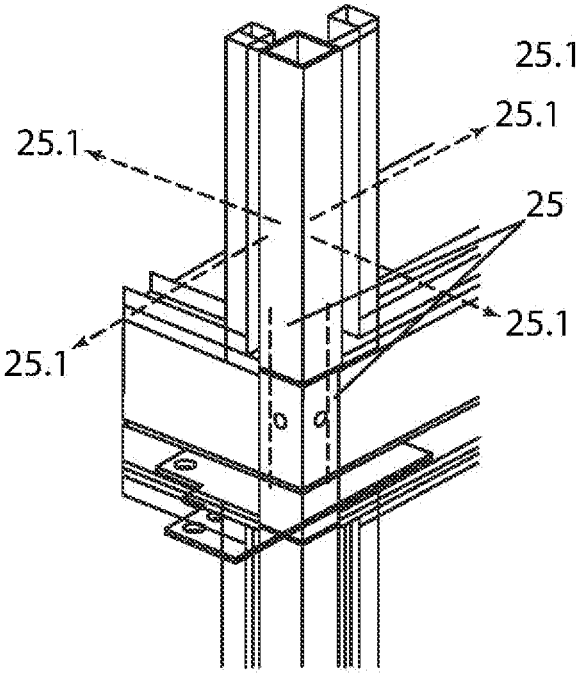
FIG. 3.5
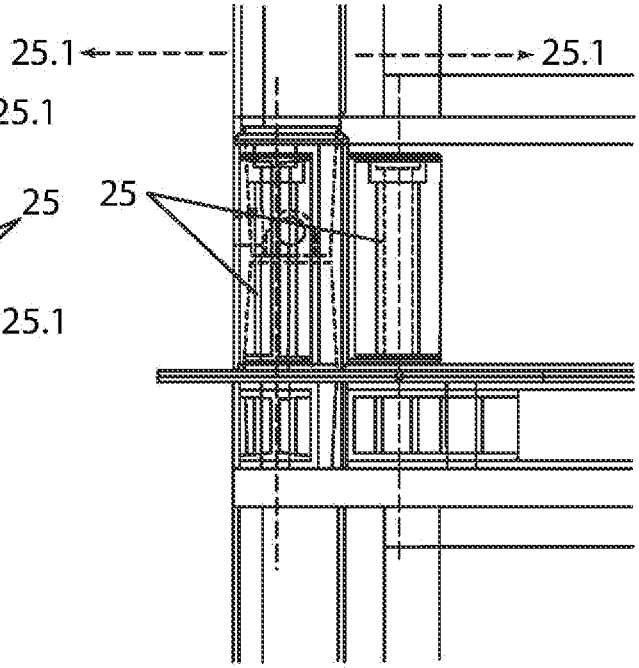

FIG. 3.4
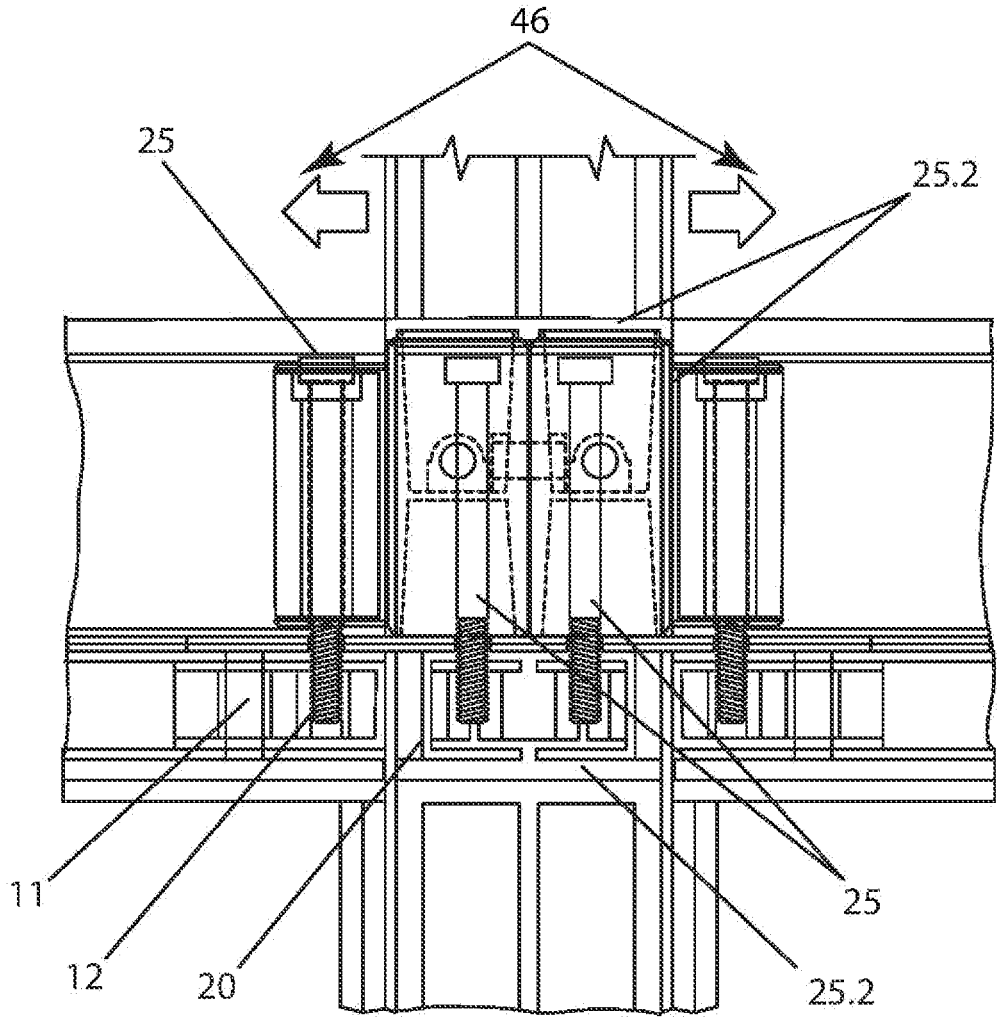

FIG. 4.1
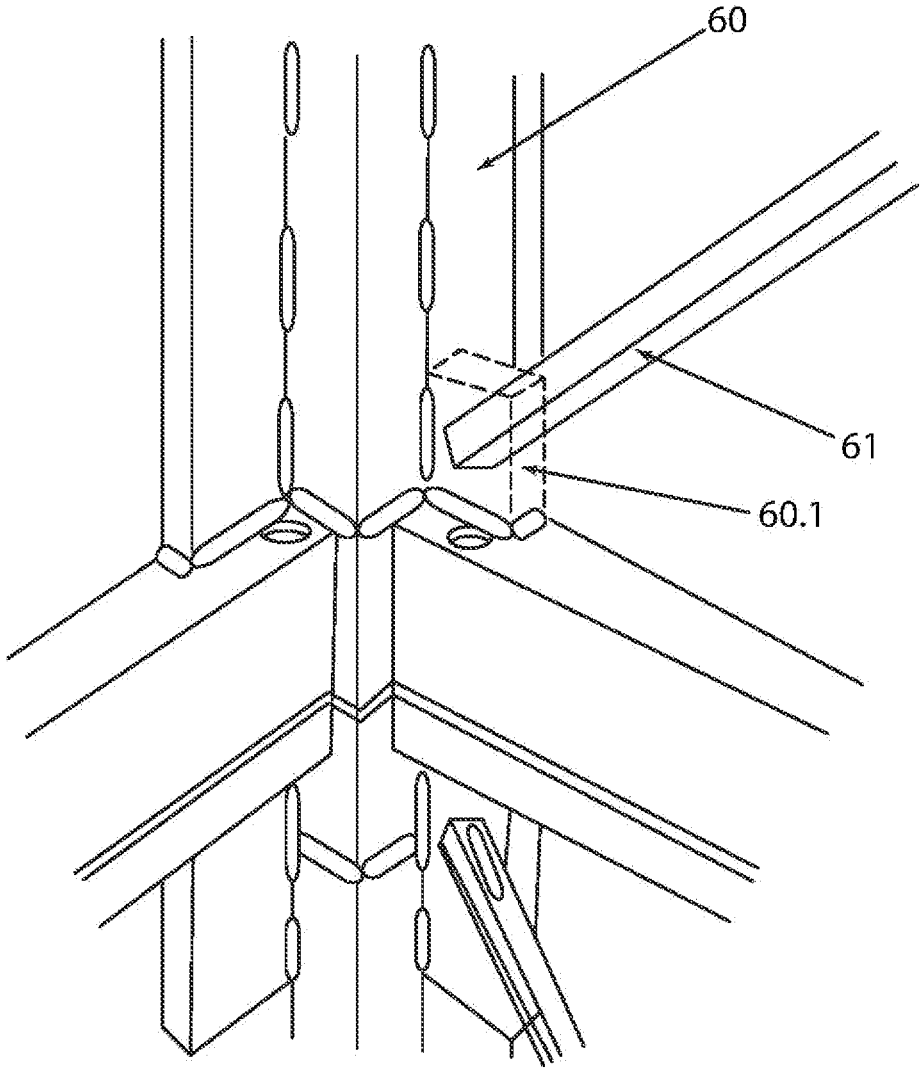

FIG. 4.2A
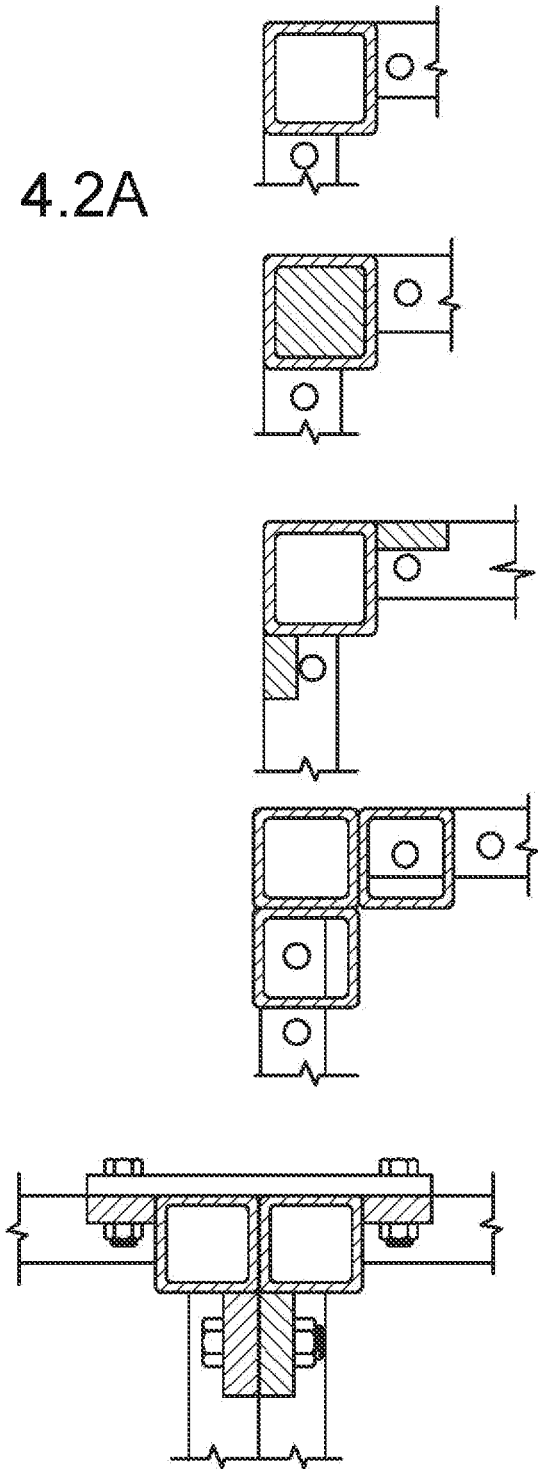

FIG. 4.2B
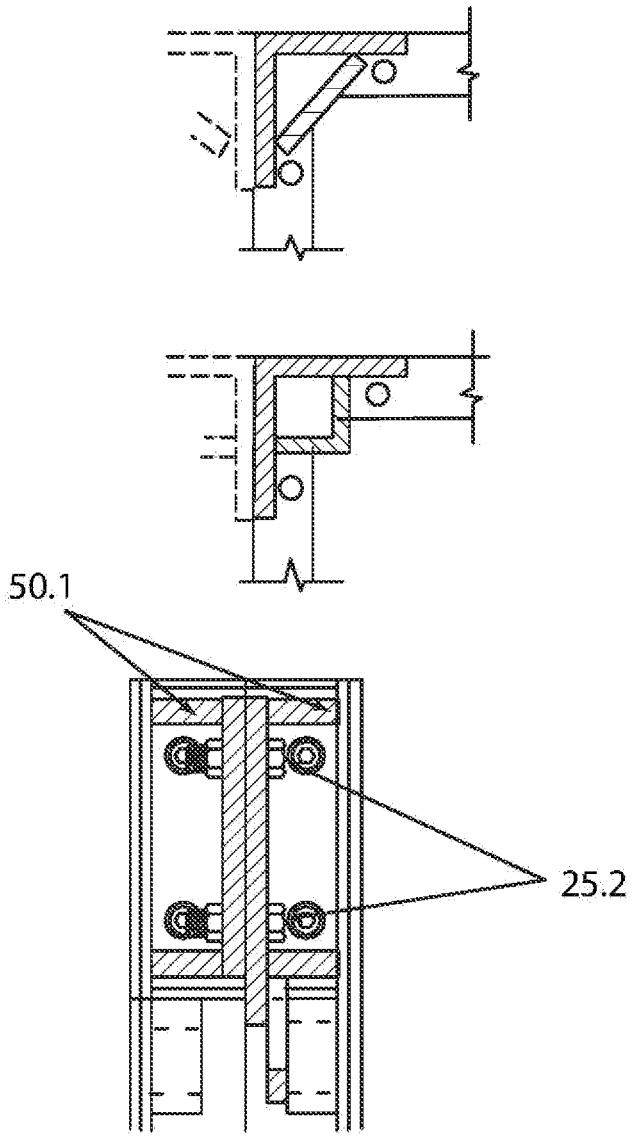

CONNECTOR FOR A MODULAR BUILDING

CROSS REFERENCE TO RELATED APPLICATION

This continuation application claims priority from U.S. patent application Ser. No. 15/752,510, having the title CONNECTOR FOR A MODULAR BUILDING, filed Feb. 13, 2018, which is a United States national phase application filed under 35 U.S.C. § 371 of International Application No. PCT/CA2016/050954, filed Aug. 12, 2016, designating the United States, which claims priority from the U.S. Provisional Patent Application No. 62/205,366, having the title CONNECTOR FOR A MODULAR BUILDING, filed Aug. 14, 2015, which are hereby incorporated herein by reference in their entirety for all purposes.

FIELD

The invention relates to a connector, a connector assembly, a hoistable connector assembly using the connector assembly, a lifting frame assembly, a coupling system for modular frame units, a method for coupling modular frame units having the connector assembly, a method of assembling a modular unit having the connector assembly and a building having the connector assembly.

BACKGROUND

It is widely known that prefabricating modular building units constructed from standardized components in a controlled factory setting is desirable due to the lowered costs and the increased quality which is obtainable in comparison to performing similar work on an outdoor construction job site.

Thus prefabricated modular building units having a floor, walls and an overhead structure, and which contain all the systems and furnishings pre-installed within them are preferred and known in the art. Further, some building assembly systems composed of the means and methods to join two or more modular building units together to form a larger structure are also known in the art.

In addition, devices which engage a specially prepared aperture on the upper or side surface of the structural frame so as to provide a releasable connection for the purpose of lifting and moving the modular building units are known in the art.

A limitation to the construction of slender or tall buildings using factory-built modules is the inability of economically constructed modules to resist and transmit the large moments resulting from wind and seismic forces and the large compression loads resulting from the effect of gravity on the building and occupants. Further, all of these force types are exaggerated by narrowness in one or both axes of the building. These effects are greatest in the lower floors and rise in proportion to increasing height and slenderness, so forces are also largest at the lower floors. It is a characteristic of many modular construction systems that the pinned nature of the connections between adjacent modules and the lack of diagonal bracing beyond that necessary for integrity in shipping limits the effectiveness of force transmission through a larger assembly of conventional module types.

The state of the art for constructing tall or slender building using modules as taught in the art cited herein is to maintain the economies of scale in production by either reinforcing the entirety of all modules of which the building is composed, so all contribute to resisting the forces in a distributed fashion as a stack of ocean freight containers do; or to employ large columns which are situated within or outside of the walls of all of the modules, creating an alternate load path; or to construct an adjoining or interconnected brace frame which by-passes the modules and transmits the large loads to the ground through the secondary structure; or to make use of a tension rod or cable which passes vertically through the building to anchor the modules against uplift and lateral drift. All of the above noted approaches can have limitations in the achievable resistance to forces and transmission of forces, or require the erection of an additional structure, which in turn can limit the achievable height or increases the amount of material used, therefore increasing the cost.

Additionally, methods of construction which employ large columns, particularly when grouped at corners or where occurring at intermediate locations within the walls result in larger spaces between modules, and/or walls of increased thickness which reduces the useful floor area of the resulting building, and/or projections which limit the free use of the voids and walls for the purposes of installing fixtures such as cabinets and shower stalls, and/or which imposes other limitations on the use of the space by the inhabitants, thereby decreasing the value of the resultant building.

Additionally, methods of modular building construction which employ secondary frames add to the assembly time for the building, increasing the cost and duration of construction and reducing the useful floor area, thereby decreasing the value of the resultant building.

Creating a multiplicity of dissimilar module types each having unique details relative to the forces acting on the module within a building is undesirable, as increased variation increases the number of unique components which must be measured, cut and inventoried until use. Additionally, setups of the manufacturing tooling required to accurately locate these parts relative to each other for assembly is error-prone and therefor normally executed by skilled persons, so any increase in the number of setups adds to both production time and cost.

Because the members comprising a networked structure must be of nearly identical length, creating the numerous features required to accurately assemble modules by welding or other means, the subsequent location and connection of the subassemblies of which a module is made, the rigging and hoisting of the completed modules and the fastening of the modules to form structurally sound groupings which provide redundant and adequate load paths as currently practiced, requires a number of precision cutting and assembly operations which increase cost.

It is well known in the art that a moment-connected module frame or building frame reduces the need for diagonal reinforcing elements which otherwise obstruct the view of the occupants and hinder the installation and maintenance of building services. However moment connections which require expansive splice plates as a means of connection require clear access to one or more faces of the module, thus increasing the amount of enclosing and finishing work which must be completed at the site.

Some embodiments of a modular building which best suit the site conditions, the needs of the occupants and the aesthetic tastes of the architect or owner may be composed of module forms having non-orthogonal shapes, including tapering, curving, polygonal etc. however existing systems for the construction of structural modules suited to tall building construction are by nature not suited to non-orthogonal shapes.

Varying shapes of modules and the varying location of walls, fixtures and other components causes the centre of gravity of modules used to construct a building or to furnish a single floor of said building, to vary. To facilitate placement while reducing the clearances to a minimum it is desirable to have the side walls of the modules oriented as closely to perpendicular as possible during hoisting. It has been the case that lengthy delays and repeated trial lifts are required to effect adjustments of the rigging so as to achieve this desirable condition. The time required to make the required changes in turn increases the total duration of the hoisting operation, thus increasing costs for both labour and equipment such as cranes as well as delaying the completion of the building.

The requirement to place and inter-connect modules which are not accurate increases the amount of space required between modules, which increases the difficulty of fireproofing the structure and the difficulty of interconnecting the members so as to achieve the greatest possible strength as well as making integration of modules in to structural groups more difficult and wasting space and providing space for the circulation of sound, smoke and vermin.

The dimensions of a module and the positional disposition of the members within it defines the position and size of the outer wall facings, of the mechanical services, of the abutting and adjoining modules and of the support structures beneath the building and a such there is an interdependent relationship between all the elements of which a modular building is composed.

The present invention can help to address the need for a compact, accurate, load-bearing, moment-connected, versatile and complete system of interrelated components for the orientation and assembly of module frames, which can facilitate quick and dependable rigging and hoisting of the completed modules and can provide for the connection of the modules to each other and to other necessary components of the building without the need for excessive unfinished areas so as to take full advantage of the structural properties of the modules and which defines and reduces the number of parts, provides features without the need for the fabrication of complex connections in the joining areas, excessive precision in the cutting of the required materials, the execution of difficult welds in difficult positions and a multiplicity of precision setups.

Specifically, the present invention consists of a system of components for the fabrication and assembly of building modules and to interconnect the modules to form buildings composed of those modules, together with a method for the definition of the number, selection and articulation of those components to be used in creating a modules suited to a specific configuration.

The present invention can also help to address the need for a system of components and work methods which allow a fabricator to economically and safely construct buildings of a wide range of types, from single family dwellings to towers of over 20 stories in a plurality of forms, including but not limited to orthogonal, tapering, radiating and curving shapes.

BRIEF DESCRIPTION OF THE DRAWINGS

Reference will now be made, by way of example, to the accompanying drawings which show example embodiments of the present application, and in which:

FIG. 1.1 is a perspective view of a lower corner block as shown in FIG. 1;

FIG. 1.2 is a side view of a lower corner block, as shown in FIG. 1, showing the tapered locating coring;

FIG. 1.3 is a perspective view of an upper corner block as shown in FIG. 1;

FIG. 2.1 is a perspective view of an embodiment including a gusset plate joining modules;

FIG. 2.2 is a perspective view of an embodiment including a gusset plate joining modules;

FIG. 3.1 is a partial perspective view of the connection between two adjacent stacks of modules using the connector as shown in FIG. 1;

FIG. 3.2 is a vertical section through arms, gusset plate and HSS at a connection using the connector as shown in FIG. 1;

FIG. 3.3 is an isometric view of the connection between two modules in a single stack using the connector as shown in FIG. 1;

FIG. 3.4 is a partial front view of the connection between two adjacent stacks of modules using the connector as shown in FIG. 1;

FIG. 3.5 is a partial side view of the connection between two modules in a single stack using the connector as shown in FIG. 1;

FIG. 4.1 is a partial isometric view of the inside of a module corner showing the vertical stiffeners and diagonal bracing;

FIG. 4.2A and FIG. 4.2B are a group of views showing progressive alternate embodiments of a reinforced column;

DESCRIPTION OF EXAMPLE EMBODIMENTS

Figure 1:
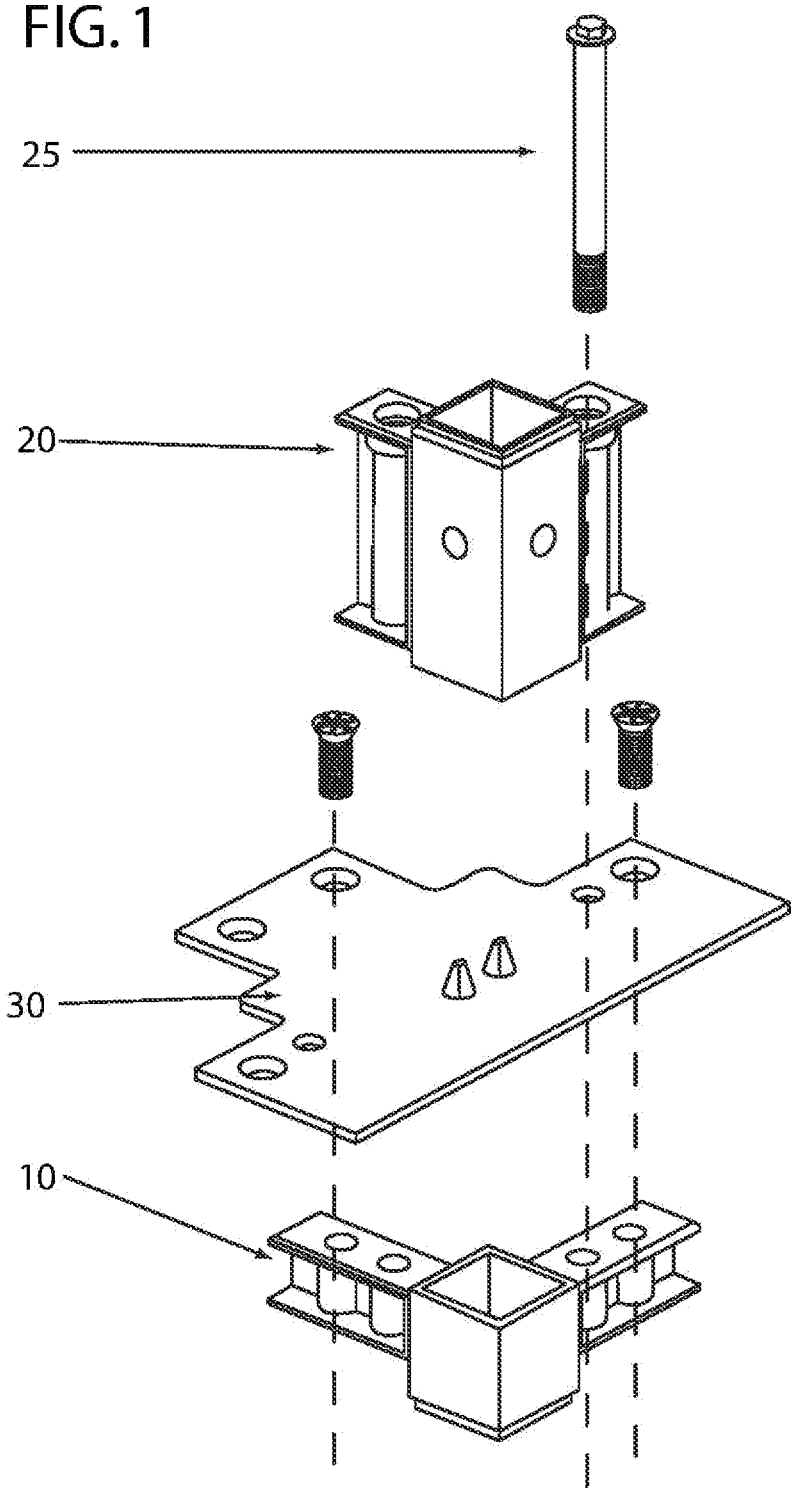
FIG. 1 is an exploded isometric view of a corner connection block as disclosed in PCT application number PCT/CA2014/050110, filed Feb. 18, 2014, incorporated herein by reference.

The specification relates to an upper connector block that can be used in the manufacture of modular building units, as described in PCT application numbers PCT/CA2014/050110, filed Feb. 18, 2014, and PCT/CA2015/050369, filed Apr. 30, 2015, both incorporated herein by reference.

The specification has been subdivided in to a section for each component or group of components for convenience in reading.

Corner Blocks

The current invention provides upper and lower load-bearing connector or blocks which in one embodiment are corner blocks. In a particular embodiment, the blocks are substantially quadrilateral and in other embodiments have polygonal or asymmetrical shapes. These blocks can be mass-produced with features that provide a multiplicity of functions so as to concentrate the precision operations in a small number and size of objects and reduce the amount and complexity of work that must be performed on other members. The upper and lower blocks are of distinct forms and located on the upper and lower ends of the vertical corner members (columns) of generally angular, tubular or built-up form, which perform the function of multi-story columns when modules so constructed are joined using the features on the blocks to form a larger or taller structure.

Likewise other features on the blocks engage the horizontal members of the building and perform the function of continuous horizontal members when modules so constructed are joined to form a larger or wider structure.

In a particular embodiment, the blocks have arms, which can be tapering, projecting at a plurality of angles including but not limited to perpendicular to the faces of the blocks providing for the location and welding of adjoining members at a plurality of angles. In a particular embodiment, the present invention thus facilitates the fabrication and erection of modules including but not limited to orthogonal, tapering, radiating and curving shapes. The threaded and unthreaded holes in the arms achieve the positioning of threaded fasteners and the vertical walls of the arms provide an increase in the load-bearing capacity and transmission of the compression and tension forces created by the forces acting on the building and by the action of the fasteners.

In a particular embodiment, the blocks have holes in both the body and the arms for the passage and receiving of bolts with nuts or are threaded to receive bolts, so as to provide continuity of vertical tension through the columns and a moment resisting interconnection between adjacent modules or other building structures. The tension resistance resulting from the connection of the columns in the vertical plane enables the structure to resist uplift where it occurs and produces friction on the gusset plate so as to convey forces to the lateral members in the horizontal plane with a high level of fixity.

More specifically, during assembly, the surfaces of the arms which are closest to the interior surface of the HSS which bears against the gusset plate is made tight, with all tolerance being on the opposite end, such that the tension imparted by the action of the bolt to the arms compresses the connecting surfaces and does not crush the HSS.

In a particular embodiment, the bolts are accessible within the wall cavity or other such places and can be arranged flush or below the surface such that a removable patch can be easily configured to cover the location of the bolt and ensure continuity of the fireproofing materials surrounding the load-bearing structures.

In a particular embodiment, the blocks have projecting features on the exterior and interior faces of the block located to provide backing for the assembly welding, reducing the structural impact of a weld to a connecting member that is cut to short or with an out-of square end or other imperfection reducing the probability of a worker executing a non-conforming welded connection between the corner blocks and the members which are welded to the block and a beveled feature so located on the outside of the block located so as to reduce the likelihood that a weld will project beyond the surface and conflict with an adjoining module.

The holes in the corner blocks provide a means of connection to tie-downs and hoisting devices. In a particular embodiment, the upper face of the block is prepared with an opening in to which a pin can be inserted/coupled/fastened or screwed having an opening, so as to provide a means of quickly and dependably connecting and disconnecting the module to a lifting device.

Gusset Plate

Another component is a plate which is interposed between the blocks at the top and bottom ends of columns or groups of columns, which has an opening permitting the pin coupled to a first block to slide through and engage a recess on the underside of a second corner block thus locating the module in the correct position. The plate also provides through holes for use in connecting adjacent modules with bolts to provide structural continuity in the horizontal plane both during construction and in the completed building and by virtue of its ductility, for accommodating slight variations in column length so as to ensure a continuous load path which bears equally on all members of the column group thus formed. As can be appreciated by someone knowledgeable in the art, the plate can be shaped to fit between a single vertical column or between two or more columns arranged in an orthogonal or other disposition. In a particular embodiment shims of a similar dimension and prepared with appropriate holes are placed in one or both sides of the connection to accommodate for variations in the finished dimensions of the modules thus maintaining the correct geometry of the modules stack.

Stairwells and Elevator Shafts

The system of the present invention allows for the fabrication of modules within which are installed stairs or elevating devices and which separate at the mateline between two modules without a significant visual or functional disruption.

Overheight Modules

The system of the present invention allows for the fabrication of modules which comprise the upper and lower halves of habitable volumes which are taller than shipping restrictions will normally allow and which are joined at the mateline between two or more stacked modules without a significant visual or functional disruption.

Hallways

Another group of components of the present invention is a structural hallway floor that is made from a suitable material such as reinforced concrete, sandwich plate, wood or formed metal together with supporting pedestals. In a particular embodiment, the slab is composed of reinforced concrete with reinforcement bars placed so that features on the support pedestals engage them so as to resist bending of the pedestals, thus creating a moment connection between stacks of adjacent modules thus connected. The pedestals are provided with holes that align with corresponding holes in the upper and lower corner blocks and serve to connect two parallel stacks of modules as well as connecting the adjacent columns within a stack on one side so as to create a combined load path. The pedestals and floor slabs may also be connected to the sides or ends of a stack of modules on one side of the slab and a balcony support frame on the outside to form a building with balconies or breezeways. The floor slab and pedestal assemblies can also be used as convenient carriers for building services such as ducts, pipes and wiring to facilitate the fabrication of these components off site in the factory environment.

Hoisting

The specification in another aspect relates to a releasable and compact connector which employs the pin coupled to the connector for hoisting a module frame. A clevis or shackle can be coupled to the pin by engaging a clevis pin or bolt in the opening in the pin and connecting the clevis or shackle to the pin, and establishing a coupling between the hoisting system and the module frame. This allows the module frame to be lifted from one end (for example, the top of the module frame) and can help to reduce or eliminate bracing or connection to opposing ends (such as the bottom end of the module frame). Such a system can help to reduce the overall work required for connecting, disconnecting and lifting a module frame unit, while can also help with aligning and connecting the module frame units during construction.

Hoisting Frame

Another component of the present invention is a hoisting apparatus which is arranged so as to suspend the load in an ideal posture for placement in the building, which in a particular embodiment is horizontal and which provides for the rapid adjustment of the position of all of the connection points from which lines pass to the crane hook so as to compensate for differences in the centre of gravity which occur in the length of a module. The device described also allows for altering the spread between pairs of cables on one side of the frame effecting a change in the dependent angle from vertical of the pair of lines which pass to the crane hook on one side of the module so as to move the centre of crane attachment to one side of the long axis of the frame so as to compensate for changes in the centre of gravity of loads which occur in the width of the module suspended from it.

Reinforcing Members

Further the specification relates to a system of standardized reinforcing members which connect with each other and with the columns, lateral framing, diagonal bracing and corner blocks described herein, eliminating the need for case-by-case design and fabrication or customization of reinforcement components.

Reinforcement Analysis

Further, the specification relates to a work method for systematically analysing the forces acting on a building composed of modules, defining the optimum location for the application of the standardized reinforcing systems, selecting from a list of standardized reinforcements with progressive buckling and uplift resistance and thereby incorporating only such reinforcements as are minimally necessary to strengthen the areas under additional stress, without adding unnecessary structural material to more locations than required, without significantly disrupting the application of fireproofing materials and without requiring additional thickness of the walls of the module.

Built Up Columns

Further, the specification relates to a method for the fabrication and connection of the outer columns so they form groupings with greater resistance to the compressive and tensile forces resulting from the loads encountered in the construction of tall and/or slender buildings.

Extendable Gasket

Further, the specification relates a gasket which extends to meet another opposed gasket after the module is placed by the action so as to prevent damage to the gasket surface during the hoisting and placement operation Benefits Increases Height without Frame The system of components and work methods of the present specification, by means of involving the whole of the modular building units thus created and connected, can serve to increase the height of a building which can be built without the requirement for a secondary external or internal bracing frame, and to increase its useable floor area due to involving a larger portion of the members in the structural function and the enhanced fixity of the connections, the creation and assurance of multiple and redundant load paths, the integration of the brace frame in to the module walls and the resulting efficient transfer of the external, internal and self-loads imposed on the completed building through the adjacent modules and thence to the ground.

Increases Height with Frame

By reducing the amount of steel required in upper floors and thus its total weight, the specification can also serve to increases the height of a building which is built with the use of a secondary external or internal bracing frame of a given size.

Reduces Number of Unique Parts, Number of Locations and Size of Members

By analyzing the loads applied and more efficiently involving more of the required members in the structural function, the specification can also help reduce the size of members required and limits the number, size and locations where unique reinforcement details and the related complexity of the fireproofing is required, thereby can help reduce the cost of such buildings.

Reduces Requirement for Precision

The present specification can help reduce the precision of the parts which must be made by workers in the modular production facility, which can help reduce the cost of the fabrication.

Reduces Complex Fabrication

The present specification concentrates many of the complex features required to join members, hoist modules and join modules in a single mass-produced component, reducing both the complexity and the requirement for skilled work necessary to construct a module.

Allows Taller and Wider

Additionally the system can allow for the building of taller modules composed of two stacked frames one of which has openings in the ceiling and the other of which has openings in the floor, longer modules due to the performance of the bracing and wider modules due to the improved behavior of the apertures in the ends, thus providing greater flexibility to designers of buildings so constructed.

Reduces Wall Thickness

By more perfectly distributing the load-bearing components the present specification can help reduce the wall thickness required to accommodate structure and services.

Reduces Site Labour for Patching

By placing the tension connections within the wall cavity and concentrating the connection means in the vicinity of the column, the present specification can help reduce both the number and the extent of the leave-out areas which must be subsequently patched.

Eliminates Gasket Damage During Erection

By shipping and erecting the modules with the gasket in retracted position and then extending it post-erection, the present specification can help decrease the possibility of damage to the gasket and the attendant reduction in the performance of the building envelope.

PCT application number PCT/CA2014/050110, filed Feb. 18, 2014, incorporated herein by reference, relates to a connector assembly 1 (as shown in FIG. 1) having upper connector 10 and lower connector 20, along with a gusset plate 30.

FIG. 1 discloses an embodiment of a connector assembly 1 that is made up of an upper connector 10, a lower connector 20 and a gusset plate 30 sandwiched between the upper connector 10 and lower connector 20. The terms "upper" and "lower" are relative and can be interchanged. However, for the purpose of describing the connector assembly 1, upper connector 10 refers to connector that would typically be positioned at an upper corner or upper end of a modular frame that can be lifted and positioned on a second (or lower) modular frame. While lower connectors 20 refer to connectors positioned on the lower corner or lower end of a modular frame, and that would be closer to ground or floor (than the upper connector).

In the embodiment shown, the upper corner connector 10 and lower corner connector 20 can be made from hollow castings of steel. In addition, the upper connector 10 has an opening at one end (first end 2) that is formed for receiving a column, post or other structural unit of a modular frame, so that the upper connector can be coupled to an end of the of the first modular frame. While the second end 3 of the upper connector 10 is designed to allow coupling of the upper connector 10 to the gusset plate 30. The lower connector 20 can also be provided with an opening on both the first end 4 and the second end 5; with the first end 4 adapted for coupling to the gusset plate 30, while the second end 5 allows coupling to an end or corner of the second modular frame. The connectors can have mechanical properties such as tensile strength and ductility equal to or greater than mild steel and metallurgical properties such that the connector can be welded to mild steel with standard practices such as structural metal inert gas (MIG) welding.

In a further embodiment, the upper and lower connectors (10, 20) each have a hollow body (2, 4), respectively. The upper connector hollow body 2 and the lower connector hollow body 4 can have a variety of shapes depending upon the design and application requirements. However, in the figures, the upper and lower connectors (10, 20) have a hollow body (2, 4) that has a shape having a square cross-section. Provided on the outer surface of the hollow body 2 of the upper connector 10 are bosses 6. Similar bosses 18 are also provided on the outer surface of the hollow body (4) of the lower connector 20.

The upper connector 10 is provided by at least a pair of arms 11 that extend from the bosses 18. The lower connector 20 is also provided with at least a pair of arms 11 that extend from the bosses 18. In the embodiment shown, the arms 11 extend normally from the surface of the bosses 18. In addition, the arms 11 are positioned to be perpendicular to each other, i.e., one arm extends at nearly 90° to the second arm. However, the position of the arms 11 can be varied depending upon the design and application requirements, and the arms 11 can be present at angles less than or greater than 90°. The arms 11 on the upper connector 10 can be provided with apertures 12 that can be used for coupling of the upper or lower connector to the connector assembly 1.

In one embodiment, the central hollow bodies (2, 4) are 4" square to accept a 4"×4" Hollow Structural Section (HSS). In another embodiment, the central hollow bodies (2, 4) are 6" square to accept a 6"×6" HSS. Connectors 10 and 20 have adequate thickness for the intended function and details such as draft angles and uniformity of sections which facilitate casting. In a particular embodiment, the casting are drilled and surfaces milled to an accuracy of +0-0.010 inches as measured between centres of the apertures 12 and the locating surfaces of the arms 11, or other tolerances as may be convenient. In another embodiment, the connector is made by assembling one or more of rolled sections, flat or brake-formed plate by welding or mechanical means. In a further embodiment, the part is made by casting non-ferrous, plastic, cementitious or any other suitable material. In another embodiment, the portions of the blocks to which the columns and arms will be connected can have features to locate the HSS and facilitate welding.

The connector assembly 1 can be formed by sandwiching the gusset plate 30 between the upper connector 10 and lower connector 20. The gusset plate 30 shown has two faces, where the first face can be in contact with lower connector 20 and the second face can be contact with the upper connector 10. In addition, the gusset plate 30 is provided with through holes 31, which align with apertures 12 on the upper connector 10 and lower connector 20, allowing fastening of the connectors (10, 20) using fastening means. The fastening means is not particularly limited, and can include nut and bolts, screws.

FIG. 1.1 Lower Connector 20

The lower corner connector has bosses 18 which provide location to the longitudinal and transverse members of the module frame and backing for the assembly welds. In the embodiment shown, the edges of the hollow body of the upper and lower connectors have beveled edges. Bevels 19 provide a location for the exterior surface of the weld bead which allows the weld to lie flush and eliminates the need to bevel the connected member. The outer faces of lower connector 20 can have a plurality of holes (or bores) 21 which are threaded or unthreaded as required by circumstances for use in the connection of column groups, hallway slabs, fixtures, hoisting means or other useful features through the use of bolts, pins, clips, joining plates or other fastening means. In another embodiment, the connector 20 is taller and additional holes are provided for the use of additional fasteners or the addition of additional bracing or other features. In another embodiment, the connector 20 is more or less than 4-sided and not quadrilateral, but rather has trapezoidal, parallelogram or other shapes so as to facilitate the production of round, curving, tapering, star-shaped or other building forms.

The lower connector 20 has arms 11 with holes (or apertures) 12 for the passage of tension bolts 25 which pass through gusset plate 30 to secure the module vertically and provide a continuous tension and moment connection which passes loads through the connection between the stacked columns and the horizontal beams. In a further embodiment, these arms project perpendicular to the surface, in another embodiment they have tapered sides 22 so as to permit the connection of members at an angle and in another embodiment the whole of the arms projects at an angle.

FIG. 1.2 Lower Connector 20

In one embodiment, the connector 20 has dimensions as shown in FIG. 1.2. As described by the hidden lines the bottom face has an opening the sides of which are perpendicular or tapered in relation to the bottom face 23. A plurality of these openings on a module having a radial relationship to the module centre receive corresponding tapering locating pin 33 in the gusset plates 30 below, thus locating the module on top of the module below and in the correct position for connection.

FIG. 1.3 Upper Connector 10

The upper corner connector 10 has bosses 18 which provide location to the longitudinal and transverse members of the module frame and backing for the assembly welds. Similar to the lower connector 20, in the embodiment shown, the edges of the hollow body of the upper and lower connectors have beveled edges. Bevels 19 provide a location for the exterior weld bead which allows the weld to lie flush and eliminates the need to bevel the connected member. The outer faces of block 10 have a plurality of holes (or bores) 21 which are threaded or unthreaded as required by circumstances for use in the connection of column groups, hallway slabs, or other useful features through the use of bolts, pins, clips, joining plates or other fastening means. In another embodiment the block is taller and additional holes are provided for the use of additional fasteners or the addition of additional bracing or other features. In another embodiment the block is more or less than 4-sided and not quadrilateral, but rather has trapezoidal, parallelogram or other shapes so as to facilitate the production of round, curving, tapering, star-shaped or other building forms. In a further embodiment these arms project perpendicular to the surface, in another embodiment they have tapered sides 22 so as to permit the connection of members at an angle and in another embodiment the whole of the arms projects at an angle.

In another further embodiment, the upper connector 10 has arms 11 with threaded holes (or second aperture) 12 closest to the body of the block for the receipt of tension bolts 25 and threaded holes (or first aperture) 13 most distant from the block for the receipt of gusset plate screws 34. In a particular embodiment these arms project perpendicular to the surface, in another embodiment they have tapered sides 22 so as to permit the connection of members at an angle and in another embodiment the whole of the arms projects at an angle.

Figure 2:
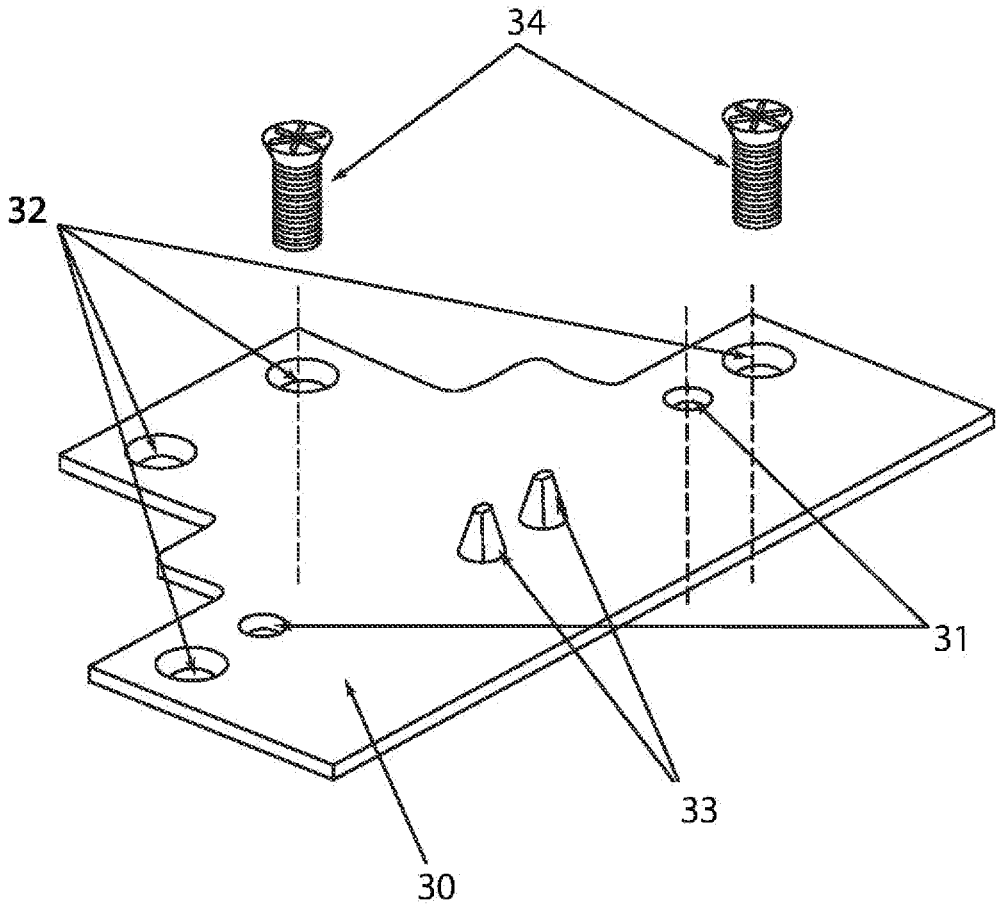
FIG. 2 is a perspective view of a gusset plate as shown in FIG. 1.

FIG. 2 shows a gusset plate 30 as used in the connector assembly of FIG. 1.

In one embodiment, the gusset plate 30 is cut from steel plate or other material having adequate thickness and mechanical properties for the intended function. In a further embodiment, it is ⅜" thick. The gusset plate has through holes 31, countersunk holes 32 and locating pins 33. Flathead screws 34 passed through holes 32 and threaded in to holes 13 in upper connector 10 accurately unite adjacent columns and thus whole modules. The ductility of plate 30 in the vertical plane ensures that the column groups are acting together to sustain large loads. The precision of the location of holes 32 for the flathead screws and the corresponding holes in the connectors ensures module-to-module tolerances are maintained and controlled.

The gusset plate 30 can be sized to fit on top of 1, 2, 3, 4 or more columns providing equivalent vertical separation in all locations and forming groups of 2, 3, 4 or more modules. As shown in FIG. 2.1 which discloses an embodiment of a gusset plate joining 4 modules, while FIG. 2.2 discloses a gusset plate 30 joining 2 modules. In the embodiment of the gusset plate 30 shown in FIG. 2.2, the plate is provided with a projecting edge for support of an adjacent component.

Figure 3:
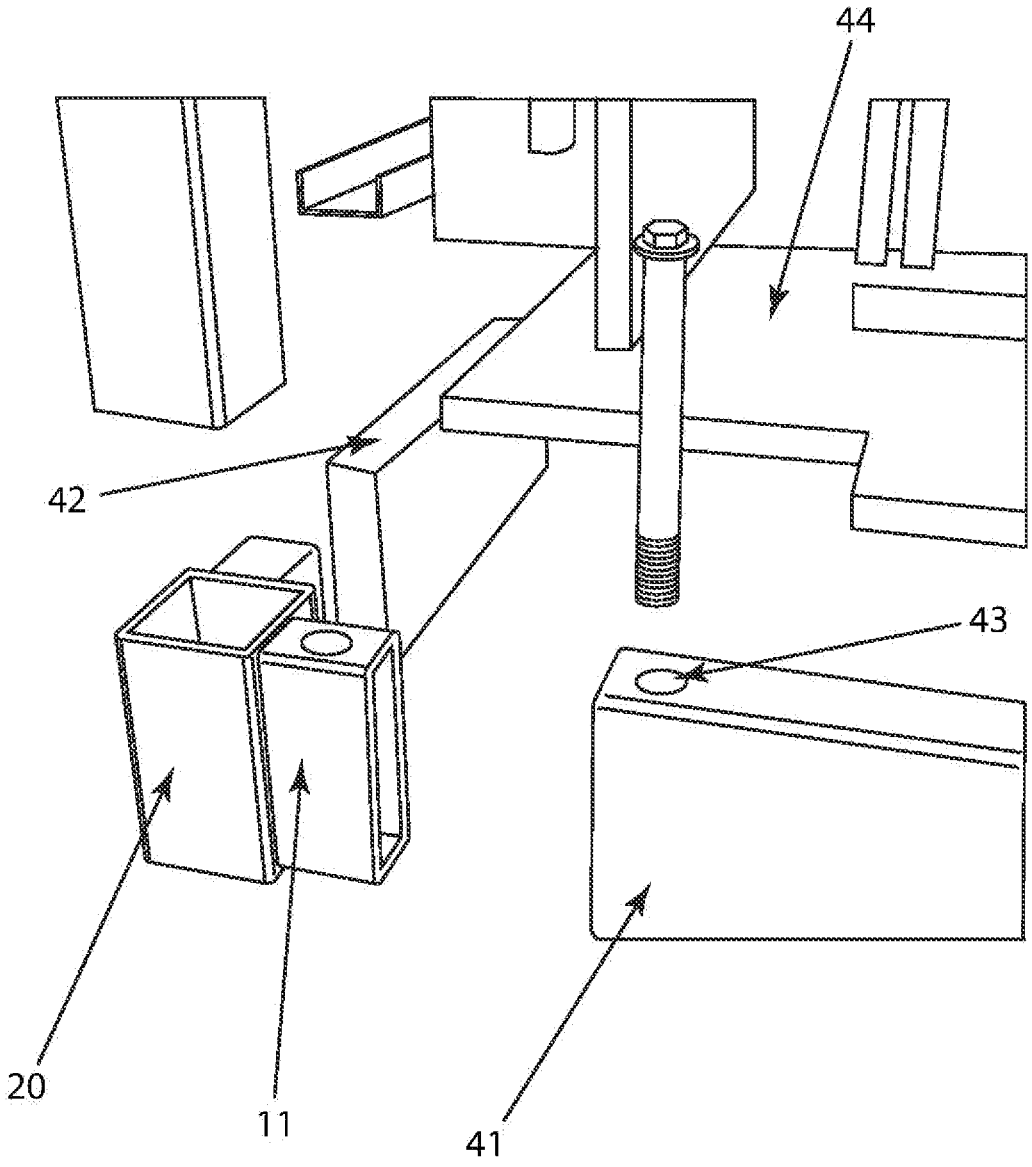
FIG. 3 is a partial exploded perspective view of a module corner using the connector as shown in FIG. 1.

FIG. 3 Assembly of a Module

To create the floor frame of a module, longitudinal floor beam 41 and lateral floor beam 42 are cut to length and provided with holes 43 which generally correspond with but do not interfere with the locations of the holes in arms 11 on the connector 10. In a particular embodiment, these beams are 3"×8" HSS for the perimeter and 3"×6" HSS for the infill members. Because the locating and welding fixture (FIG. 15), described herein, positions the pre-machined connecting blocks and defines the hole locations and their locations relative to each other, provides the exterior dimensions of the assembly, the fixture ensures that modules made using the fixture conform to the established grid previously described. In addition, the features on the blocks ensure that the beams do not require beveling on the edges of the ends and the cutting to length operation is not critical in either length or squareness. The beams are slipped over the corresponding arms 11 on the lower corner connector 20 and welded in the manner previously described.

A person skilled in the art should recognize that the assembly of the ceiling follows a similar process using members of an appropriate size placed in the same fixture. In a particular embodiment, these are 3"×3" HSS for the perimeter with 2"×2" HSS for the infill members. Thus both top and bottom frames capture the outer dimensions of the same fixture and are coordinated.

A suitable material 44 such as fibre-cement board, or steel sheet deck and concrete toping, or steel-composite sheet decking is applied to the top face of the floor beams of the module floor thus built, and fastened appropriately, or concrete or other material is filled between the framing so as to support occupant loads and provide the necessary diaphragm action to the module and in turn to a building composed of modules. Similarly, material such as drywall or fire-proof board and insulation of a variety of types depending on conditions is applied to the surfaces of the framing and boards and in voids in walls and ceilings to provide a variety of functions such as privacy to the occupants, to provide fireproofing to the structure and to limit the transmission of sound.

FIG. 3.1, 3.3, 3.4, 3.5 Vertical Connection of Modules to Form a Moment-Resistant Structure As previously described, lower connector tube 41 has an oversize holes 43 which communicates with the hole in arms 22 through which pass tension bolts 25 which thread in to the threaded hole in the top face of arm 11 on upper block 10 inside upper wall framing tube 45, trapping and clamping gusset plate 30 and transferring vertical tension loads through the connection.

As tension bolts 25 are threaded to the correct torque value in to the female threads in hole 12 of the of arm 11 on upper connector 20 of the module below, the tension created pulls the upper and lower frame tubes and the gusset plate together so as to establish the continuous moment action (25.1) which passes from column to column through the connection thus formed and is prevented from rotating in the vertical plane by the adjacent frame tubes, especially the deeper members which comprise the floor frame. The racking action which is a feature of all buildings subjected to wind, earthquake and other loads is thus reduced. In a particular embodiment, bolts 25 are composed of high-strength steel such as Grade 8 such that the combination of the tensile strength and the number of bolts is sufficient to resist the wind or seismic-induced uplift on the structure thus connected.

Figure 4:
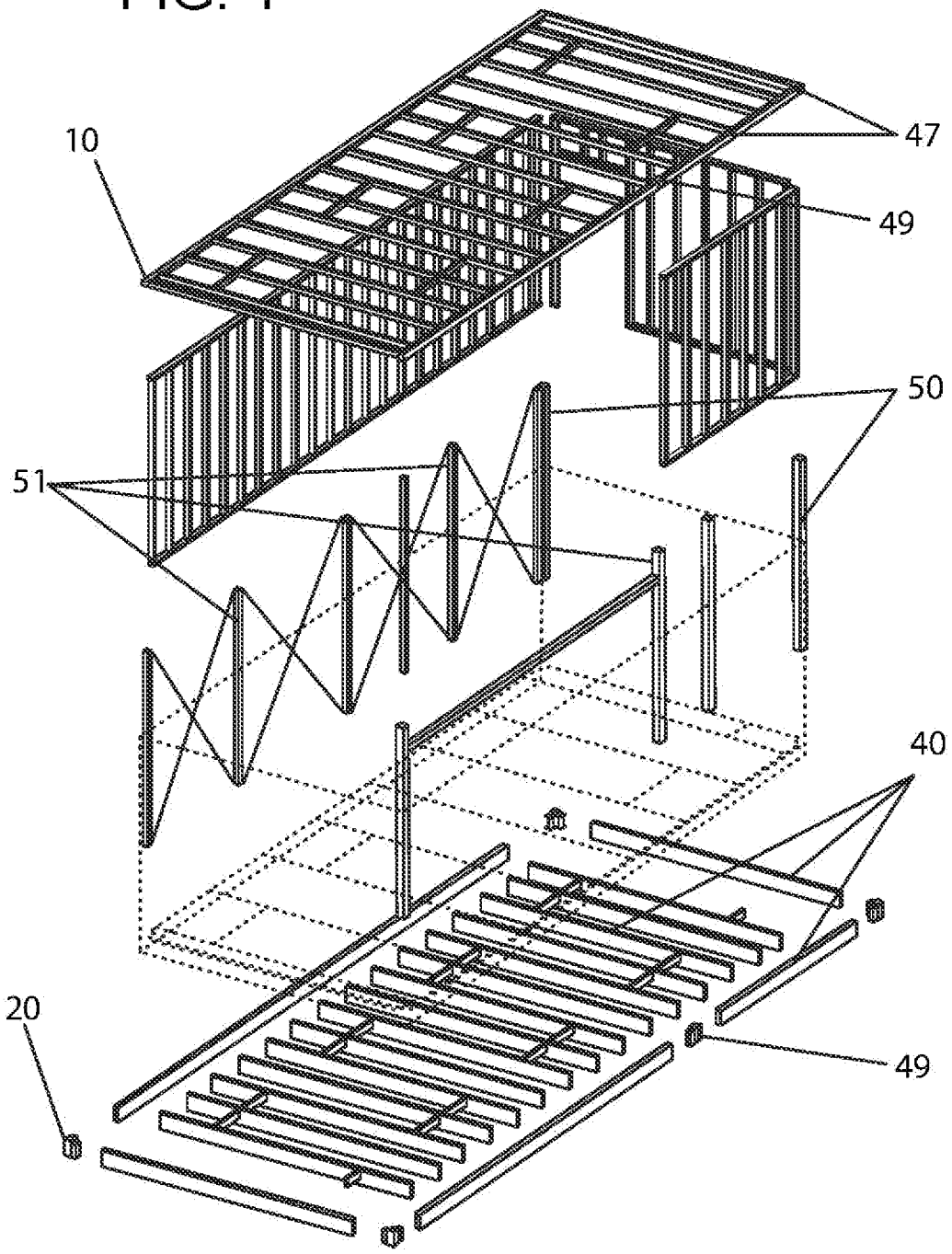
FIG. 4 is an exploded isometric view of a module using module connectors.

FIG. 4 Exploded View of Typical Frame

Floor frame 40 is connected to ceiling frame 47 by corner columns 50 and intermediate columns 51 which in a particular embodiment are substantially perpendicular to the floor and ceiling frames and welded in place. In another embodiment the connections between the upper and lower horizontal members and the intermediate vertical columns 48 is constructed with an intermediate connector 49 similar in form to the connectors described in FIGS. 1.1 and 1.3. but having opposed arms. In another embodiment the columns are of various lengths and mitered to fit against each other or against the blocks such that a plurality of angular relationships between the ceiling and floor is realized.

FIG. 4.1 View of Sidewall Bracing

If the loads acting on the module are sufficiently large to warrant the addition of diagonal reinforcement, the rigidifying and diagonal bracing system shown in FIG. 4.1 is installed. The diagonal reinforcing system consists of vertical reinforcing bars 60, which in a particular embodiment are of the form and installed in the location shown in FIG. 4.1 or of the forms and locations of other particular embodiments as shown in FIG. 4.2A or 4.2B. Diagonal bars 61 are welded or bolted to these members or in the case of lighter structures having smaller loads they are welded directly to the vertical or horizontal frame members or both. The module thus formed when connected to other modules by the moment-resistant corner connection and can help create a moment and tension resistant structure which transmits the loads throughout itself in all axes. In a particular embodiment, the bars are diagonally opposed, ¾" in section and function in tension. In another they are diagonally opposed, of 1"×3" in section and function in tension. In another they are single, of 3"×4" HSS or other dimension and function in both tension and compression as suited to the loads they are to resist.

FIGS. 4.2A and 4.2B Vertical Stiffeners

FIGS. 4.2A and 4.2B are sequentially arranged figures showing progressive means of reinforcing columns against buckling and uplift starting with the weakest at the top and ending with the strongest at the bottom.

As shown in FIG. 4.2A and FIG. 4.2B vertical stiffening and increasing of the cross section of the columns so as to increase load-bearing capacity and resistance to buckling and bending without increasing the thickness of the wall or introducing a separate brace frame is achieved by any of the means shown and applied in a progressive manner as warranted by loads and cost: Increasing wall thickness, filling the columns with grout, adding fins to the corners, grouping sections, using larger sections and grouping those sections. The particular embodiment is the approach which adds least to the thickness of the walls, especially where columns are grouped or are located in the centres of walls or where useful space would be obstructed.

Figure 5:
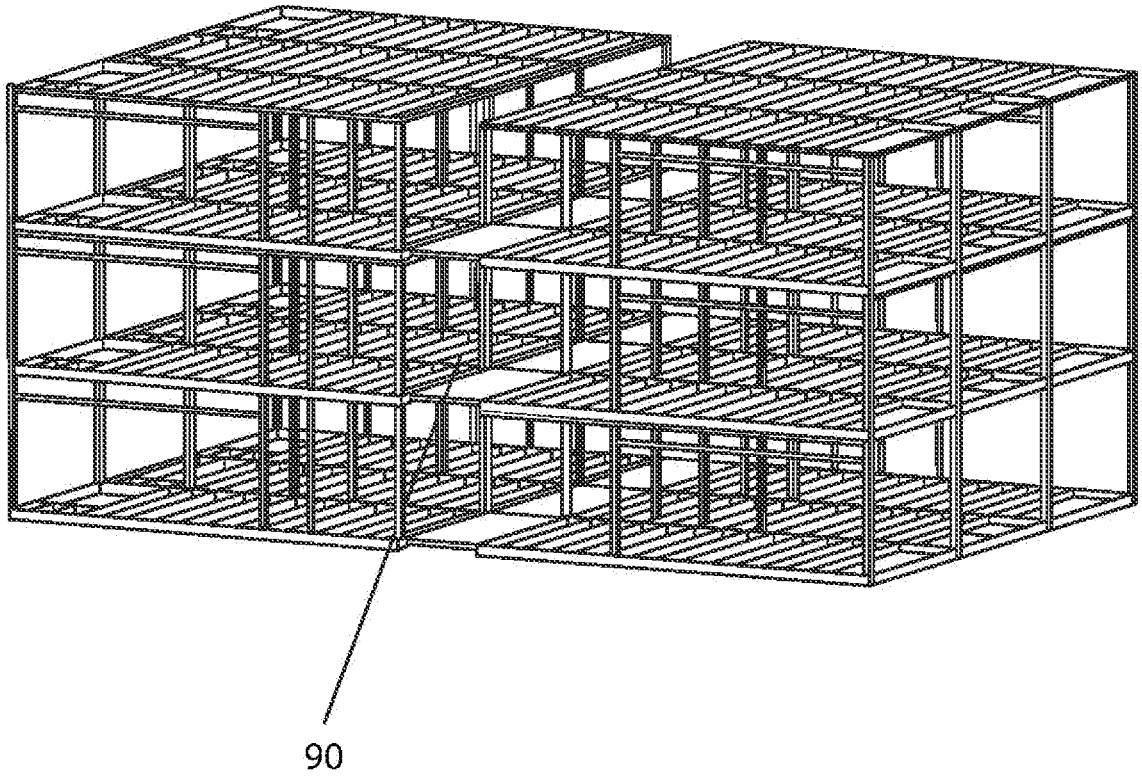
FIG. 5 is an isometric view of a group of 18 modules joined to form a building with central hallways on all floors.

FIG. 5 View of a Small Building

Modules fabricated as described in FIG. 3 are typically connected to form larger structures as shown. In a particular embodiment, a central hallway 90 is present and can provide access to the module ends for fastening, for completing the interconnection of mechanical services and for the use of the occupants in accessing their units.

Figure 6:
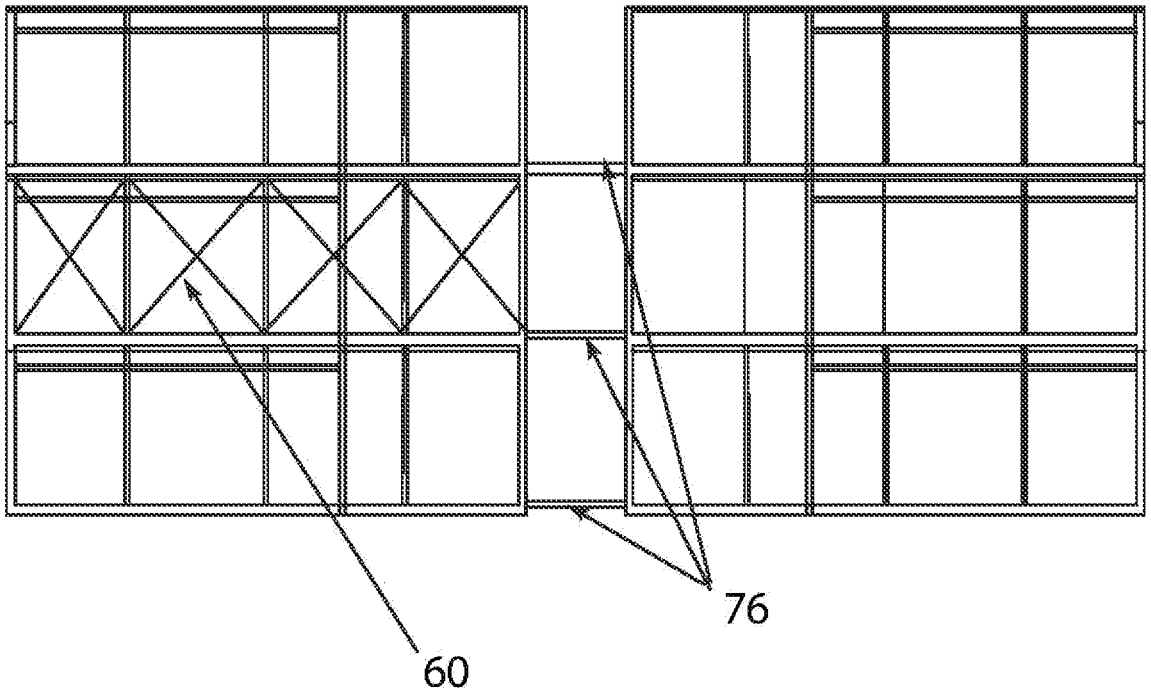
FIG. 6 is a side view of a group of modules joined to form a building.

FIG. 6 Side View of a Small Building

A side view of a typical structure with a centrally-located hallway 76 is shown, together with the diagonal bracing 60 described in FIG. 4.1.

Figure 7:
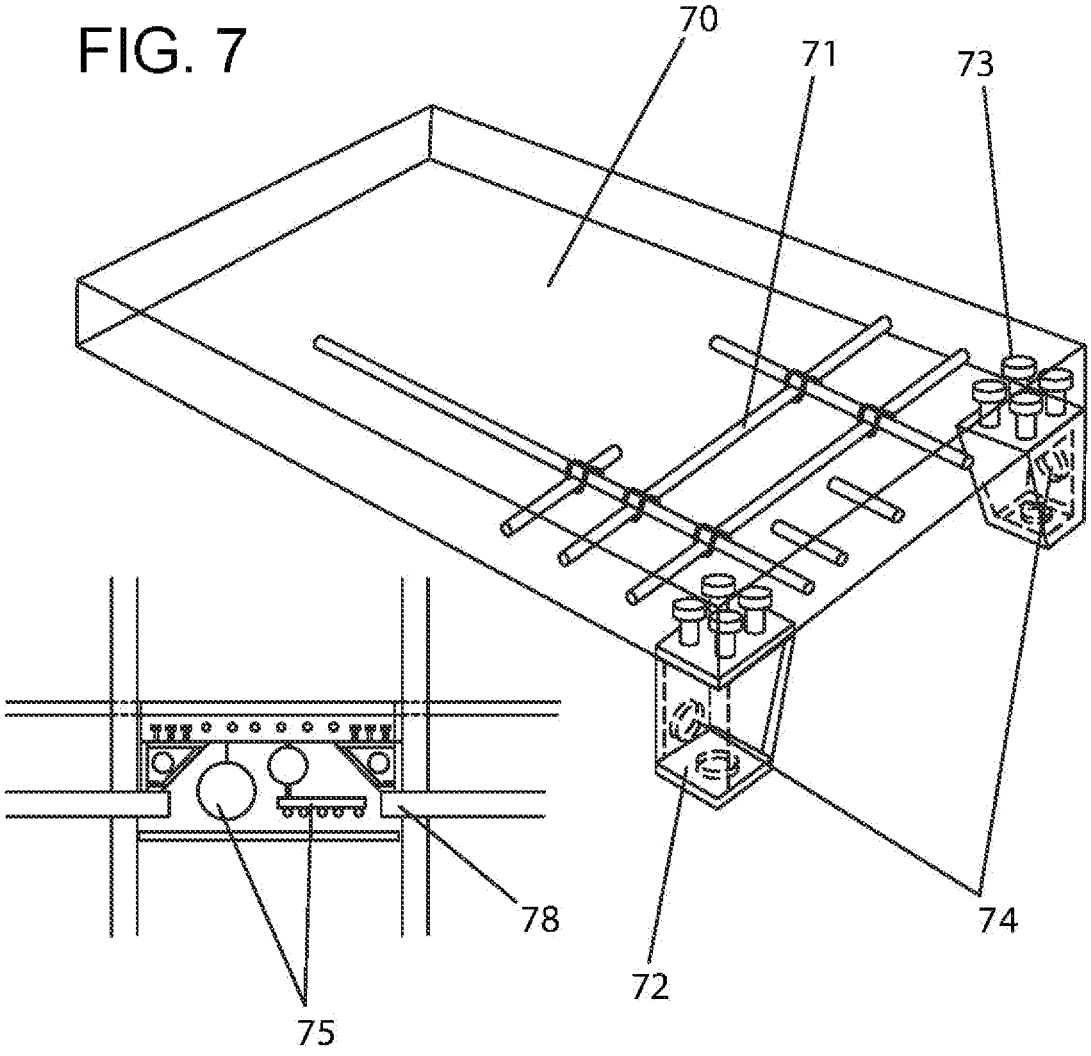
FIG. 7 is a transparent perspective view of a hallway slab and an end view of the slab installed in a building.

FIG. 7 View of Hallway Floor System

A section of floor is shown consisting of concrete slab 70, with reinforcing bars 71 and supported by pedestals 72 which are prevented from rotating by being bolted to connector blocks 10 and 20 by means of holes 74 creating a moment connection; and prevented from pulling out of the concrete by shear studs 73 which engage the concrete and the reinforcing bars. In a particular embodiment, the pedestals span vertically over upper and lower corner connectors and are bolted to them adding to the fixity of the vertical connection between columns. In another particular embodiment the slab is long enough that the pedestals span over two or more adjacent modules, adding to the fixity of the horizontal diaphragm action.

In another particular embodiment, the hallway slab is composed of formed plate, or any other suitable material such as wood or steel-urethane sandwich plate or composites.

In a particular embodiment the hallway is used as a convenient support and carrier for common services such as electrical or liquid supply lines 75 which are typically found in buildings and thus provides a means to pre-fabricate these elements, transport them to the building site and hoist them in to place without additional handling.

In an embodiment shown in FIG. 7, the pedestal 72 are in contact and positioned on the gusset plate 30. The gusset plate 30 used extends beyond the module frame to provide a surface for placing the pedestals 72 for supporting the slab.

Figure 8:
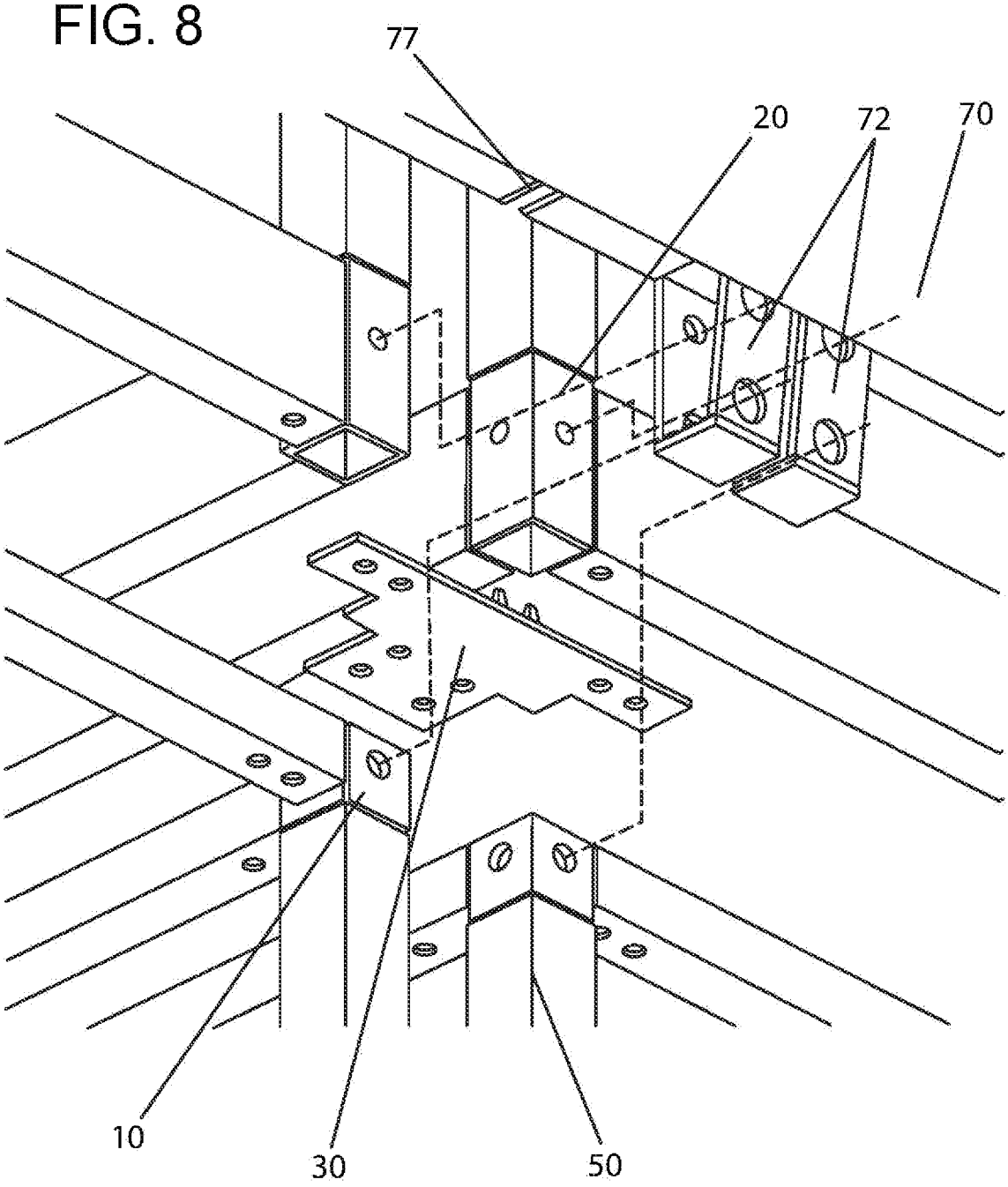
FIG. 8 is a partial exploded isometric view of the connection between two stacks of modules and the hallway floor at the point of connection between two consecutive hallway slabs.

FIG. 8 Exploded Isometric View of Connections to Hallway Floor System

When installed as described for use as the floor of a hallway between two stacks of modules separated by a suitable space, the structure thus formed unites the adjacent stacks with a moment resistant connection, such that the hallway floor structure increases the resistance of the entire building to lateral loads, thereby reducing both the number and size of diagonal reinforcement required.

In another particular embodiment the hallway slab structure is connected to the outer face of a stack of modules and supported by a column grid or diagonal tension braces or diagonal struts to provide a breezeway or balcony. In the embodiment shown in FIG. 8, the pedestals 72 of the hallway 70 are each provided with a pair of holes 74. The first set of holes 74 in the pedestal that are positioned closer to the floor 70 can be coupled to the lower connector 20 in the upper modular frame. While the second set of holes 74 in the pedestal that are positioned away from the floor 70 can be coupled to the upper connector 10 in a lower modular frame. Consequently, in the embodiment shown in FIG. 10, the pedestals are not positioned on the gusset plate 30, which lack the extension shown in FIG. 7.

Figure 9:
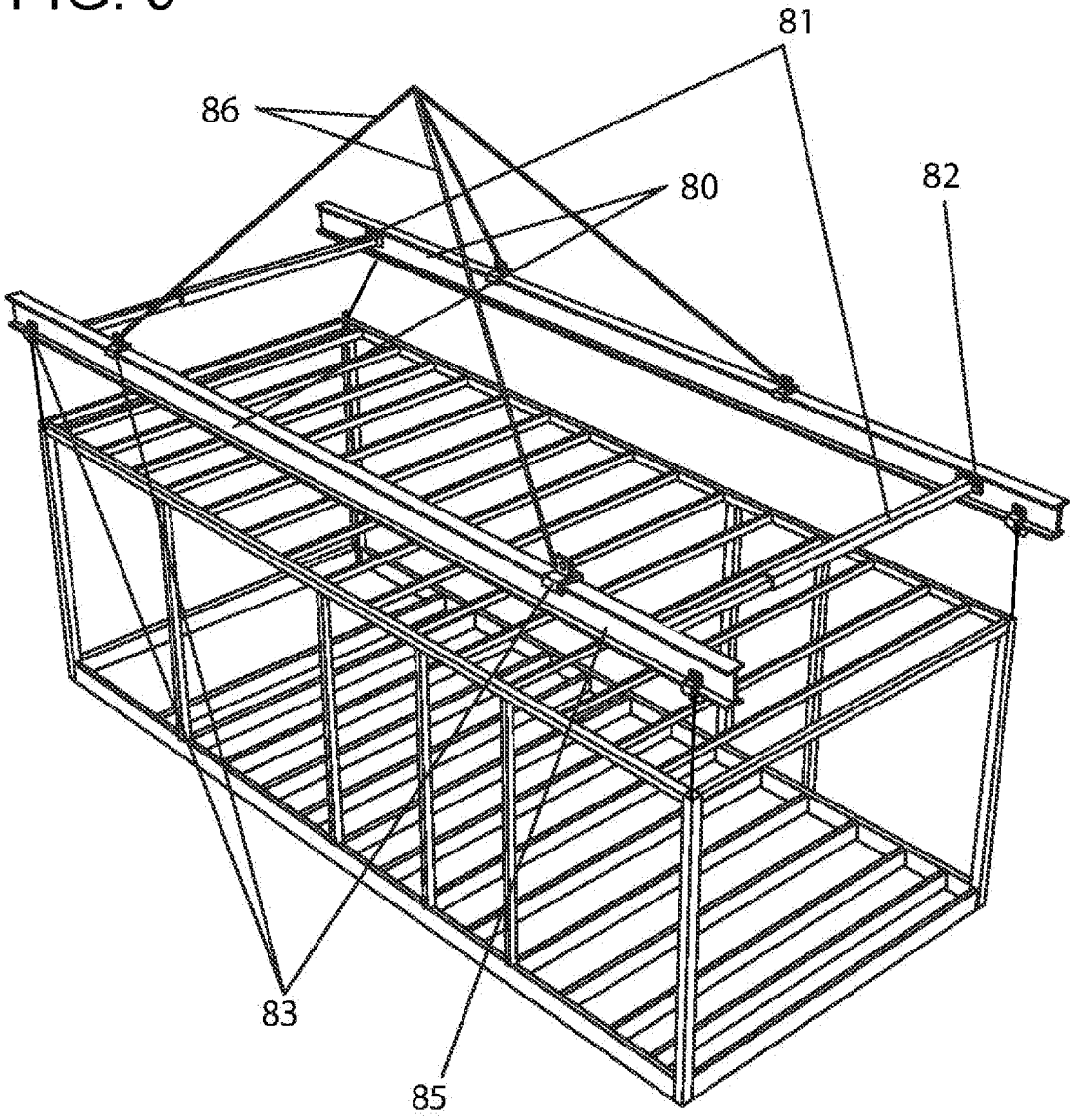
FIG. 9 is an isometric view of the hoisting rig engaged to a module.
Figure 12:
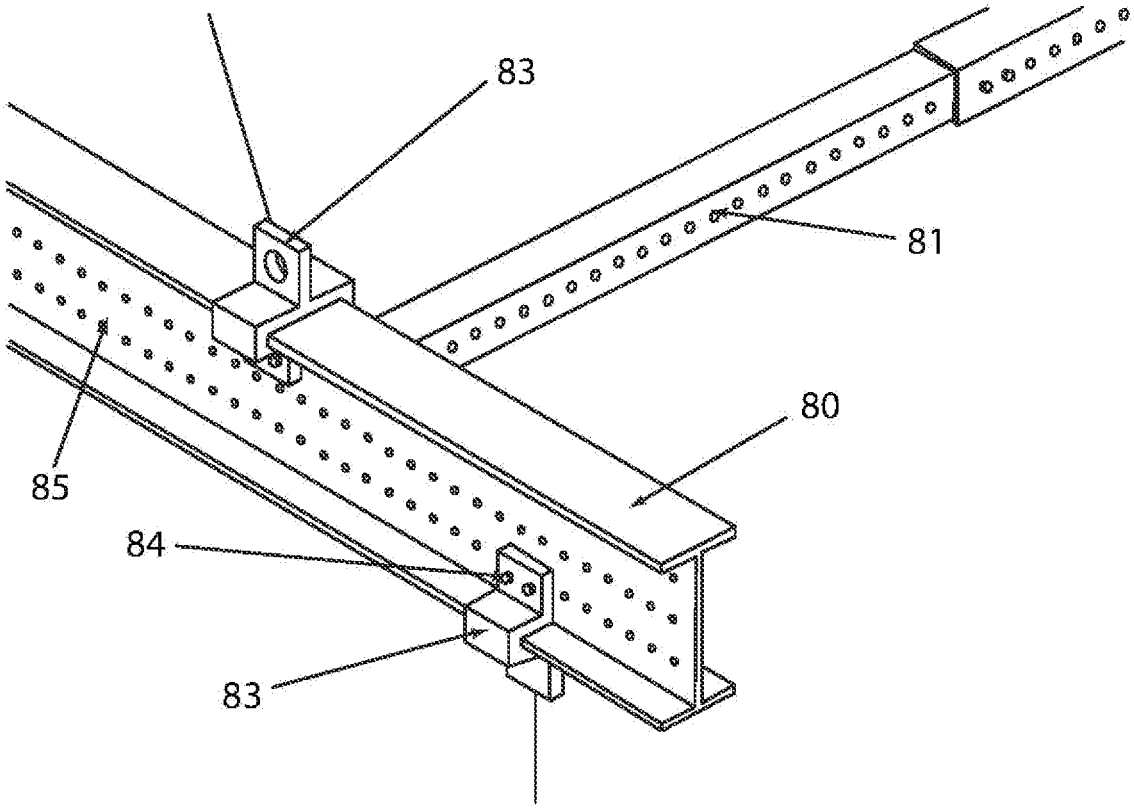
FIG. 12 is a partial perspective view of one corner of the hoisting frame.

FIGS. 9 and 12 Liftable Frame Assembly

A lifting frame is provided for the reduction of the compression loads on the module frame members attributable to the pyramidal displacement of the lifting lines, and to provide a means to accurately level the modules during all phases of the lift and irrespective of the length of line passing upward to the crane, so as to facilitate placement of the modules without inadvertent contact which can damage frames, seals, insulation and finishes.

Beams 80 are joined by struts 81 through flanges 82 using bolts. Eight sliding hoist points 83 (shown in FIGS. 10 and 12) are provided which slide on beams 80 and are prevented from moving when locked in place using locking pins 84 in rows of holes 85. Load-bearing cables 86 pass upwards and converge on master hoisting fitting 87 shown in FIG. 11.

In the embodiment shown in FIG. 9, the beam 80 can be an I-beam that has an upper end and a lower end. A first set of four hoist blocks 83 are provided on the upper end of the beam 80 and a second set of hoist blocks 83 are provided on the lower end of the beam 80. The hoist blocks 83 are coupled to the beam and can move (for instance by sliding the hoist block) from a first position to a second position, as may be required for lifting a frame. The I-beam can also be provided with a plurality of holes near the first and second ends, which allows affixing of the hoist blocks 83 in place on the I-beam by use of fasteners, such as bolts and nuts.

Figure 11:
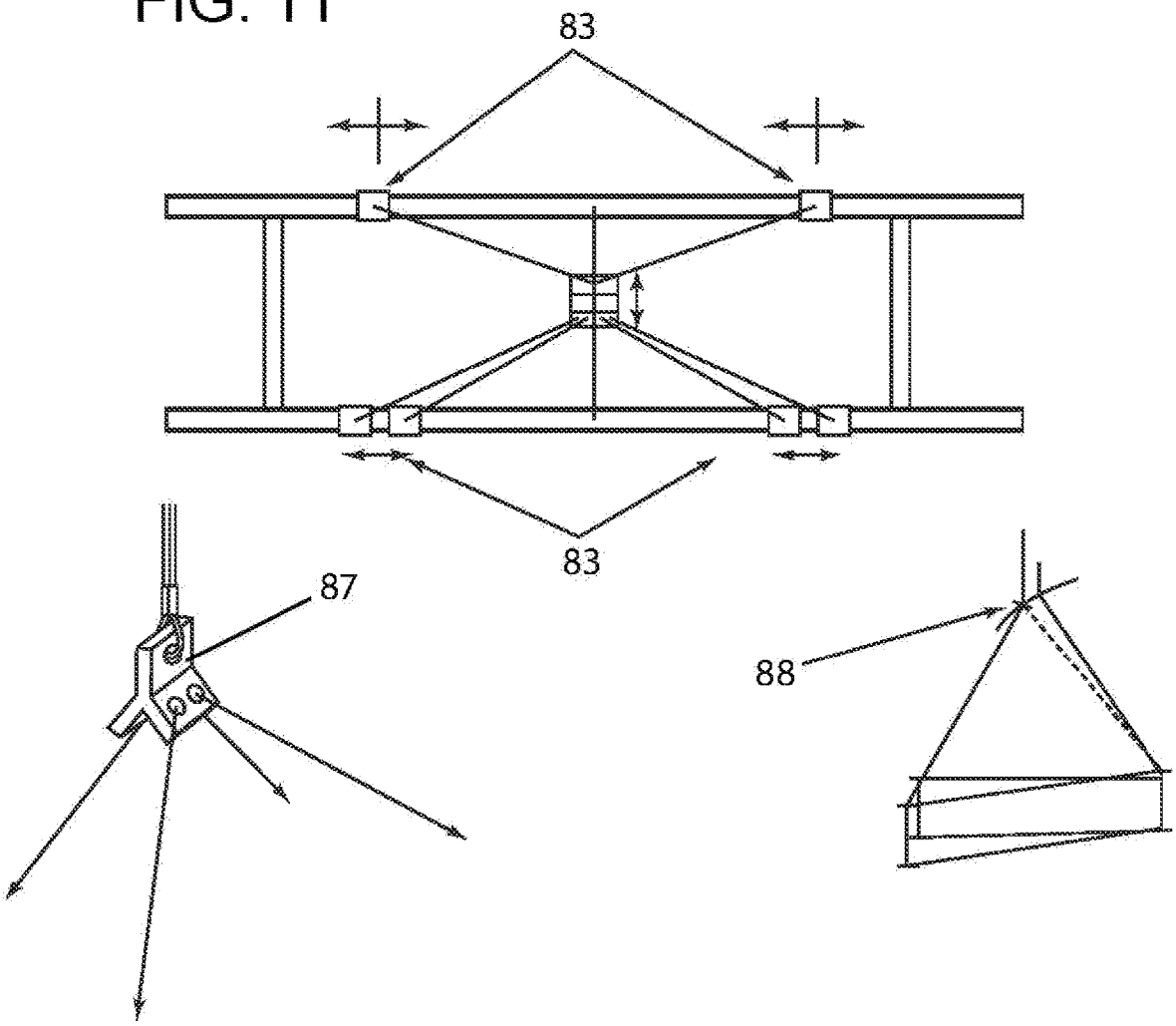
FIG. 11 (upper) is a top view showing the effect on the lateral centre of gravity of moving the hoist points on the hoist frame (Bottom left) the combined hoisting point (bottom right) an end view of the shift in CG from centre to one side.

The first set of hoist blocks 83 present on the upper end (or first end) of the I-beam are attached to load bearing cables 86, which are attached to a master hoisting fitting 87 shown in FIG. 11. The lifting frame structure be balanced to reduce load on any particular portion of the modular frame by moving the hoist blocks 83 on the I-beam 80, and fastening the hoist blocks 83 in a different position.

FIG. 11 Hoisting Geometry

In preparation for hoisting a module, the centre of gravity of the module is determined by the use of a computer program capable of calculating the centre of gravity based on the recorded weights and positions of the masses which comprise the module as represented in a computer model, or iteratively by one or more trial lifts. The data thus gathered is recorded and provided with the module. A table is prepared using a computer program or trigonometry which specifies the hole locations to be used to adjust the combined centre of gravity of the module and hoisting frame system to level the module to be hoisted. Prior to connecting the hoisting frame to the module, the table is consulted and the sliding blocks are located and locked in place in the stated positions.

To move the centre of gravity of the system along the long axis of the system, hoist points 83 are moved as a group towards the centre of gravity of the load, maintaining an equidistant (quadrilateral) arrangement. To move the centre of gravity sideways, 88, at right angles to the long axis of the system, the hoist points 83 on one side only of the beams 80 are brought together or spread apart so as to increase or decrease the angle between them thus changing the angular relationship between the hoisting lines passing upwards to common hoisting point 87.

In another embodiment the hoist points are moved independently to achieve other desirable objectives, such as equalizing the load on the slings or to tilt the load intentionally.

In another embodiment the frame is composed of a single beam, in another embodiment the frame is not quadrilateral but triangular, polygonal or any other shape as may be convenient for the purpose of best supporting and balancing the load.

Figure 10:
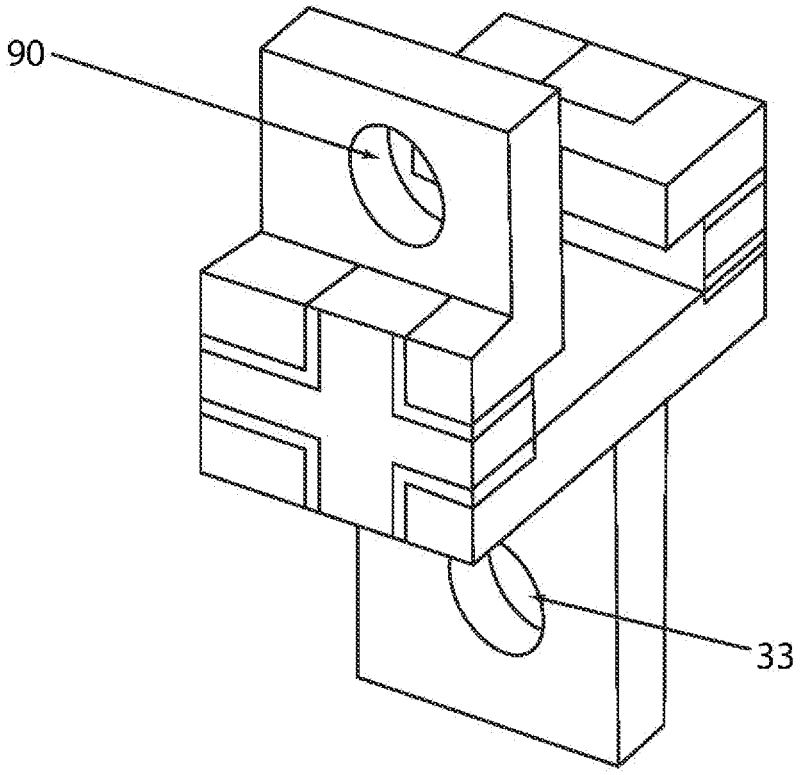
FIG. 10 is an isometric view of a typical sliding hoist point.

FIG. 10 View of a Single Sliding Block with Fabrication Details

FIG. 10 discloses an embodiment of a hoist block in accordance with the invention. The hoist block can be made of a block having a T-shaped channel extending from one face to another face of the block, and having an opening on an upper end of the block. The opening on the upper end extends to the T-shaped opening in the block. The block also has a first flange extending upwardly from the upper face of the block and a second flange extending from the lower end of the block. Each flange is provided with an opening for coupling the block. In a particular embodiment, the block is machined from solid steel or cast or fabricated from another suitable material. In another particular embodiment, the block is welded from plate as shown.

Figure 13:
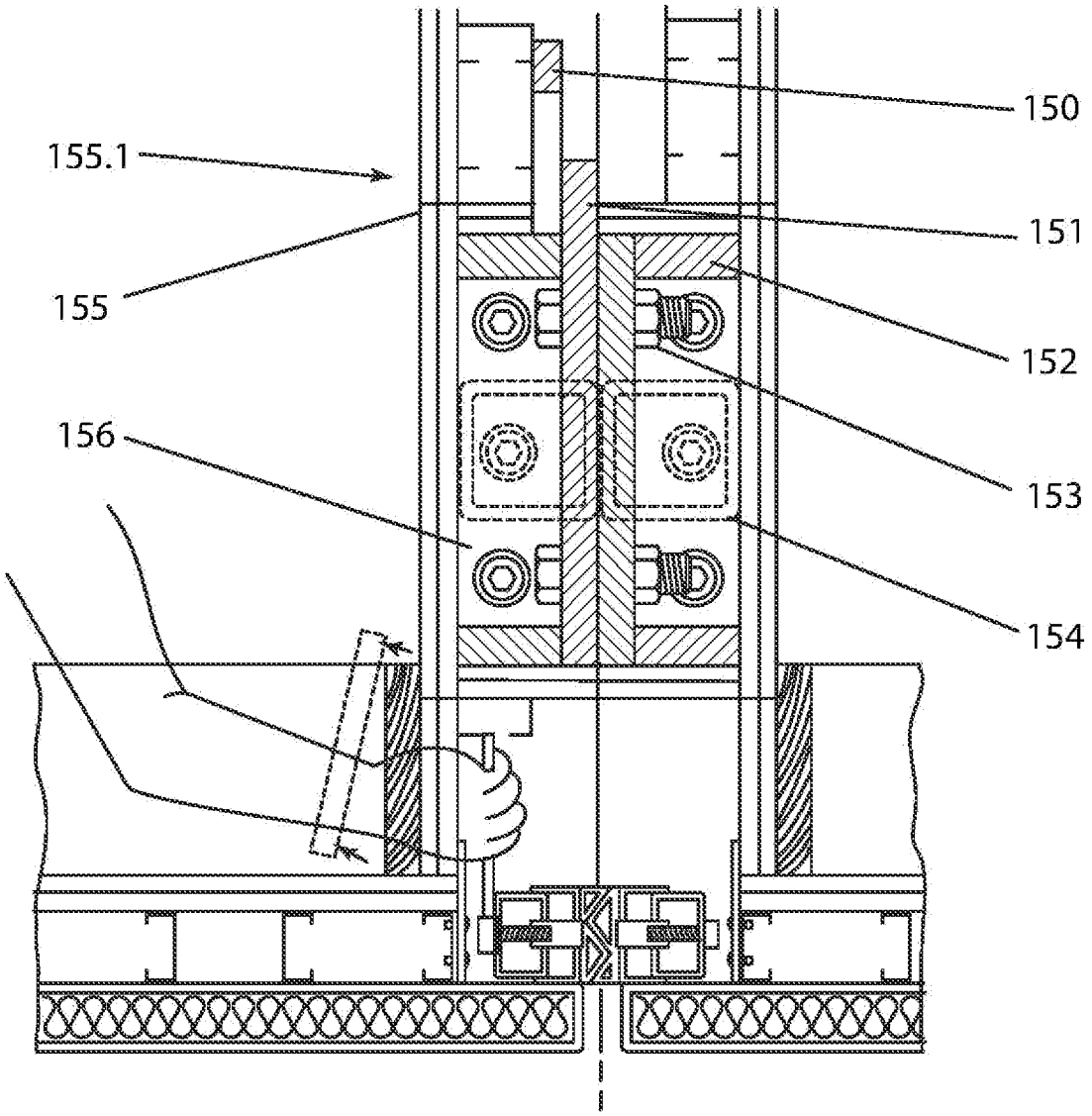
FIG. 13 is a section view through a split column.

FIG. 13 is a Section View Through a Split Column

FIG. 13 discloses a particular embodiment of a shared structural column. A built-up "C" section 152 spanning the height of the module is bolted in multiple locations with bolts 153 to a similar section 151 forming a column which is twice as wide thus providing greater resistance to buckling forces. Baseplate 156 which occurs at both the top and bottom forms a transition to lighter columns 154 or heavier columns as appropriate depending on the loads. Diagonal braces 150 as required are connected to the extended web of column 151. A removeable section of fire-proof wall board 155 is provided for access to the bolts during erection of the structure.

Figure 14:
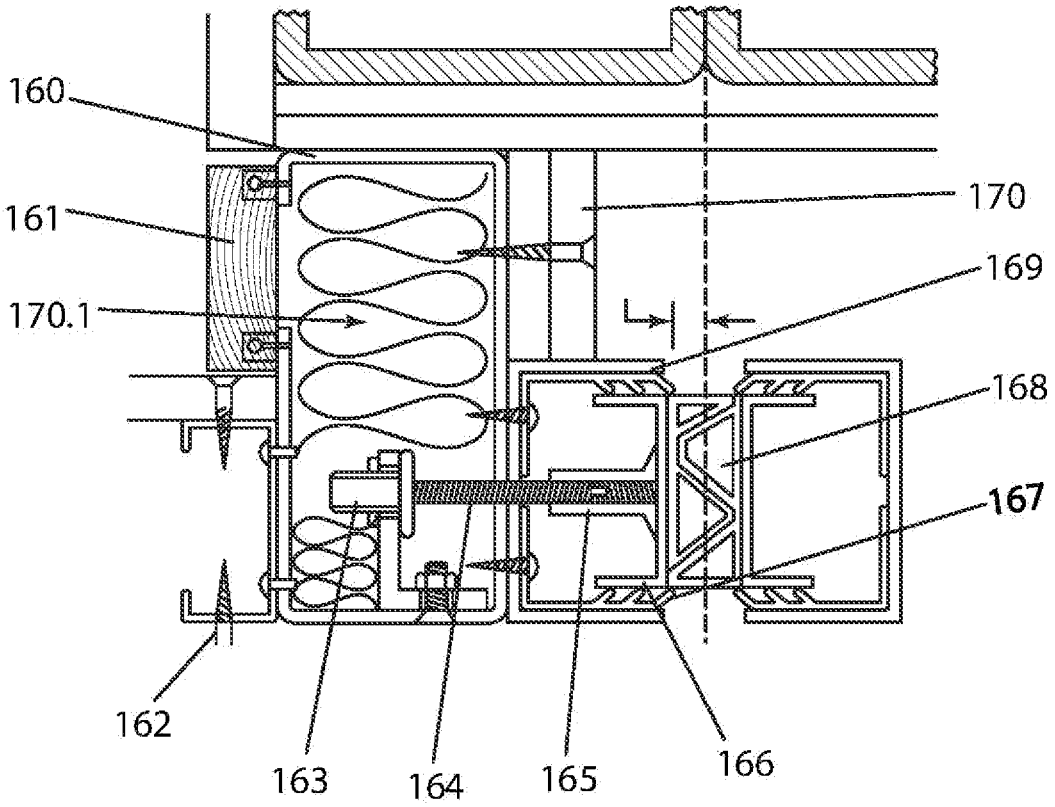
FIG. 14 is a section through an extendable mateline gasket.

FIG. 14 is a Section Through an Extendable Mateline Gasket

A particular embodiment of an extendable mateline gasket is shown. Molded or extruded elastic material 168 with multiple sealing features is fastened to channel 166, which slides in gasket 167 which is fastened to the inner surface of channel 169 and is extended by captive screw 164 travelling in threaded socket 165 and actuated by rotating head 163. The assembly is mounted to support channel 160 which can be of any convenient depth to which is fastened acoustic and fire-resistant material 170. Access to operate the gasket advancing screw is through cover 161 which can, in a particular embodiment, be decorative and fastened in a removable manner.

To form a seal between a first modular unit with a second modular unit, the modular units are each provided with a channel 166. In the embodiment shown, a gasket 167 is present in the channel 160, along with a toothed connector 168. The toothed connector has a profile that is complementary to the toothed profile in the channel in the second modular unit. In a particular embodiment, the gasket 167 allows movement of the toothed connector 168 in one direction only, which is away from the modular frame. This can be achieved by, for instance, providing angled tabs that extend from a surface of the toothed connector and corresponding receptacles in the gasket 167 for receiving the tabs. Once the tabs are inserted into the receptacles, the gasket is locked in place and can prevent the toothed connector from moving back into the channel 160.

Initially, the two modular units are brought in contact with each other and the channels aligned. The toothed connector in the second modular frame can be present in an extended position, where it extends beyond the mateline of the two modular frames and also beyond the cavity of the channel 160. Once in place, the toothed connector in the first channel can be extended from a disengaged position, where the toothed connector is positioned within the cavity of the channel to an engaged position, where it extends outside the cavity of the channel and the teeth of the toothed connector in the first modular frame engage and align with the complementary teeth of the toothed connector in the second modular frame.

Figure 15:
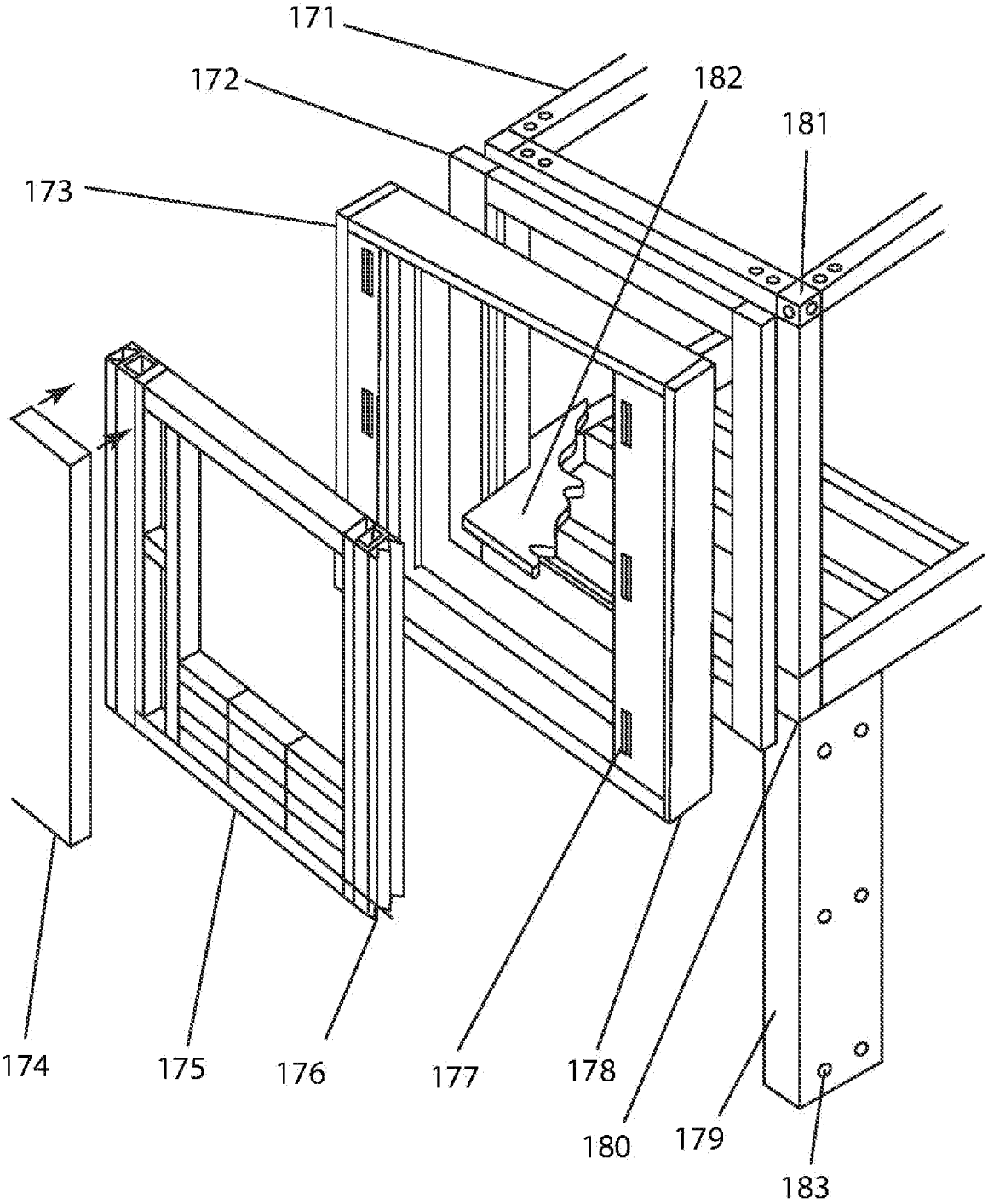
FIG. 15 is an exploded view of the façade system.

FIG. 15 is an Exploded View of the Façade System

Figure 16:
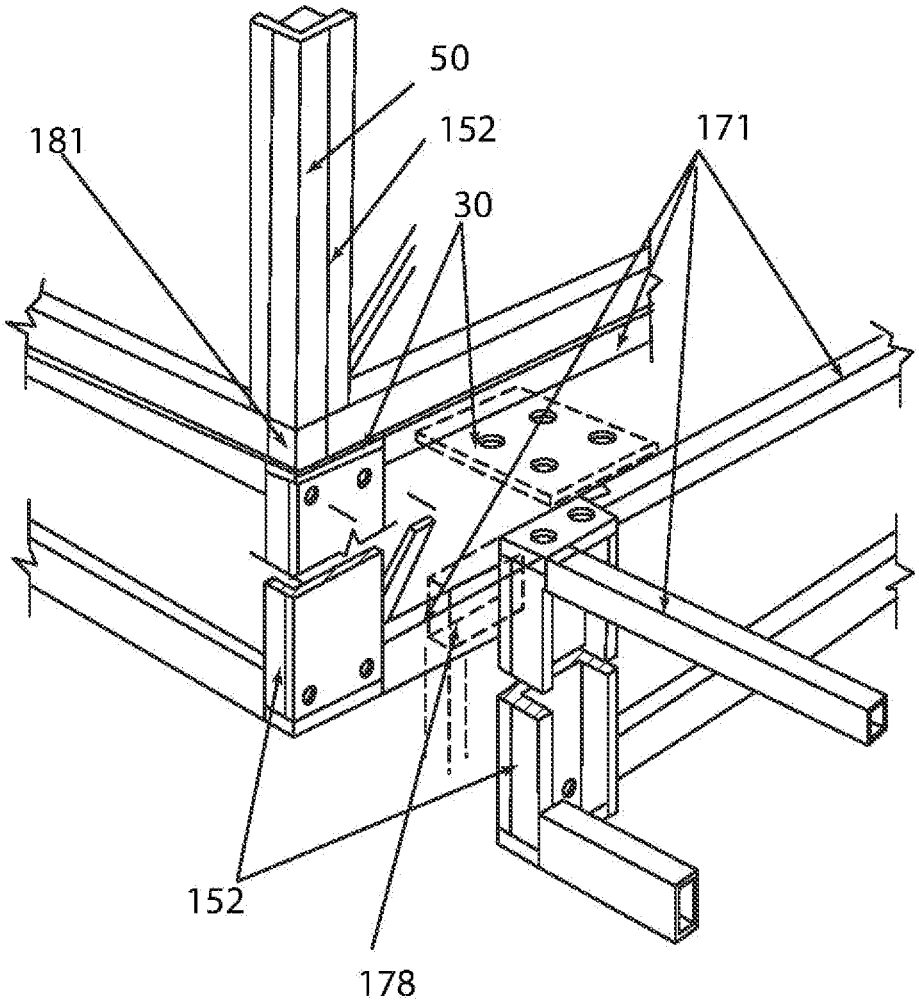
FIG. 16 is a partially exploded view of the connection between an upper floor module built with reinforced columns and a lower floor module built with built-up mega columns.

A particular embodiment of a façade system for modular construction is shown together with the associated structural frame. The structural frame 171 with moment blocks 181 is fireproofed with insulating board layer 172 and decked with flooring board 182 and is shown supported by one half of progressively reinforced split column 179 connected to the adjacent column (not shown) using bolts inserted in holes 183. Spacer frame 173 is acoustically and fire insulated with board layer 178 and is provided with holes 177 to access gasket extension screws 164 (FIG. 16). Façade infill and gasket mounting frame 175 is equipped with gasket assembly 176 and faced with exterior wall panel 174. The transition to a built up structural column 179 with slip-critical bolting 183 is shown.

FIG. 16 is an exploded view of the vertical transition at a shared structural column A particular embodiment of both halves of a shared structural column at the point of transition to a lighter column is shown. Built up "C" sections 152 are bolted to one another to form an "I" section. The members of structural frame 171 are welded to the "C" channels in lieu of the moment blocks in the frames where the "C" sections are used. Moment block 181 rests on combined shiming and gusset plate 30 (greater detail can be found in FIG. 2) which is in turn fastened to the top end of columns 152. Façade framing 173 is fastened to the face of the assembly in a manner similar to FIG. 15.

Figure 17:
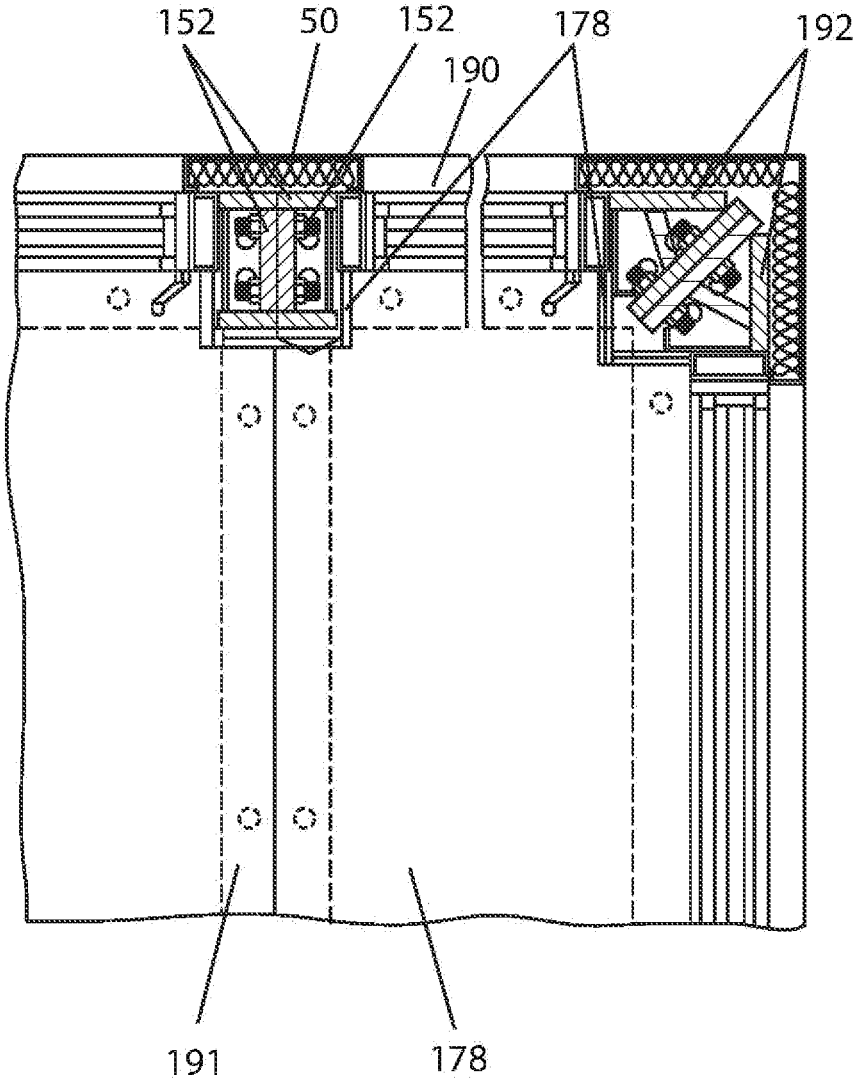
FIG. 17 is a horizontal section of a panelized structure constructed with panels framed by built-up mega columns.

FIG. 17 is a Horizontal Section of a Structural Panelized Façade System

A particular embodiment of a structural façade system for a modular building is shown. Built up sections 152 are joined in the manner previously described by headers top and bottom to form assemblies with window units 190, but unlike the volumetric modules previously described, the façade units are shipped and erected separate from the floors and interior walls. Beams 191 support floor slabs 178. Fireproof covering 178 insulates the steel structure. Façade panel 50 provides insulation and appearance. As someone skilled in the art will appreciate, 45 degree split corner column 192 performs a similar function at a 90 degree outside corner. In another particular embodiment the angle of the split corner column is greater than or less than 45 degrees so as to facilitate the construction of structures with variable geometry.

Figure 18:
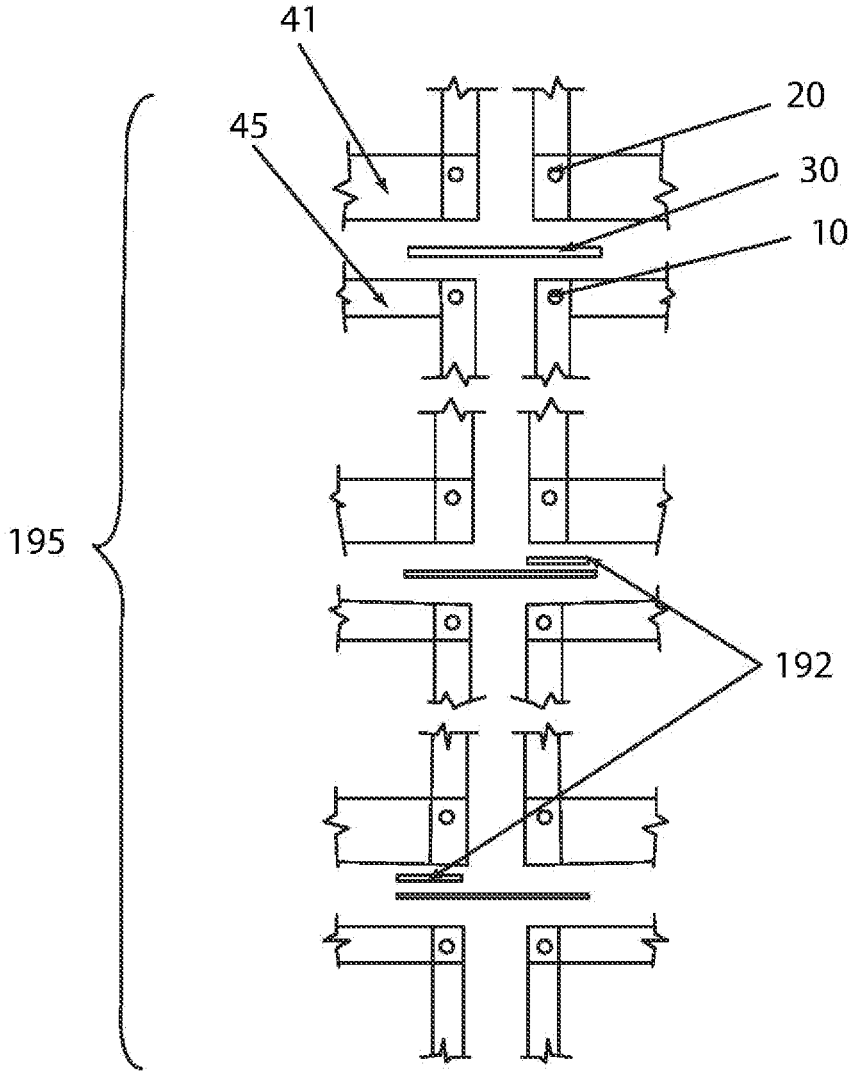
FIG. 18 is an exploded vertical view of a stack of modules showing the use of gusset plates of varying thickness and number to maintain the correct total height and alignment of a stack of modules.

FIG. 18 is a Simplified Exploded View of a Vertical Stack of Modules

As previously described, upper corner connector 10 is joined to lower corner connector 20 by bolts passing through gusset plate 30. In a particular embodiment, gusset plate 30 is provided in a variety of thicknesses which can be selected during assembly of the building and interposed in the connection as required to compensate for variations in the dimensions of the modules, such that the total dimension of the stack of modules conforms to the correct value as measured at 195. In another particular embodiment, a partial plate 192 is provided with the corresponding hole pattern and in a variety of thicknesses to compensate for differences in the dimensions of adjacent modules.

Figure 19:
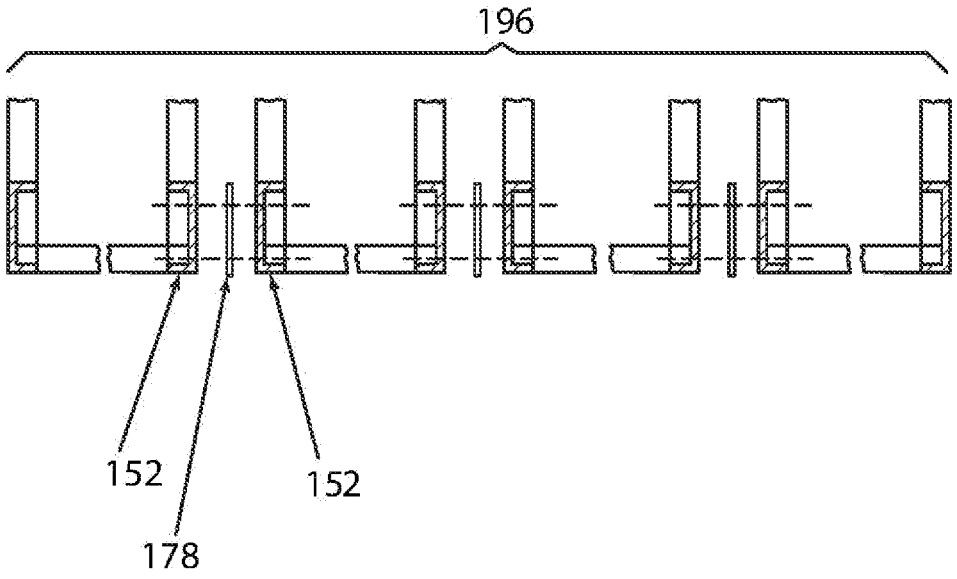
FIG. 19 is an exploded horizontal section of a row of modules showing the use of shims of varying thickness and number to maintain the correct total width and alignment of a row of modules.

FIG. 19 is a Simplified Exploded View of a Horizontal Row of Modules

As previously described, built up "C" section columns composed of two halves 152 are bolted together to join adjacent modules and to form a larger section. In a particular embodiment, shim 178 is provided in a variety of thicknesses and with pre-cut holes for the passage of connecting bolts. During assembly of the building the appropriate shim can be selected and interposed in the connection as required to compensate for variations in the accumulated horizontal dimension of the modules as measured at 196.

PCT/CA2015/050369, filed Apr. 30, 2015, incorporated herein by reference, discloses another embodiment of a connector and connector assembly for use in the construction of modular units and buildings. The improvements disclosed herein can be used with the connectors disclosed in the earlier PCT applications noted herein.

Figure 20A:
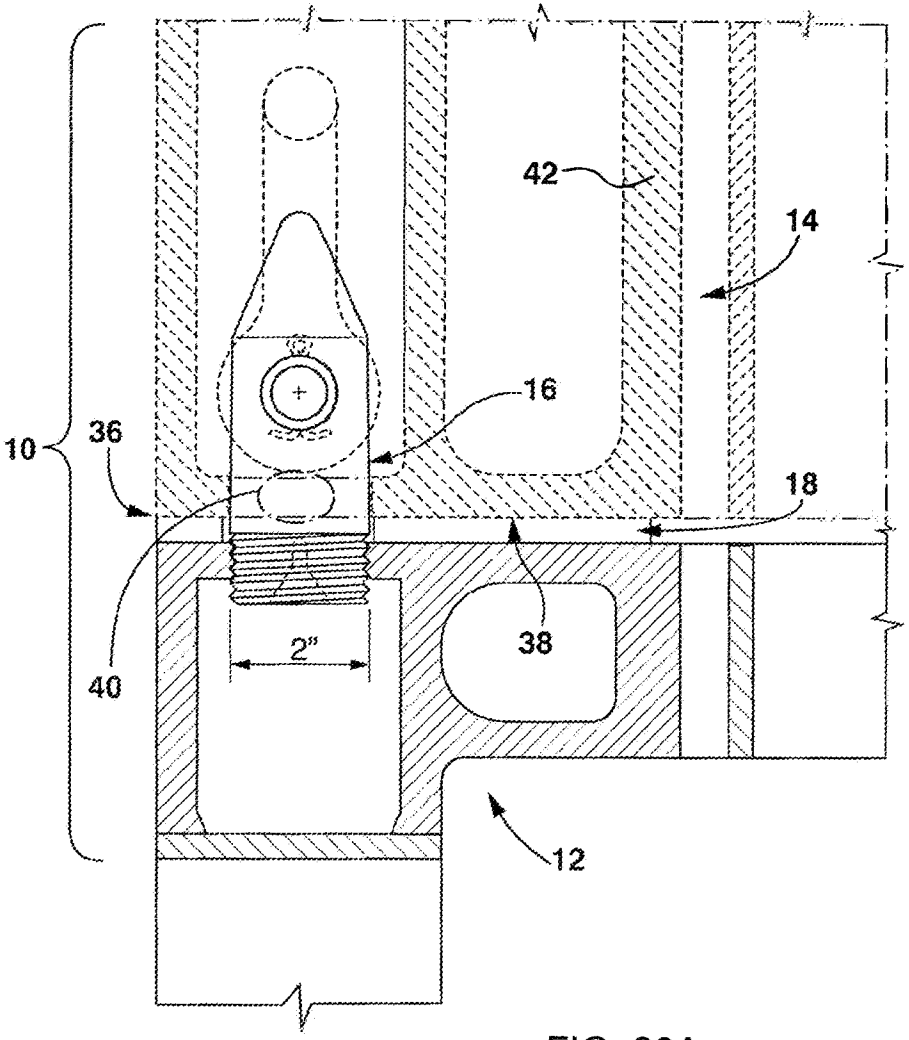
FIG. 20A is a sectional view of an embodiment of a connector assembly in accordance with the specification.

In accordance with the specification FIG. 20A shows an embodiment of a connector assembly (10) having a first (upper) connector (12), a second (lower) connector (14), a pin (16) and a gusset plate (18) sandwiched between the first (upper) connector (12) and the second (lower) connector (14). The making and use of the connector assembly (10) as disclosed herein, in particular, the second (lower) connector (14) and the gusset plate (18), is similar to that disclosed in n PCT application numbers PCT/CA2014/050110, filed Feb. 18, 2014, and PCT/CA2015/050369, filed Apr. 30, 2015, both incorporated herein by reference. Moreover, a person of ordinary skill in the art should be able to use the connector assembly (10) disclosed in the subject application and adapt it accordingly, based on the teaching of the above-noted patent documents, common general knowledge and/or non-inventive routine experimentation.

Figure 20B:
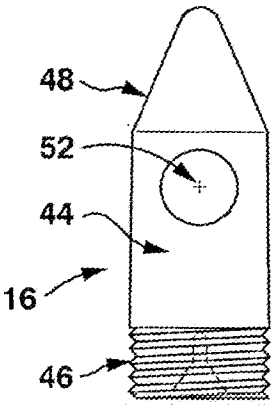
FIG. 20B is a side view of an embodiment of a pin in accordance with the specification.

FIG. 20B discloses a pin (16) for use in coupling the first (upper) connector (12) to a second (lower) connector (14). The pin (16) has body (44), which in the embodiment disclosed herein is cylindrical in shape, however, other shapes may be made or used depending upon the design and application requirements. In one embodiment, as disclosed herein, the pin-body (44) at one end is threaded (46), while the other opposed end is conical-shaped (48). The threaded end (46) of the pin (16) is cylindrical in shape and can be screwed into the first (upper) connector (12), as described herein, for connecting the pin (16) to the first (upper) connector (12).

The conical-shaped end (48) of the pin (16) can be inserted into an opening (40) (circled in FIG. 20A) in the second (lower) connector. The conical-shaped end (48) of the pin can help with coupling of the first (upper) connector (12) with the second (lower) connector, while also helping with alignment of the two connectors (12 and 14) to form the connector assembly.

Although the pin disclosed and described herein is threaded at one end while the other end is conical, a person of ordinary skill in the art should recognize that there is no absolute requirement to do so and the shape of the pin can be varied depending upon design and application requirements. For example and without limitation, rather than having a threaded end, one end of the pin can be smooth such that it can be fixed to the first (upper) connector by welding or other affixing means, such as a screw, bolt or pin, or any other means that allow the pin to be held in place. Further, the opposing end of the pin (described herein as the conical-shaped end) can be flat, such as being more cylindrical-shaped similar to the shape of the body of the pin. The opposing end of cylindrical pin, in one embodiment, can be provided with beveled edges.

In one embodiment, the pin (16) can be provided with a hole (52), which can used for help with hoisting of a modular frame assembly, as described further herein.

Figure 21:
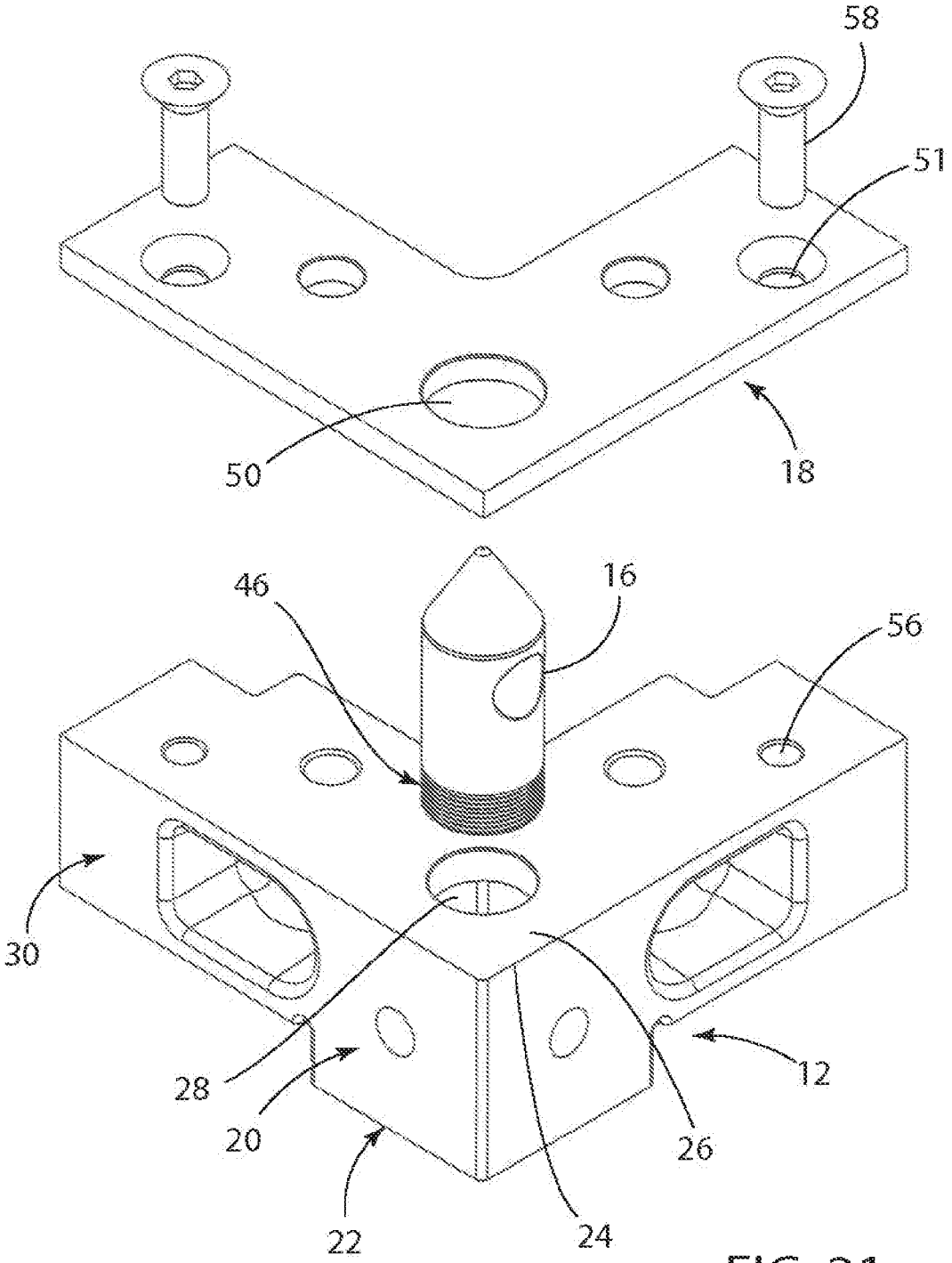
FIG. 21 is a perspective view of an embodiment of a first (upper) connector coupled to a pin in accordance with the specification.
Figure 22:
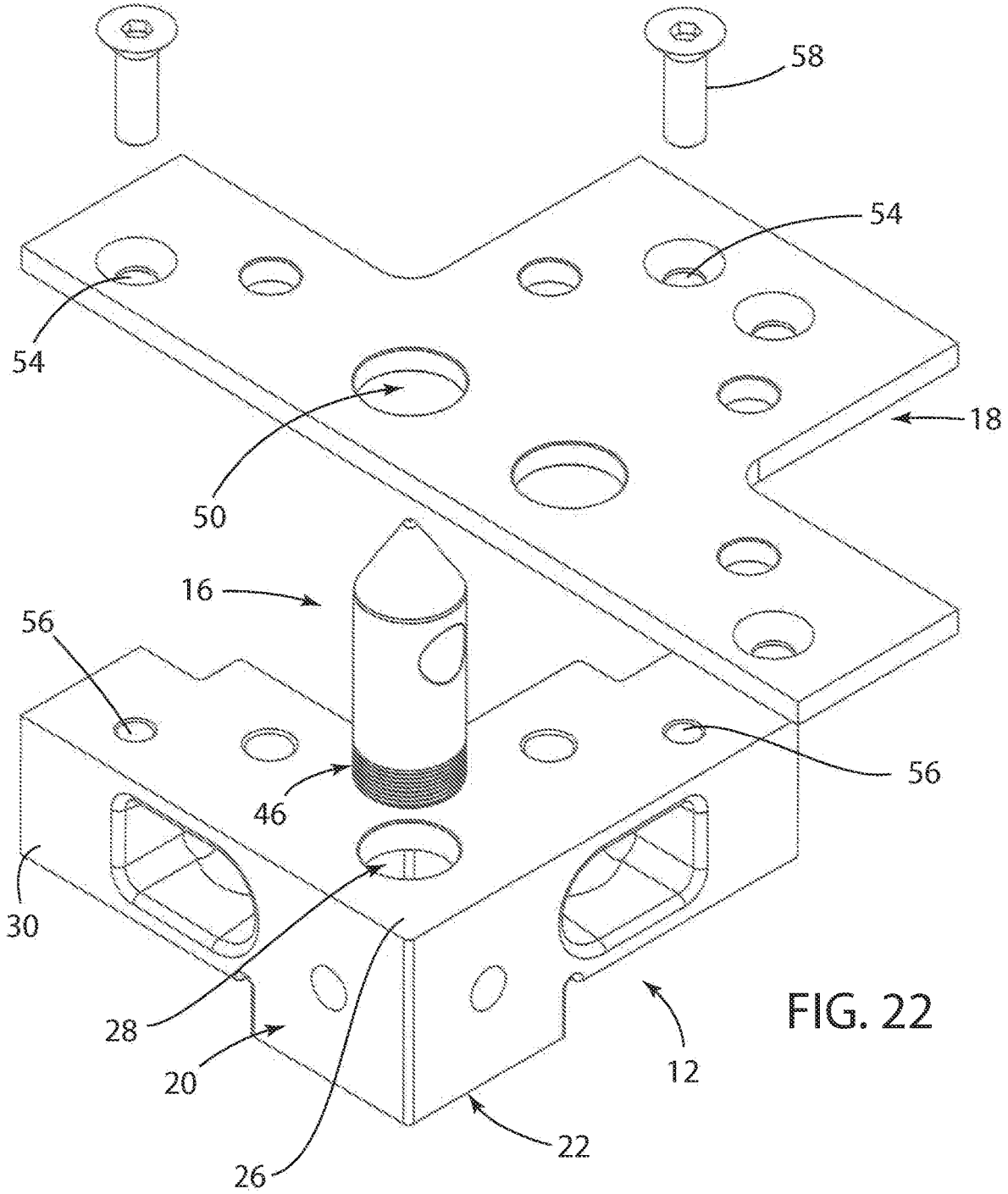
FIG. 22 is an exploded perspective view of an embodiment of a first (upper) connector, a pin and a gusset plate in accordance with the specification.

FIGS. 21 and 22 disclose embodiments of a first (upper) connector (12), a pin (16) for coupling and a gusset plate used for forming a connector assembly (10). The first (upper) connector has a first (upper) connector body (20) and first (upper) connector arm (30) extending from the first (upper) connector body (20).

The first (upper) connector body (20) at one end (the first (upper) connector body column receiving end (22)) is adapted for receiving a column of a modular structure for connecting the first (upper) connector to a modular structure. At an opposed end, the first (upper) connector body has a first (upper) connector body gusset contact end (24) and a first (upper) connector body gusset contact face (26) at the first (upper) connector body gusset contact end (24). When forming the connector assembly (10), the first (upper) connector body gusset contact face (26) contacts the gusset plate (18).

Figure 23:
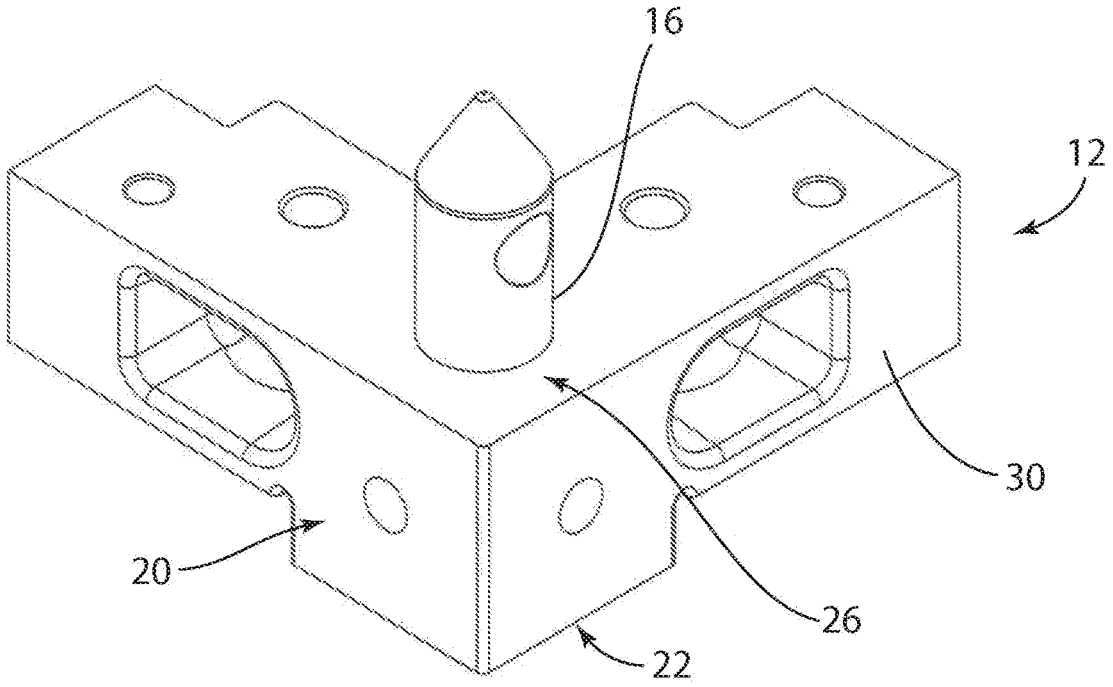
FIG. 23 is an exploded perspective view of another embodiment of a first (upper) connector, a pin and a gusset plate in accordance with the specification.

The first (upper) connector body (20) at the first (upper) connector body gusset contact face is also provided with a threaded aperture (28) for receiving the threaded end (46) of the pin (16). The threaded end (46) of the pin (16) can be screwed into the threaded aperture (28) for coupling the pin (16) and the first (upper) connector (12) (as shown in FIG. 23).

Also shown in FIGS. 21 and 22 are embodiments of a gusset plate (18) that can be used for forming the connector assembly (10). The gusset plate (18) as shown herein is provided with a passage (50) that can allow the pin (16) to pass through the gusset plate (18) when coupling the first (upper) connector (12) with the second (lower) connector (14). The presence of the passage (50) in the gusset plate (18), along with the conical shape of the pin (16) can assist with installation for forming the connector assembly (10) and for proper alignment of the gusset plate (18).

Additional holes (54) can be provided on the gusset plate (18) that align with holes (56) in the first (upper) connector arms (30) on the first (upper) connector gusset contact face (26). Bolts (58) or other fastening means can be used for affixing the gusset plate (18) to the first (upper) connector (12).

Once the first (upper) connector (12), pin (16) and the gusset plate (18) are coupled together, the assembly than be connected to the second (lower) connector (14) to form the connector assembly.

The second (lower) connector (12), analogous to the first (upper) connector (10) has a second (lower) connector body (32) that has a second (lower) connector body column receiving end (34), a second (lower) connector body gusset contact end (36) and a second (lower) connector body gusset contact face (38) at the second (lower) connector body gusset contact end. The second (lower) connector body column receiving end (34) is adapted for coupling to a beam or other structure of a module; while the second (lower) connector body gusset contact face (38) at the second (lower) connector body gusset contact end (36) is adapted for contacting the gusset plate (18) (as shown in FIG. 20A).

The second (lower) connector body (32) at the second (lower) connector body gusset contact face is provided with an opening (40) (circled in FIG. 1) for receiving the conical end of the pin (16). During coupling to form the connector assembly (10), the conical end (48) of the pin (16) can help with assembly to form the connector assembly (10) and also with proper alignment of the modules.

The second (lower) connector (14), similar to the first (upper) connector, is also provided with at least a pair of second (lower) connector arms (42) coupled to and extending from the second (lower) connector body. Other than the features disclosed herein, features of the first (upper) connector (12), the second (lower) connector (14) and gusset plate (18) can be similar to that disclosed in PCT application numbers PCT/CA2014/050110, filed Feb. 18, 2014, and PCT/CA2015/050369, filed Apr. 30, 2015, both incorporated herein by reference.

Although the specification has been described with the use of a first (upper) connector and a second (lower) connector, the first connector could be lower connector of a modular frame and the second connector can be upper connector of a modular frame unit. Alternatively, both the first and second connectors could be upper or lower connectors.

Figure 24:
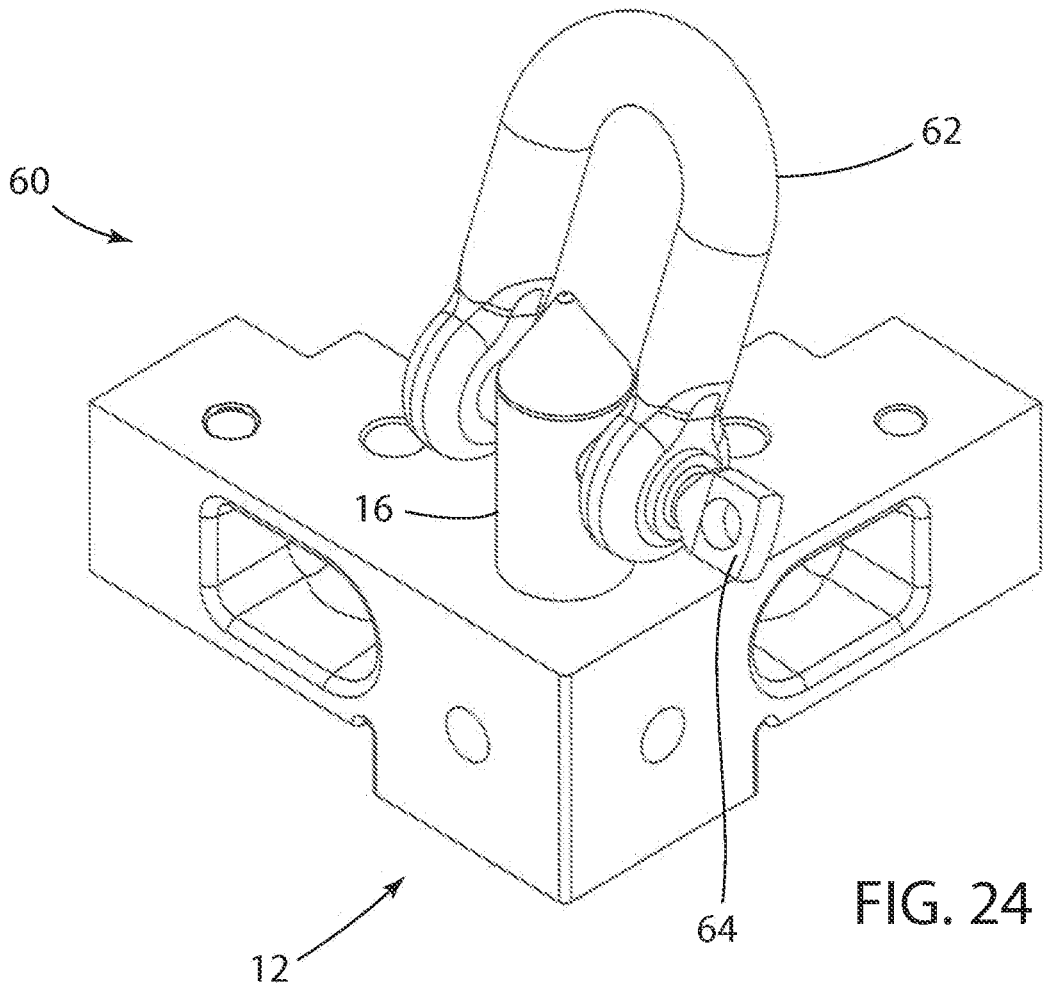
FIG. 24 is a perspective view of an embodiment of a first (upper) connector, a pin and a shackle in accordance with the specification.

FIG. 24 shows a hoistable assembly (60) formed by the first (upper) connector (10), the pin (16) and a shackle (formed by a U-shaped member (62) and pin (64)). Once the first (upper) connector has been attached to a first (upper) end of a module and the pin has connected to the first (upper) connector (as described herein), a pin (64) connected to the U-shaped member (62) of a shackle can be inserted into the pin-hole (52) of the pin (16). This allows a module frame to be lifted and moved from one location to another, while keeping the module intact. Once the module has been positioned, the pin (64) can be removed and module frame separated from the shackles. The hoistable assembly can be used with the hoistable means disclosed herein above.

FIGS. 25-28 show embodiments of assembled corner connector assembly formed by the upper connector, gusset plate, pin and lower connector, disclosed herein. During assembly, the threaded end of the pin is screwed to the upper connector that has a threaded opening on the gusset contact face of the upper connector. Once coupled to the upper connector, the conical end of the pin is passed through the opening in the gusset plate and is inserted into the opening in the gusset plate contact face of the lower connector. This allows for proper alignment of the connector assembly and can avoid use of the pins as disclosed in the gusset plate of the previous PCT applications, disclosed herein.

For coupling the upper connector, lower connector and gusset plate together to form the connector assembly, screws (FIGS. 25 and 27) or bolts (FIGS. 26 and 28) can be used. A first set of screws or bolts can pass through holes in the gusset plate and engage the upper connector. While a second set of screws or bolts can pass through opening in the arms of the lower connector, and then pass through holes in the gusset plate and engage and couple to the upper connector to form the connector assembly.

Figure 25:
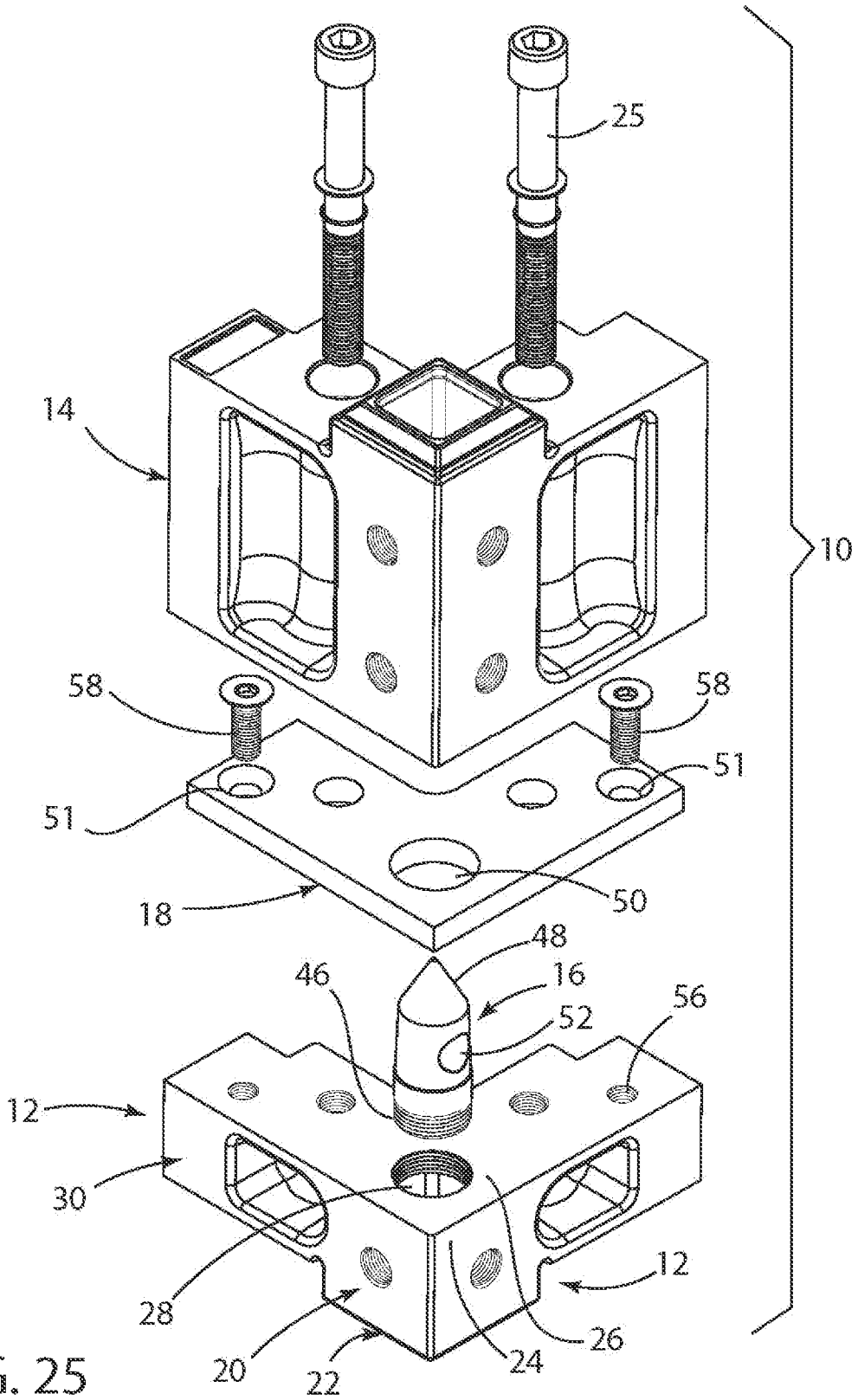
FIG. 25 is an exploded perspective view of a corner connector assembly in accordance with the specification.
Figure 26:
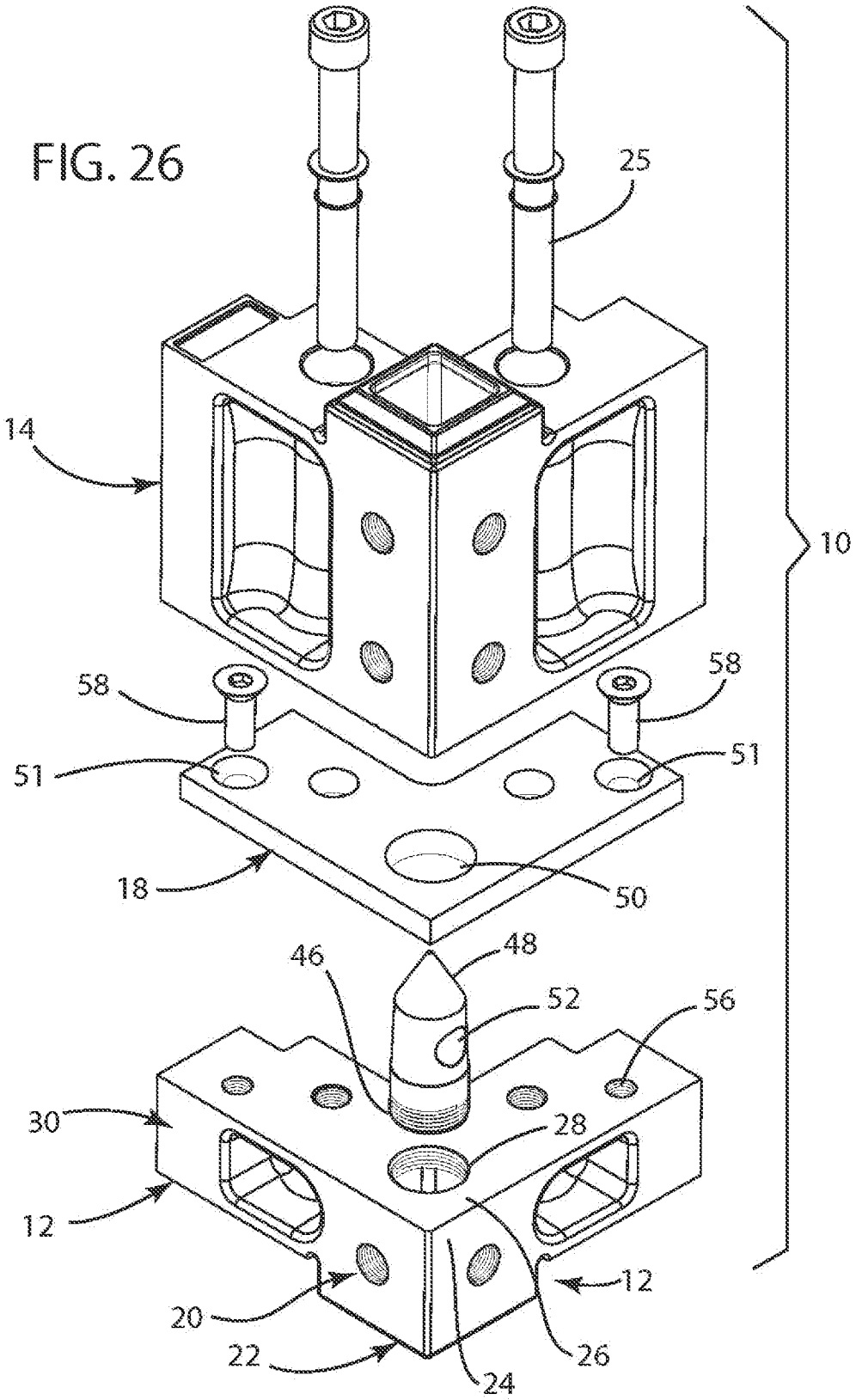
FIG. 26 is an exploded perspective view of another embodiment of a corner connector assembly in accordance with the specification.
Figure 27:
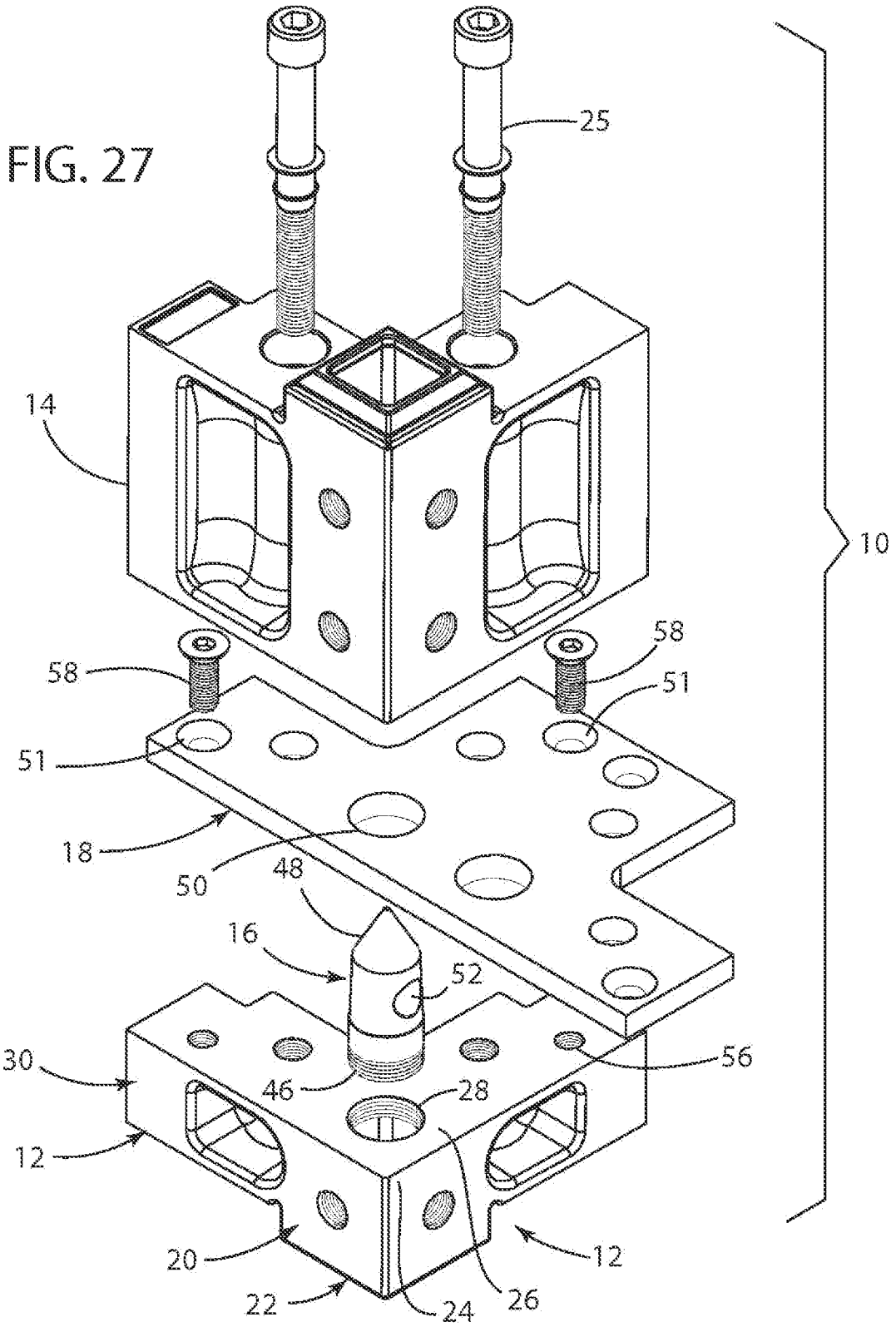
FIG. 27 is an exploded perspective view of a further embodiment of a corner connector assembly in accordance with the specification.
Figure 28:
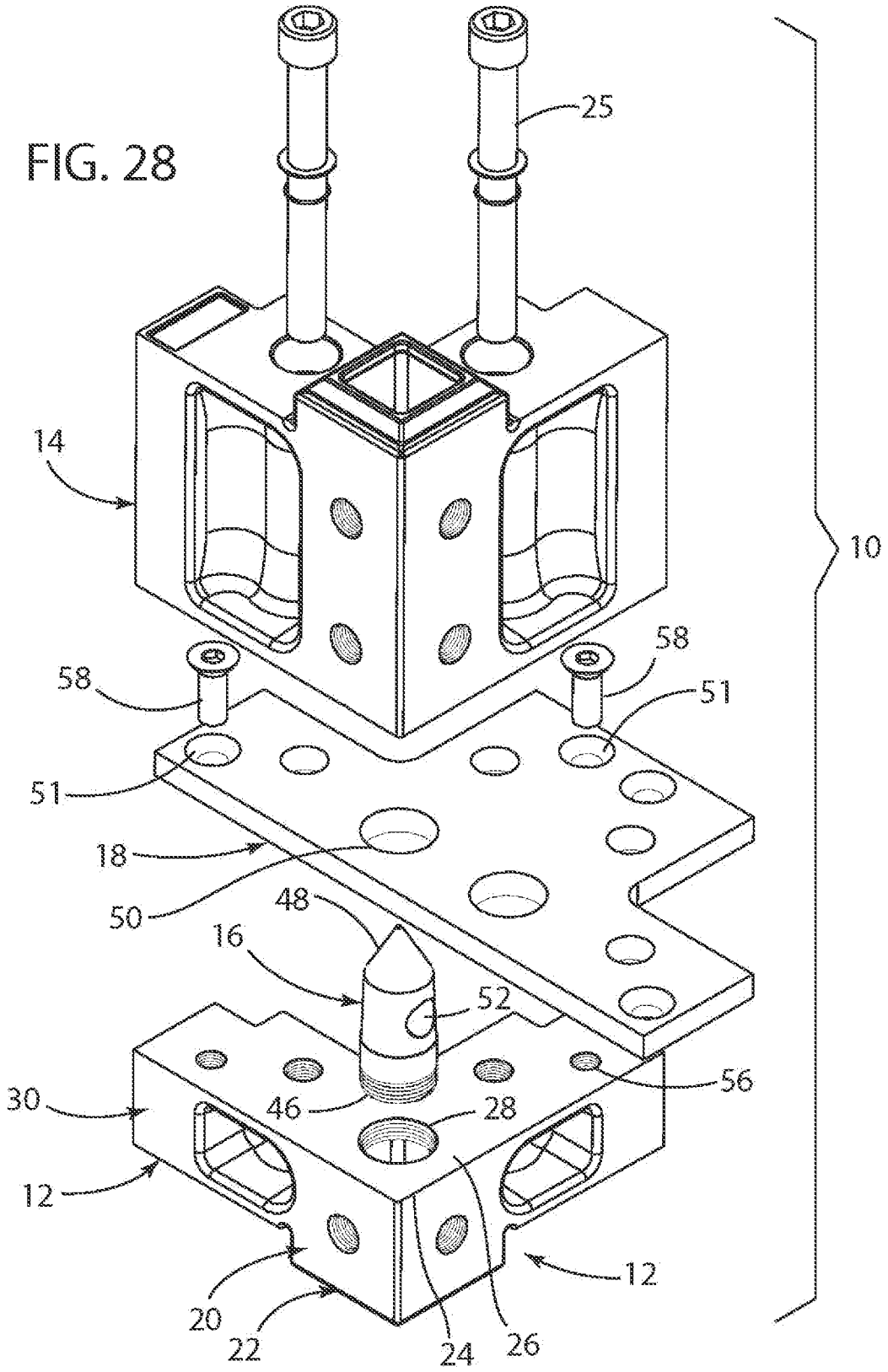
FIG. 28 is an exploded perspective view of another further embodiment of a corner connector assembly in accordance with the specification.

FIGS. 25 and 26 disclose an embodiment of a corner connector where the gusset plate is connected to a single upper connector and a single lower connector. While FIGS. 27 and 28 disclose an alternate embodiment of a gusset plate that engages an adjacent pair of upper connectors and an adjacent pair of lower connectors. This can help with aligning of adjacent module frame units during construction. As should be recognized by a person of ordinary skill in the art, the gusset plate can be modified such that it engages four adjacent module frame units by being present in between four adjacent upper connectors and four adjacent lower connectors, such as in the centre of a modular building.

Figure 29:
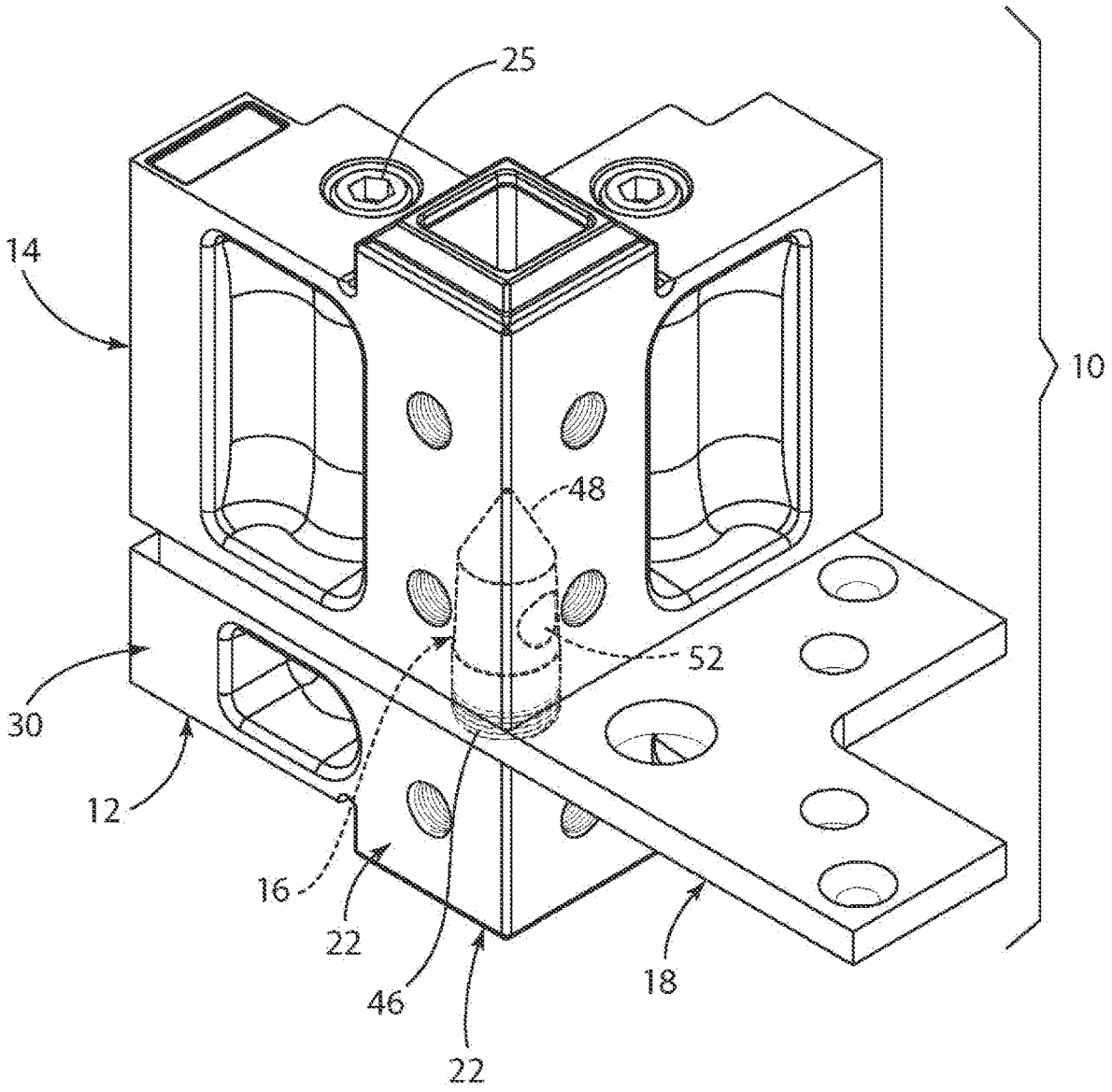
FIG. 29 is a perspective view of a connector assembly showing in phantom the coupling of the upper and lower connector with the gusset plate and pin.
Figure 30:
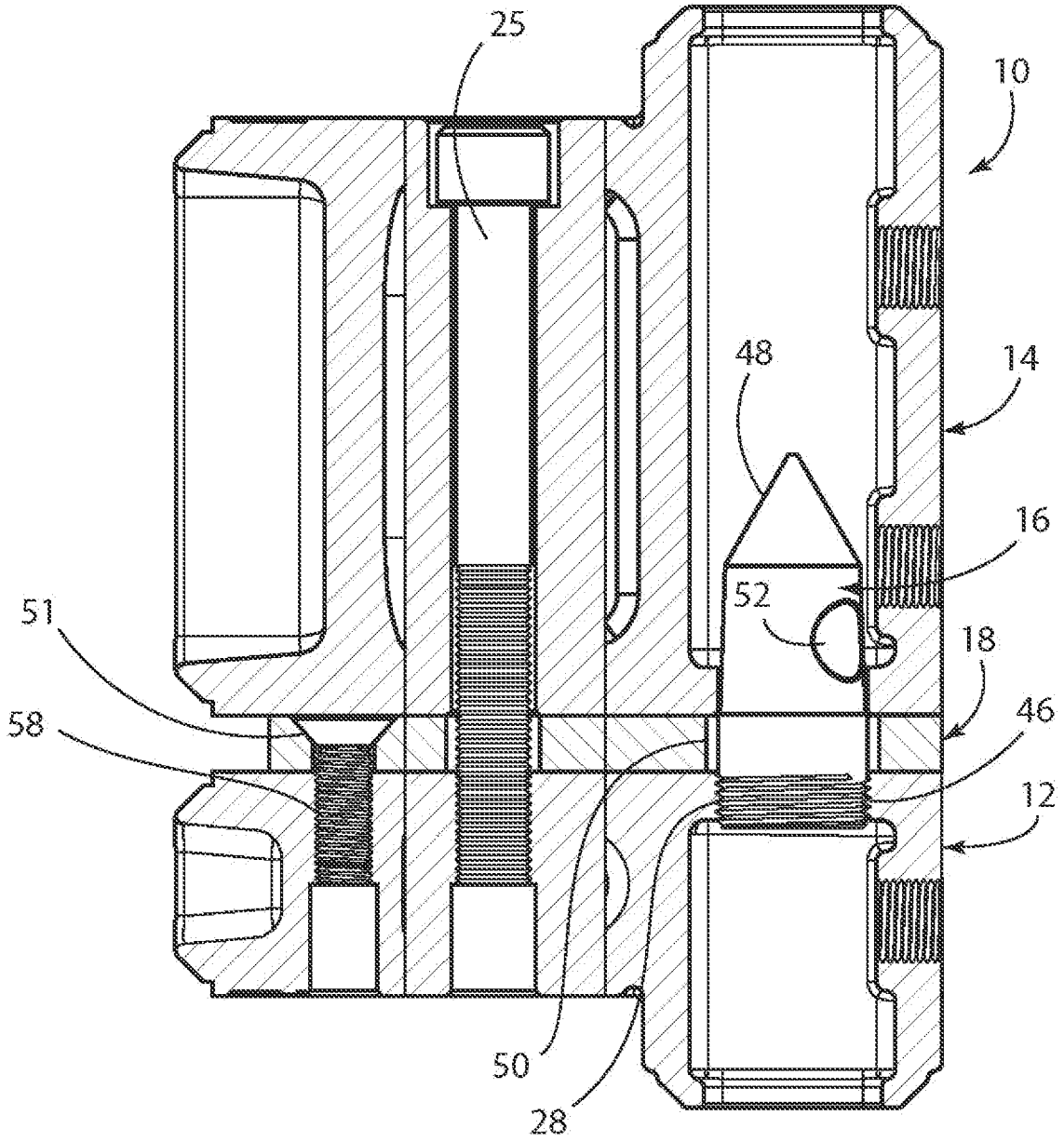
FIG. 30 is a cross-sectional view of the connector assembly of FIG. 29.
Figure 31:
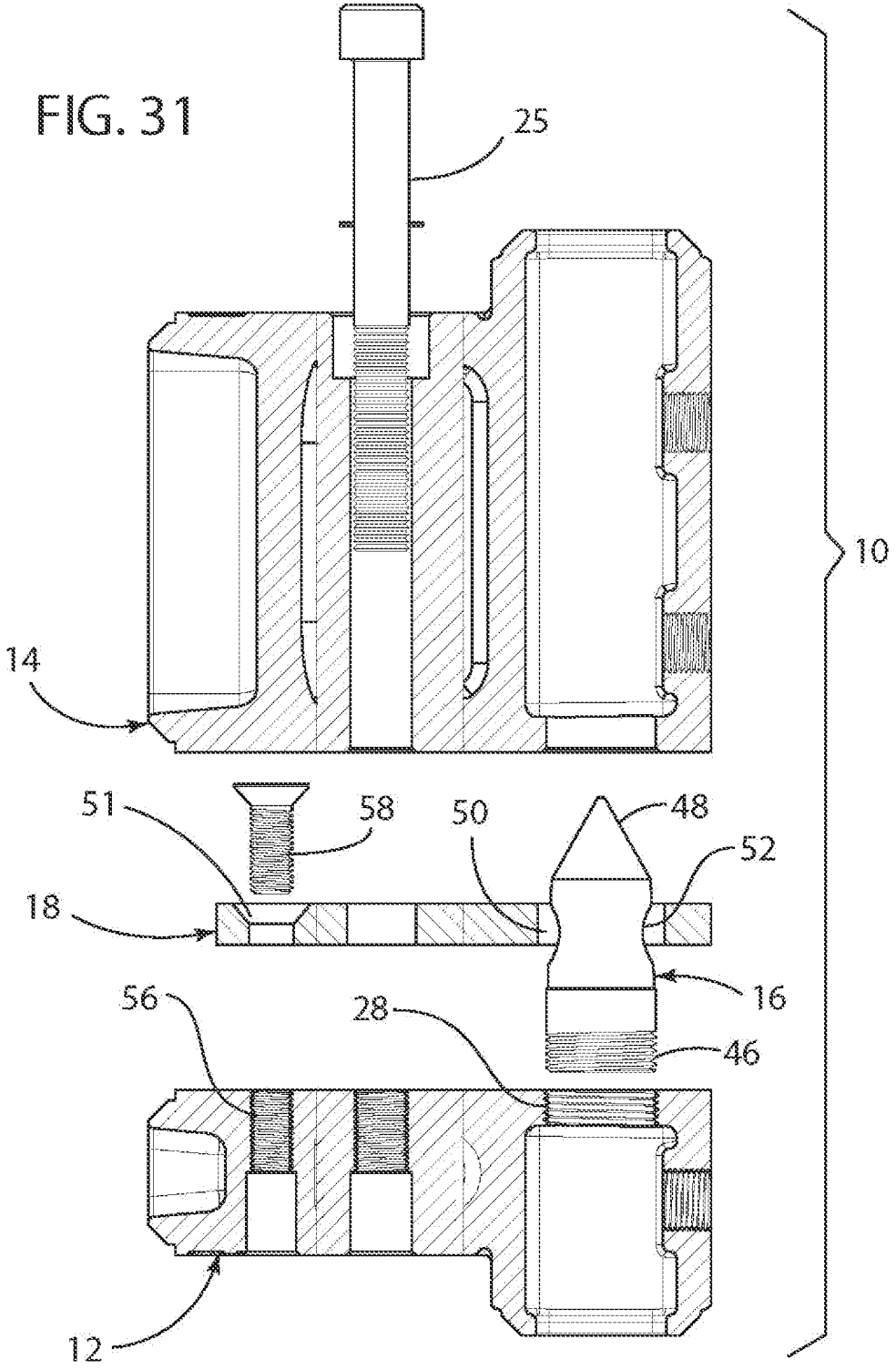
FIG. 31 an exploded cross-sectional view of the connector assembly of FIG. 29.

FIG. 29 shows an embodiment of an assembled corner connector assembly (in phantom) to disclose the pin and how it is positioned. FIGS. 30 and 31 show a cross-sectional view of the assembled (FIG. 30) and exploded (FIG. 31) connector assembly. As shown, the pin is inserted into the opening in the gusset contact face of the lower connector and the conical end of the pin, along with the body of the pin having the pin-hole can be present in the hollow body of the lower connector.

As should be recognized by a person of ordinary skill in the art, the corner connectors disclosed in FIGS. 20-31 are different from that disclosed in the earlier figures, and can be similar to the connectors shown in PCT/CA2015/050369, filed Apr. 30, 2015, and which are incorporated herein by reference; which allow for structural elements, such as HSS, to be welded to the ends of the arms extending from the upper or lower connector.

In one embodiment, as disclosed herein, the circumference or perimeter of the body of the pin allows it to contact or be slightly smaller that the circumference or perimeter of the opening in the second connector. This can help with the connector assembly functioning as a single block. Further, the pin disclosed herein, once engaged in the second connector, can help to reduce lateral displacement caused by the lateral forces at right angles to the pin, that can result in displacement along the plane of contact of the connectors.

As should be recognized by a person of ordinary skill in the art, the module frames can be formed and used in a similar manner as disclosed in PCT application numbers PCT/CA2014/050110, filed Feb. 18, 2014, and PCT/CA2015/050369, filed Apr. 30, 2015, both incorporated herein by reference.

Certain adaptations and modifications of the described embodiments can be made. Therefore, the above discussed embodiments are considered to be illustrative and not restrictive.

| Parts list | |
|---|---|
| 10 | Connector assembly |
| 12 | first (upper) connector |
| 14 | second (lower) connector |
| 16 | pin |
| 18 | gusset plate |
| 20 | first (upper) connector body |
| 22 | first (upper) connector body column receiving end |
| 24 | first (upper) connector body gusset contact end |
| 26 | first (upper) connector body gusset contact face |
| 28 | threaded aperture |
| 30 | first (upper) connector arms |
| 32 | second (lower) connector body |
| 34 | second (lower) connector body column receiving end |
| 36 | second (lower) connector body gusset contact end |
| 38 | second (lower) connector body gusset contact face |

-continued

| Parts list | |
|---|---|
| 40 | opening (not shown) |
| 42 | second (lower) connector arms |
| 44 | pin body |
| 46 | threaded first end |
| 48 | conical second end |
| 50 | passage |
| 52 | pin-hole |
| 54 | holes in gusset-plate |
| 56 | hole in first (upper) connector arm |
| 58 | bolts |
| 60 | hoistable assembly |
| 62 | shackle |
| 64 | pin |

The invention claimed is:

1. A connector assembly comprising a first connector, a second connector, a pin coupling the first connector to the second connector and a gusset plate sandwiched between the first connector and the second connector, the gusset plate having a passage adapted for receiving the pin, the first connector comprising:

a first connector body having a first connector body column receiving end, a first connector body gusset contact end and a first connector body gusset contact face at the first connector body gusset contact end, wherein the first connector body gusset contact face has an aperture; and at least a pair of first connector arms, each first connector arm being coupled to and extending from the first connector body and having a first connector arm inner face, a first connector arm outer face, a first connector arm gusset contact face, a first connector arm load bearing face and a first connector arm beam contact face, the beam contact face being positioned distal from the first connector body, and each first connector arm having at least one first connector arm fixing aperture for receiving a fastening means to couple the second connector to the first connector and at least one first connector arm gusset coupling aperture for receiving a second fastening means to couple the first connector to the gusset plate; and a first connector arm boss coupled to and extending from the first connector arm beam contact face of each first connector arm, the boss having a first connector arm weld receiving bevel extending from a distal end of the arm and a first connector arm weld backer extending from the bevel;

the second connector comprising a second connector body having a second connector body column receiving end, a second connector body gusset contact end and a second connector body gusset contact face at the second connector body gusset contact end, wherein the second connector body gusset contact face has an opening ; and at least a pair of second connector arms, each second connector arm being coupled to and extending from the second connector body and having a second connector arm inner face, a second connector arm outer face, a second connector arm gusset contact face, a second connector arm load bearing face and a second connector arm beam contact face, the beam contact face being positioned distal from the second connector body , and each second connector arm having at least one fixing aperture on the load bearing face for receiving a fastening means to couple the second connector to the first connector; and a second connector arm boss coupled to and extending from the beam contact face of each arm, the boss having a second connector arm weld receiving bevel extending from the distal end of the arm and a second connector arm weld backer extending from the bevel;

the pin comprising a pin-body having a first end and an opposed second end, the first end adapted for coupling the aperture on the first connector body gusset contact face, and the second end adapted for engaging the opening on the second connector body gusset contact face;

wherein the pin further comprises a pin-hole formed on the pin body, and wherein the pin is attachable to a shackle when the pin is not coupled to the second connector, and the pin is capable of forming a hoistable assembly with the first connector and the shackle.

2. The connector assembly of claim 1, wherein the first end of the pin-body is threaded and engages a threaded aperture in the first connector body gusset contact face.

3. The connector assembly of claim 1, wherein the opposed second end of the pin is conical.

4. A connector assembly comprising a first connector and a pin coupled to the first connector, the first connector comprising:

a first connector body having a first connector body column receiving end, a first connector body gusset contact end and a first connector body gusset contact face at the first connector body gusset contact end, wherein the first connector body gusset contact face has an aperture; and at least a pair of first connector arms, each first connector arm being coupled to and extending from the first connector body and having a first connector arm inner face, a first connector arm outer face, a first connector arm gusset contact face, a first connector arm load bearing face and a first connector arm beam contact face, the beam contact face being positioned distal from the first connector body, and each first connector arm having at least one first connector arm fixing aperture for receiving a fastening means to couple a second connector to the first connector and at least one first connector arm gusset coupling aperture for receiving a second fastening means to couple the first connector to the gusset plate; and a first connector arm boss coupled to and extending from the first connector arm beam contact face of each first connector arm, the boss having a first connector arm weld receiving bevel extending from a distal end of the arm and a first connector arm weld backer extending from the bevel;

the pin comprising a pin-body having a first end and an opposed second end, wherein the first end is adapted for coupling the aperture on the first connector body gusset contact face;

wherein the pin further comprises a pin-hole formed on the pin body, and wherein the pin is attachable to a shackle, and the pin is capable of forming a hoistable assembly with the first connector and the shackle.

5. The connector assembly of claim 4, wherein the first end of the pin-body is threaded and engages a threaded aperture in the first connector body gusset contact face.

6. The connector assembly of claim 4, wherein the opposed second end of the pin is conical.

7. A system of modular frame units for forming a modular building, comprising:

a first module frame unit having a first module frame first end coupled to a first connector;

a second module frame unit having a second module frame first end coupled to a second connector; and the first connector and the second connected coupled by a pin and sandwiching a gusset plate, wherein the first connector, the second connector, the pin and the gusset plate are as defined in claim 1.

8. A method for coupling modular frame units for forming a modular building, comprising:

coupling a first connector to a first connector end of a first module frame unit;

coupling a second connector to a second connector end of a second module frame unit; and sandwiching a gusset plate and coupling the first connector and the second connector using a pin to form modular frame units, wherein the first connector, the second connector, the pin and the gusset plate are as defined in claim 1.

9. A modular building comprising the connector assembly as defined in claim 1.

* * * * *